US011850202B1

(12) United States Patent
Minors et al.

(10) Patent No.: US 11,850,202 B1
(45) Date of Patent: Dec. 26, 2023

(54) EXERCISE BOARD

(71) Applicant: 1STEP ENTERPRISES, LLC, Rockledge, FL (US)

(72) Inventors: Clarence E. Minors, Rockledge, FL (US); Sharon J. Minors, Rockledge, FL (US)

(73) Assignee: 1STEP ENTERPRISES, LLC, Rockledge, FL (US)

( * ) Notice: Subject to any disclaimer, the term of this patent is extended or adjusted under 35 U.S.C. 154(b) by 0 days.

(21) Appl. No.: 18/199,197

(22) Filed: May 18, 2023

Related U.S. Application Data

(60) Provisional application No. 63/343,826, filed on May 19, 2022.

(51) Int. Cl.
*A61H 1/02* (2006.01)
*A63B 23/00* (2006.01)

(52) U.S. Cl.
CPC ..... *A61H 1/0266* (2013.01); *A63B 23/00* (2013.01); *A61H 2205/10* (2013.01); *A63B 2023/006* (2013.01)

(58) Field of Classification Search
CPC .. A61H 1/0266; A61H 2205/10; A63B 23/00; A63B 2023/006; A63B 23/08; A63B 22/16; A63B 23/085; A63B 21/0407; A63B 21/022; A63B 21/0085; A63B 21/4047; A63B 21/4015; A63B 21/0557; A63B 21/05; A63B 21/151; A63B 21/22; A63B 21/0442; A63B 2210/58; A63B 23/10; A63B 2210/52; A63B 2210/56; A63B 2022/0038; A63B 2022/0097; A63B 2210/54; A63B 2210/50; A63B 23/03508; A63B 21/4034; A63B 21/0552; A63B 21/023; A63B 21/0421; A63B 2209/14; A63B 2225/093; A63B 71/0036; A63B 2208/0252; A63B 2225/62; A63B 2208/0228; A63B 2209/10; A63B 2209/08
See application file for complete search history.

(56) References Cited

U.S. PATENT DOCUMENTS 2,144,962 A * 1/1939 Bresnahan ..... A63K 3/023 482/19
3,297,320 A * 1/1967 Di Benedetto ..... A63B 23/085 482/79
3,401,931 A * 9/1968 McCafferty ..... A63K 3/023 482/19
3,472,508 A * 10/1969 Baker ..... A63B 25/06 482/79
5,087,036 A * 2/1992 Cooper ..... A63B 23/085 482/79
5,672,144 A * 9/1997 Hulme ..... A63B 23/0211 482/91

(Continued)

*Primary Examiner* — Garrett K Atkinson
(74) *Attorney, Agent, or Firm* — Brian S. Steinberger; Hilary F. Steinberger; Law Offices of Brian S. Steinberger, P.A.

(57) ABSTRACT

Portable exercise incline board devices and methods for exercise and balance fitness that can be easily assembled, disassembled and transported. The incline board can be assembled from a generally rectangular top ice with raised upper surface, along with a pair of right triangle support pieces and a rear vertical piece wherein raised protrusions align into mateable grooves so that the pieces slide and lock together for assembly and slide apart for disassembly.

17 Claims, 55 Drawing Sheets

(56) References Cited

U.S. PATENT DOCUMENTS 5,871,216 A * 2/1999 Sparacino ..... A63B 63/08 273/402
6,244,992 B1 * 6/2001 James ..... A61H 1/0237 482/79
6,572,514 B1 * 6/2003 Calafato ..... A63B 22/16 482/79
6,705,975 B2 * 3/2004 Kuo ..... A63B 23/0429 482/52
6,808,476 B2 * 10/2004 Zagone ..... A63B 21/023 482/80
6,932,345 B1 * 8/2005 O'Dell ..... A63B 67/06 273/402
7,237,777 B2 * 7/2007 Digges, III ..... A63B 67/06 273/400
D551,803 S * 9/2007 Durante ..... D28/61
8,029,420 B1 * 10/2011 Thati ..... A63B 22/0056 482/79
8,092,350 B2 * 1/2012 Chinag ..... A63B 21/00181 482/52
8,360,940 B2 * 1/2013 Kole ..... A63B 21/0552 482/79
8,801,579 B2 * 8/2014 Beck ..... A63B 23/04 482/907
D726,844 S * 4/2015 Mathew ..... D21/685
D729,885 S * 5/2015 Wampler ..... D21/662
D729,886 S * 5/2015 Wampler ..... D21/662
9,931,540 B1 * 4/2018 Lazar ..... A63B 26/003
10,499,741 B2 * 12/2019 Flancer ..... A47C 4/00
10,549,142 B1 * 2/2020 Ash ..... A61H 1/0266
11,324,998 B2 * 5/2022 Amis ..... A61H 1/0266
11,638,852 B2 * 5/2023 Tarkington ..... A63B 21/023 482/80
2003/0073550 A1 * 4/2003 Hsu ..... A63B 23/085 601/28
2005/0272563 A1 12/2005 Liang
2006/0240955 A1 * 10/2006 Pu ..... A61H 1/0266 482/79
2014/0100086 A1 * 4/2014 Pagliaro ..... A61H 1/0237 482/91
2019/0160322 A1 * 5/2019 McCarthy ..... A63B 21/4034
2021/0207760 A1 * 7/2021 Perelli ..... G06F 1/1632

* cited by examiner

EXERCISE BOARD

CROSS REFERENCE TO RELATED APPLICATIONS

This application claims the benefit of priority to U.S. Provisional Application Ser. No. 63/343,826 filed May 19, 2022, the entire disclosure of which is incorporated herein by specific reference thereto.

FIELD OF INVENTION

This invention relates to exercise, and in particular to devices, systems and methods for providing a portable exercise incline board for exercise and balance fitness that can be easily assembled, disassembled and transported.

BACKGROUND AND PRIOR ART

Slant and incline boards have been proposed over the years for balancing fitness and for stretching heel, hamstring, Achilles, and leg muscles. See for example, RO&LY Portable Slant Board-Adjustable incline board; StronTek Portable Slant Board. However, these types of slant boards be large and cumbersome and difficult to transport, and not able to be taken apart, and generally require metal parts that would be difficult to take on planes.

Thus, the need exists for solutions to the above problems with the prior art.

SUMMARY OF THE INVENTION

A primary objective of the present invention is to provide devices, systems and methods for providing a portable exercise incline board for exercise and balance fitness that can be easily assembled, disassembled and transported.

A secondary objective of the present invention is to provide inexpensive and plastic devices, systems and methods for providing a portable exercise incline board.

An embodiment of the exercise incline board, can include a generally rectangular top piece with rounded top end and angled lower end, the top piece having a raised upper surface, and hexagon shape grooves along a lower surface, a rear vertical support piece having hexagon shape protrusions along an upper end, and a plurality of elongated grooves along an inner face; and a pair of right angle support pieces, each having raised protrusions along each outer vertical leg, wherein the raised protrusions for aligning into the plurality of elongated grooves of the inner face of the rear vertical support, and the hexagon shape protrusions on the upper end of the rear vertical support piece for aligning into the hexagon shape grooves along the lower surface of the generally rectangular top piece.

Another embodiment of a plastic incline exercise board can include: a top board having an upper side with raised surface edges, and a lower side with a plurality of slots; a pair of generally triangular support pieces, each having an upper inclined top side with a plurality of upper raised clips, and a rear side with a plurality of raised rear clips, the upper raised clips adapted to be inserted and locked in the plurality of slots in the lower side of the top board; and a rear vertical support piece having one side with a plurality of slots, wherein the raised rear clips on each of the pair of triangular support pieces are adapted to be inserted into and locked in the plurality of slots on the rear vertical support piece.

The top board can have a generally rectangular shape, and the rear vertical support piece has a generally rectangular shape smaller than the rectangular shape of the top board.

Each of the triangular support pieces can include a front footer, and a rear footer.

The plurality of upper raised clips can include three clips arranged in a first direction, and the plurality of raised rear clips can include two clips arranged in a second direction, the first direction being different from the second direction.

Each of the upper raised clips and raised rear clips can be L-shaped clips.

Each of the plurality of slots on the lower side of the top board can have a step ledge.

Each of the plurality of slots in the rear vertical support piece can have a step ledge.

The top board can have a triangular shaped front end for allowing the front end of the top board to sit flush on a floor surface.

The triangular shaped front end of the top board can have a greppable surface pad.

The plastic incline exercise board include a flexible mat adapted to fit underneath the exercise board.

The plurality of slots in the top board can be six slots.

The plurality of slots in the rear vertical support piece can be four slots.

Each of the slots can have a step ledge.

Another embodiment of the exercise board assembly for feet, can include a top board having an upper side, and a lower side with a plurality of slots, a pair of support pieces, each having an upper inclined top side with a plurality of upper raised clips, and a rear side with a plurality of raised rear clips, the upper raised clips adapted to be inserted and locked in the plurality of slots in the lower side of the top board, and a single rear vertical piece having a plurality of slots, wherein the raised rear clips on the pair of support pieces are adapted to be inserted into and locked in the plurality of slots on the rear vertical support piece.

Each of the slots can have a step ledge.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

First Embodiment

Second Embodiment

Figure 23:
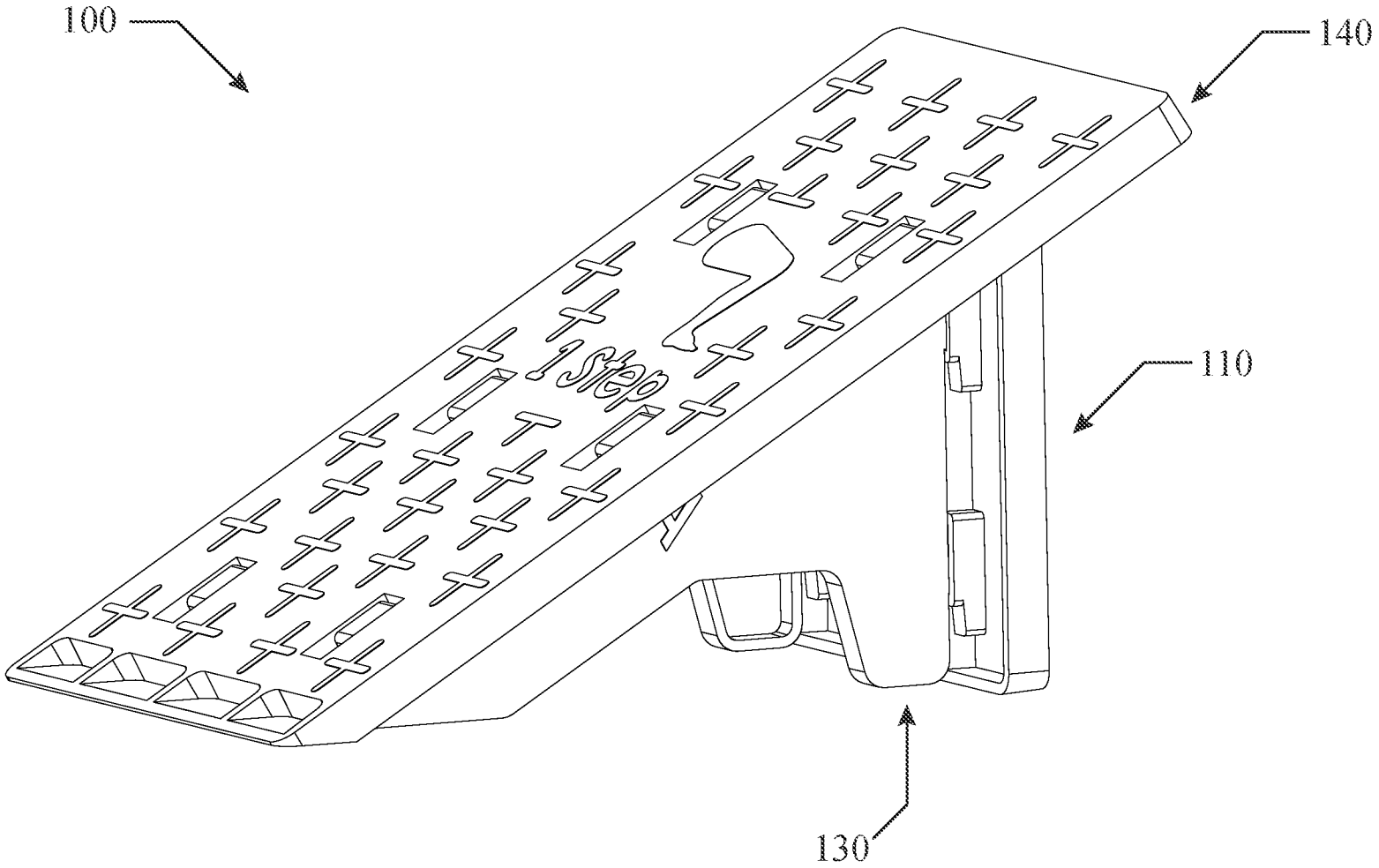

FIG. 23 is an upper front right perspective view of an assembled second embodiment of an incline/exercise board.

Figure 24:
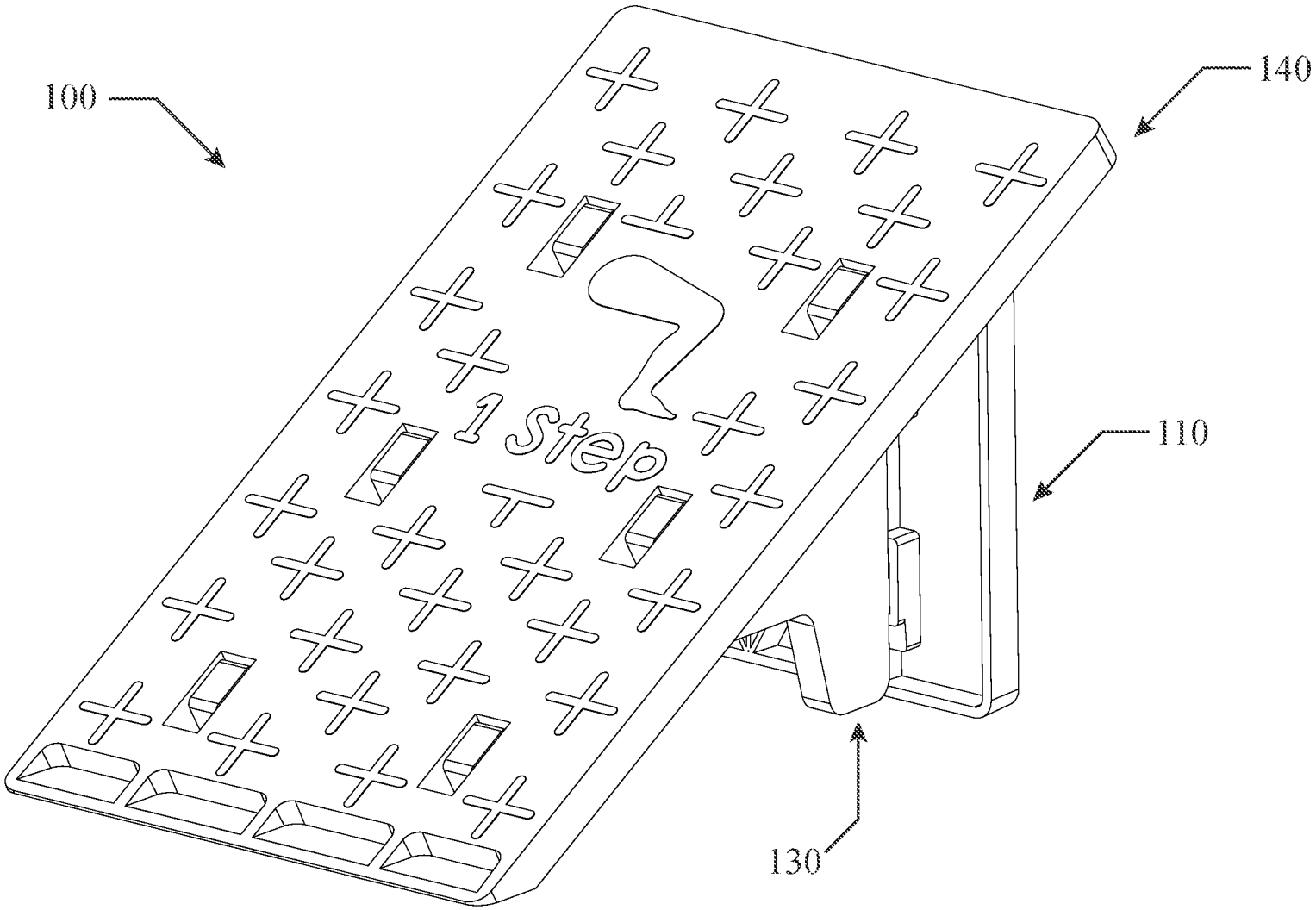

FIG. 24 is another upper front right perspective view of the assembled incline/exercise board of FIG. 23.

Figure 25:
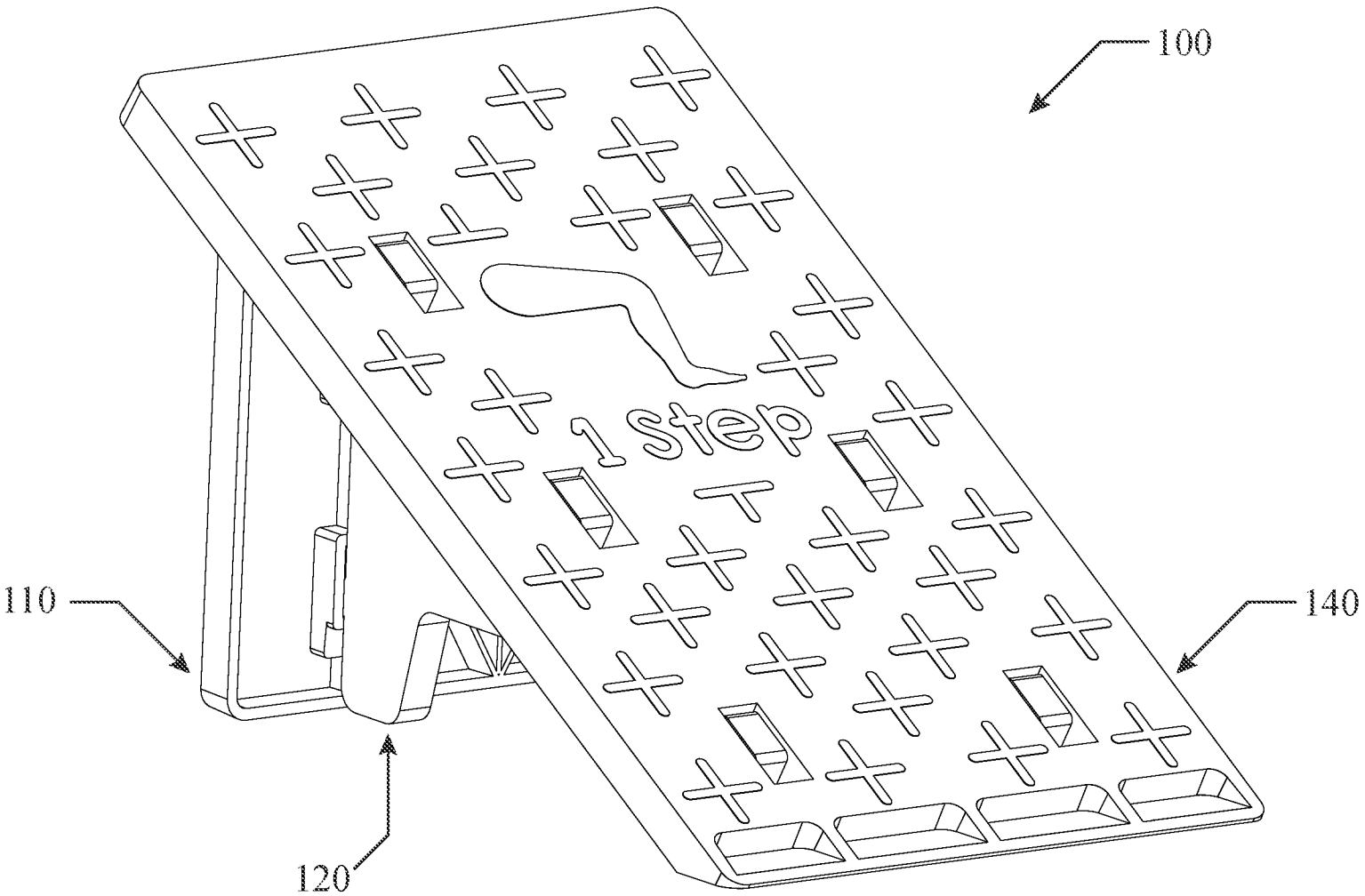

FIG. 25 is an upper front left perspective view of the incline/exercise board of FIG. 23.

Figure 26:
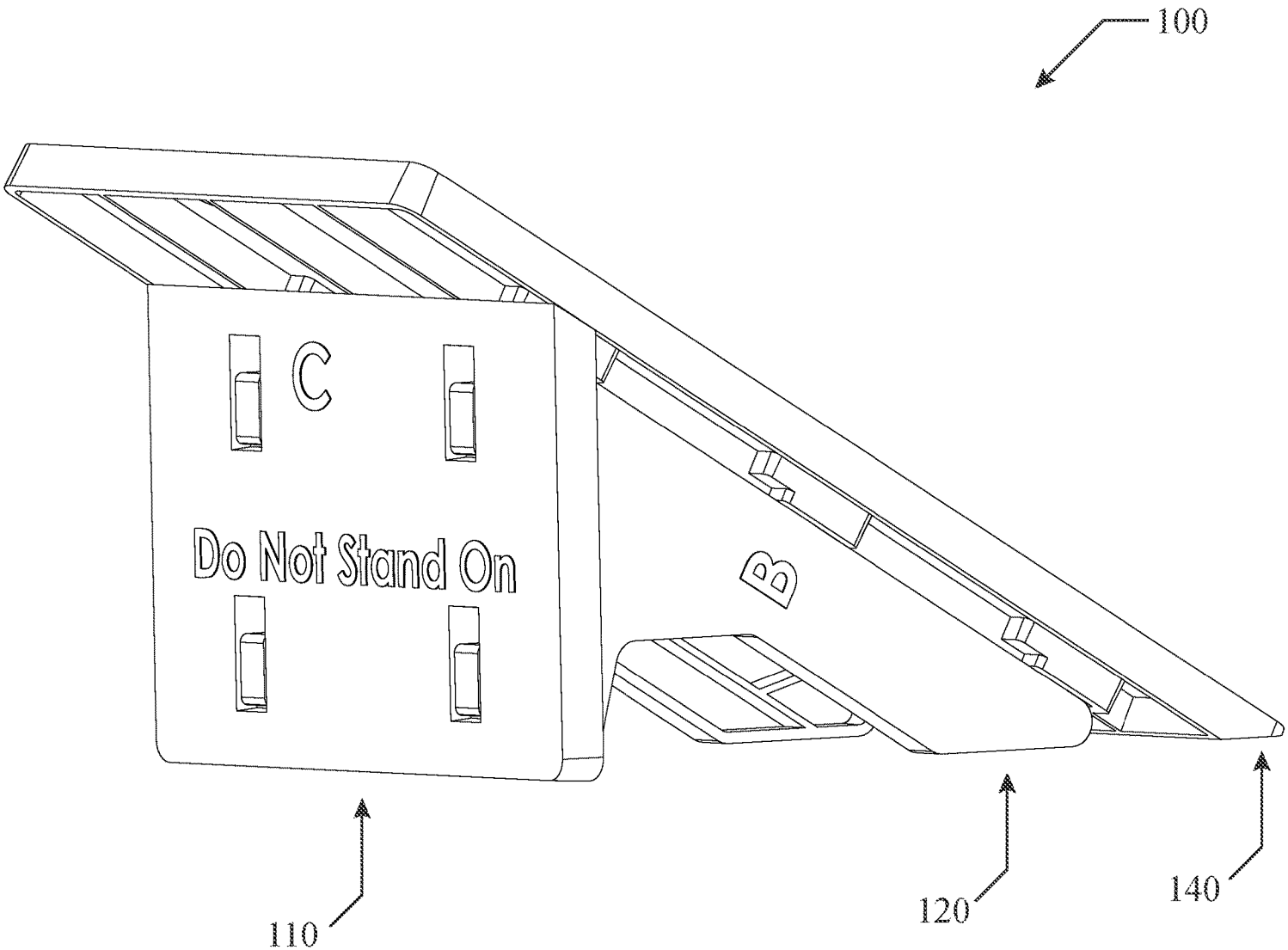

FIG. 26 is a rear right perspective view of the incline/exercise board of FIG. 23.

Figure 27:
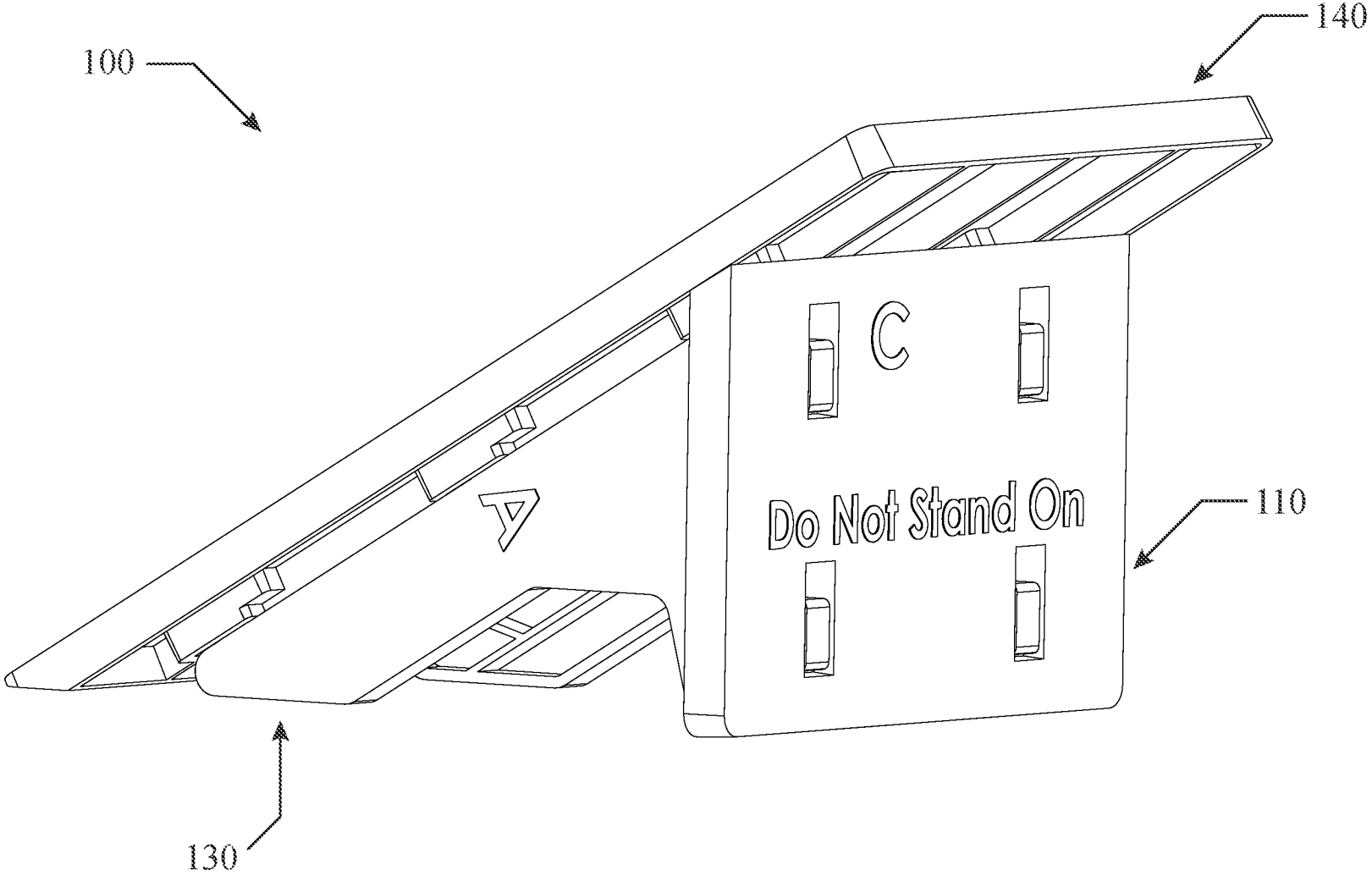

FIG. 27 is a rear left perspective view of the incline/exercise board of FIG. 23.

Figure 28:
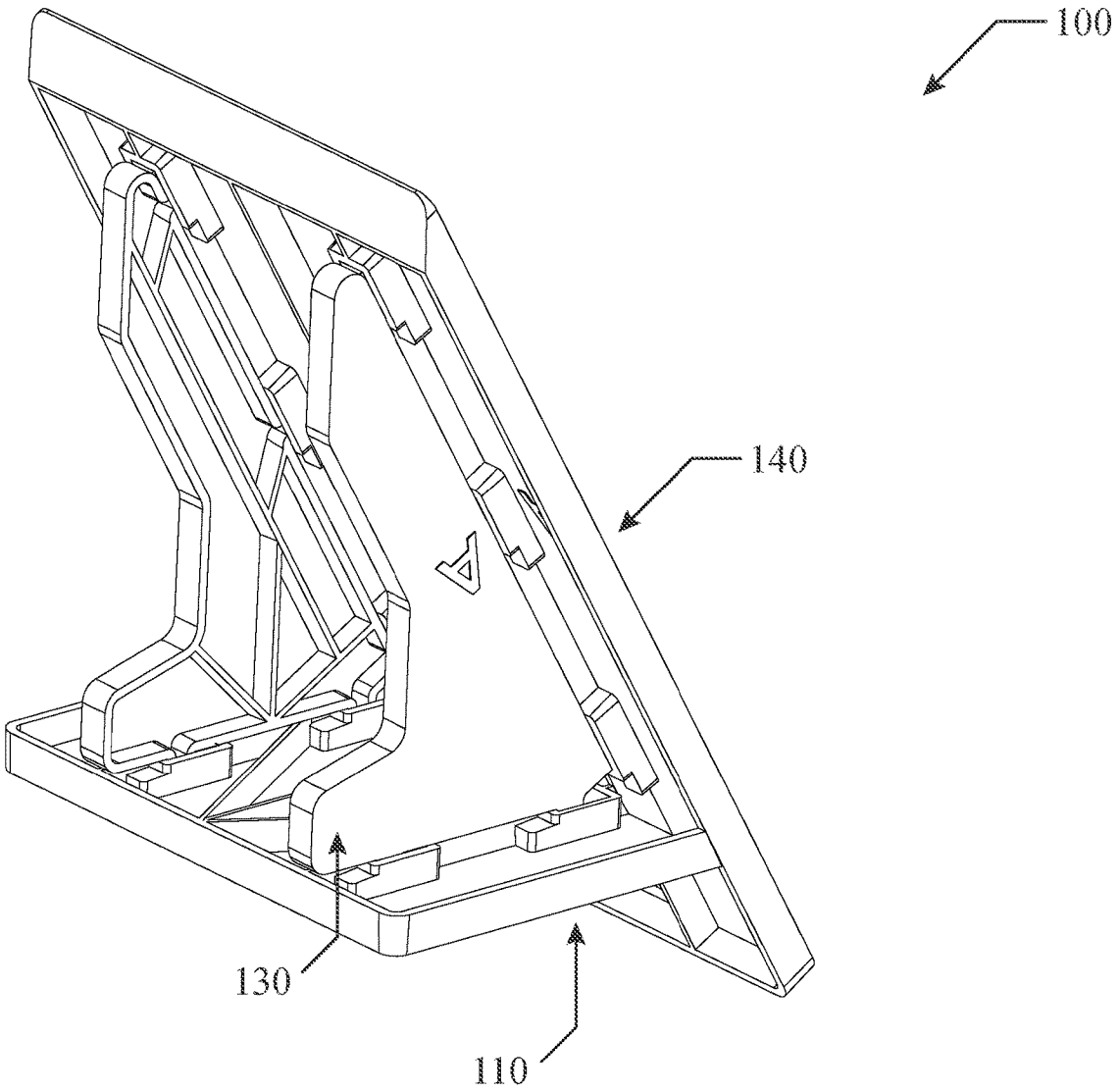

FIG. 28 is a rear right perspective view of the incline/exercise board of FIG. 23.

Figure 29:
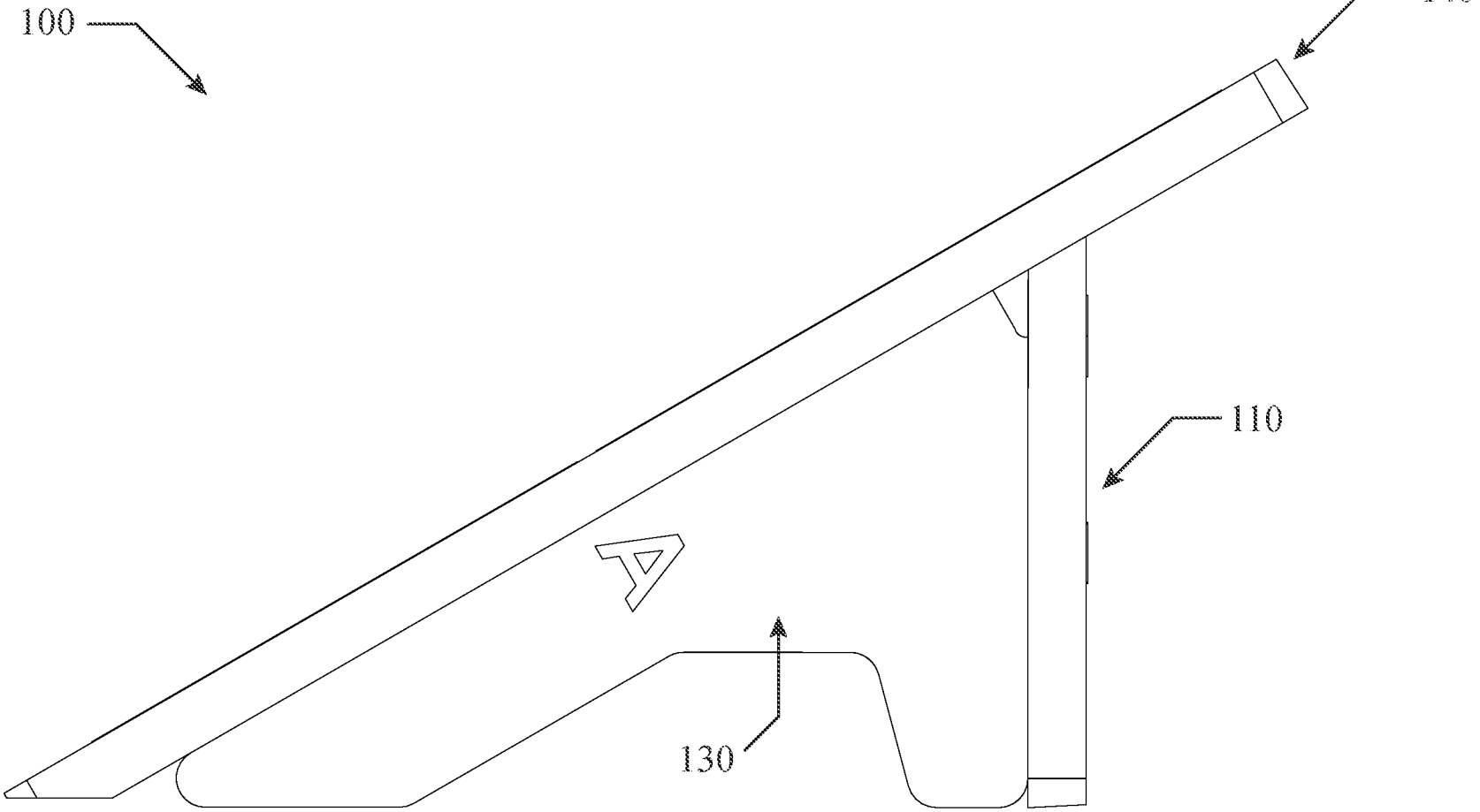

FIG. 29 is a left side perspective view of the incline/exercise board of FIG. 23.

Figure 30:
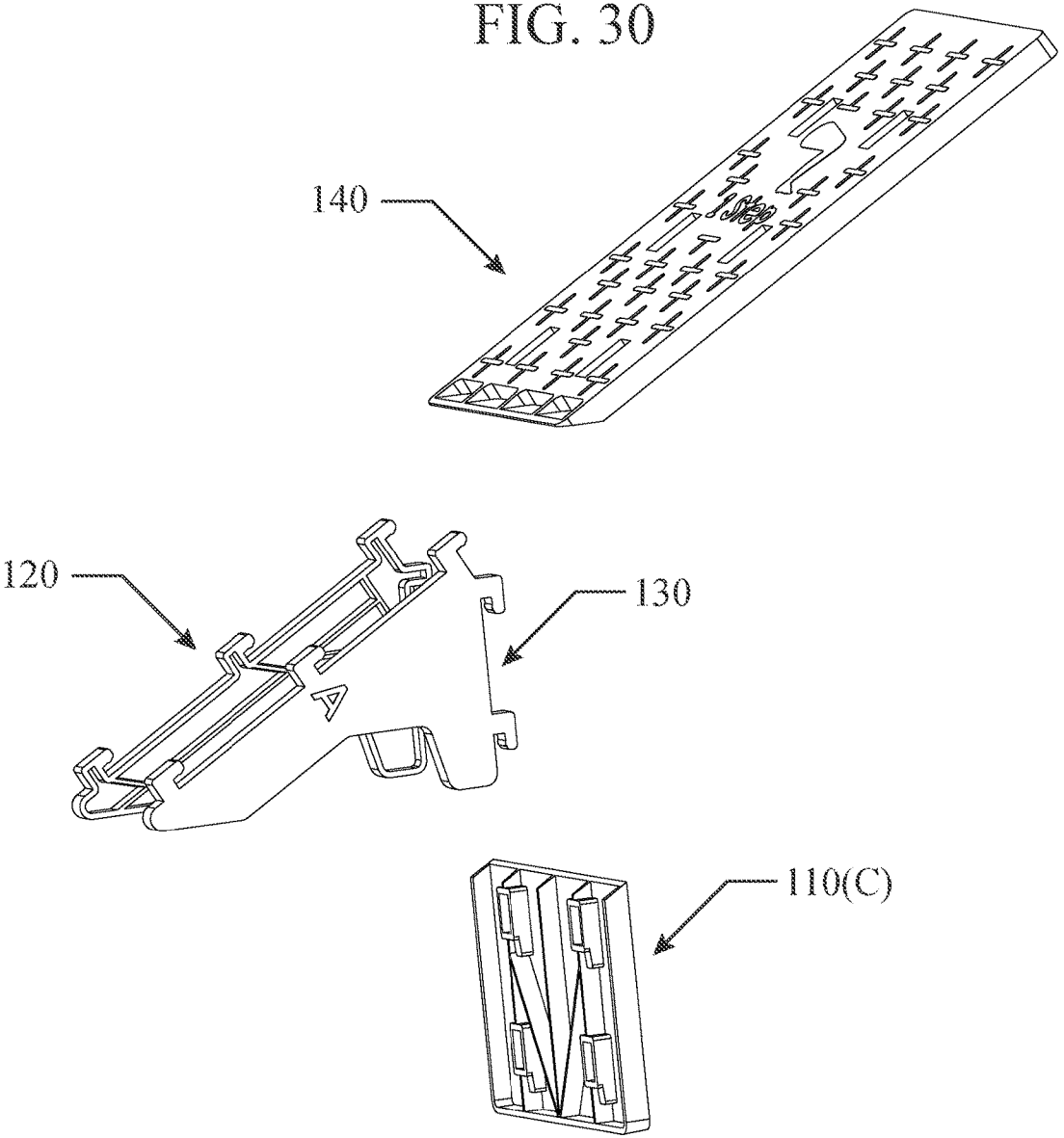

FIG. 30 is an exploded perspective view of the incline/exercise board of FIG. 23.

Figure 31:
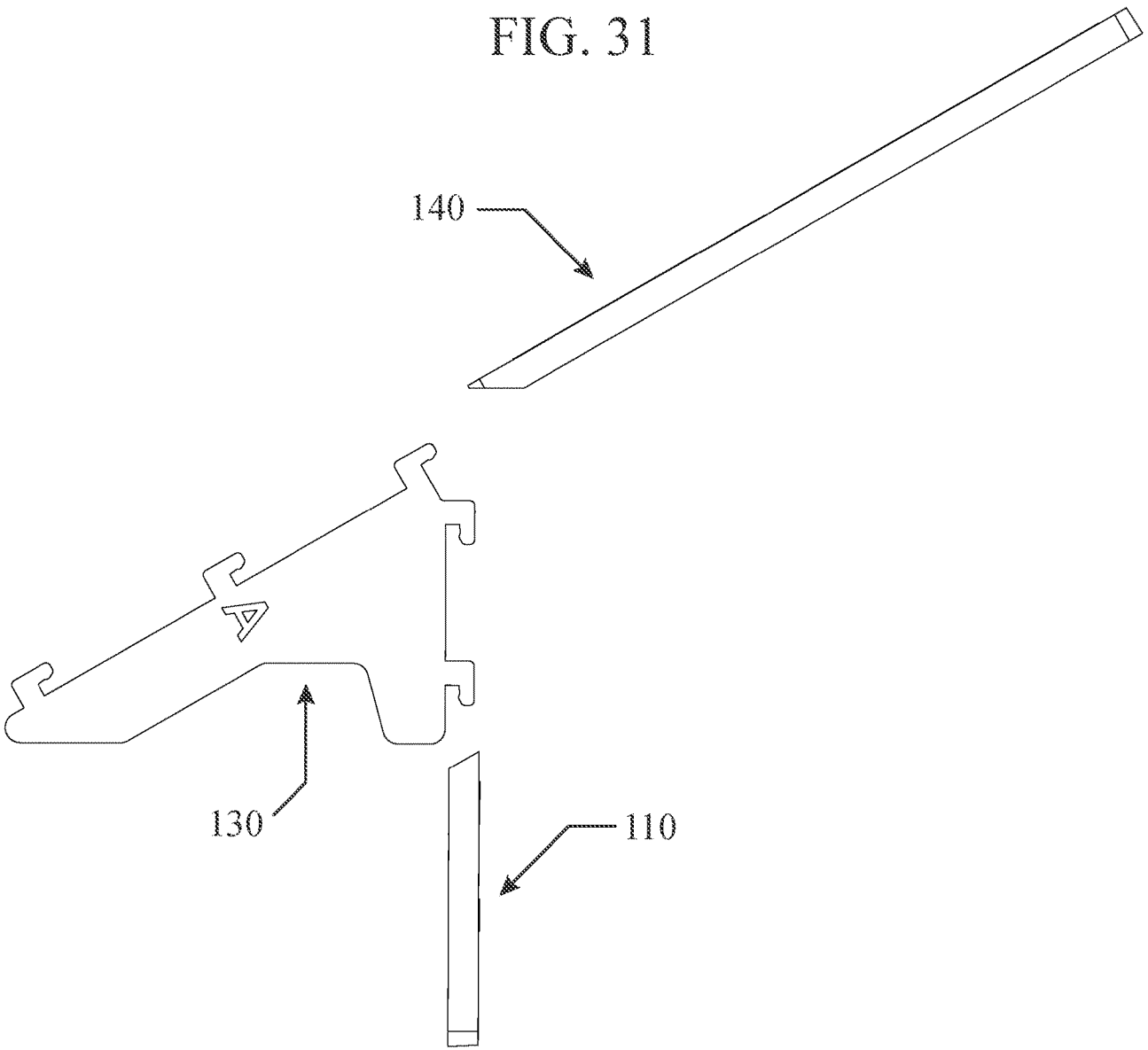

FIG. 31 is a right side view of the exploded incline/exercise board of FIG. 30.

Figure 32:
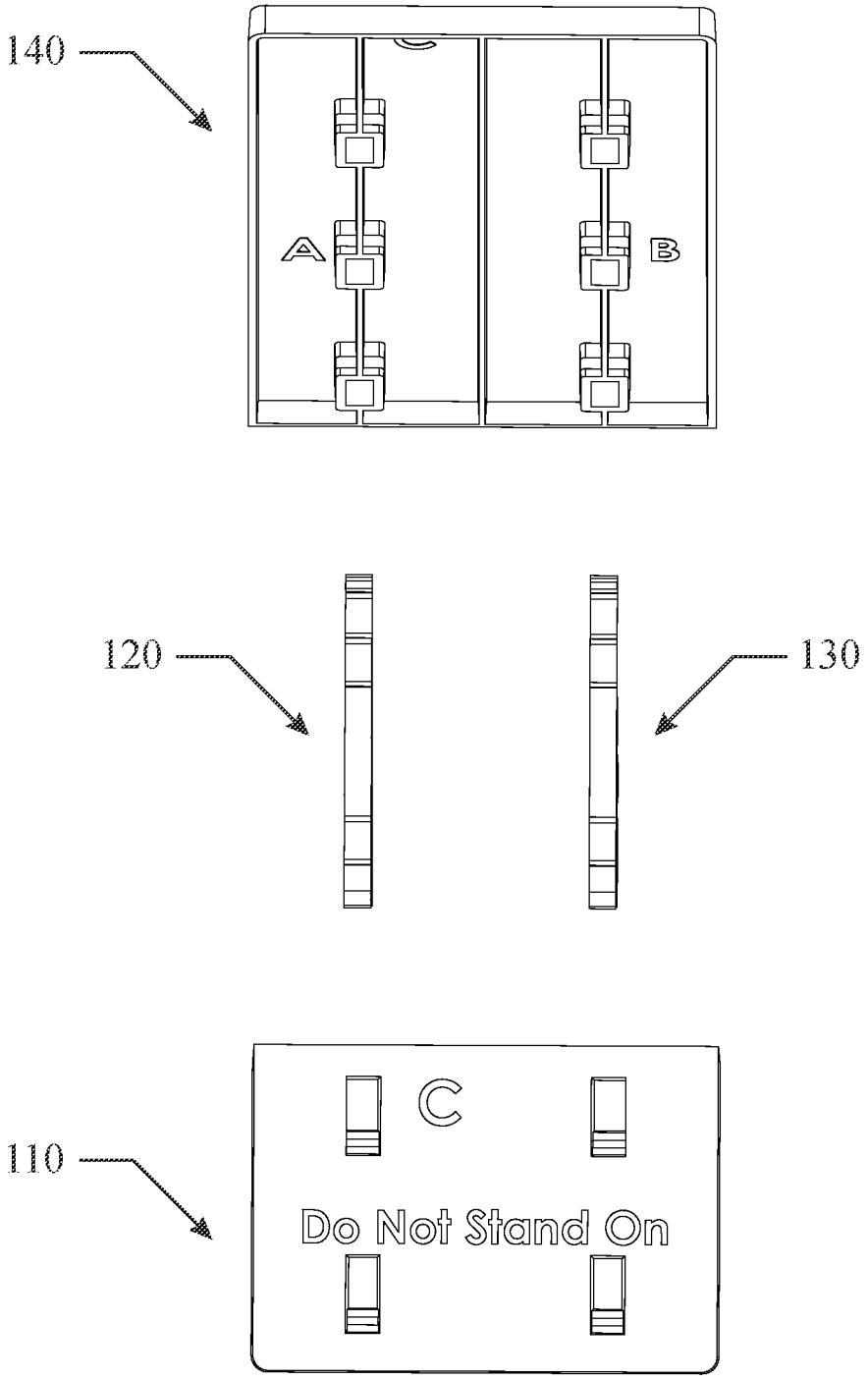

FIG. 32 is a rear side view of the exploded incline/exercise board of FIG. 30.

Figure 33:
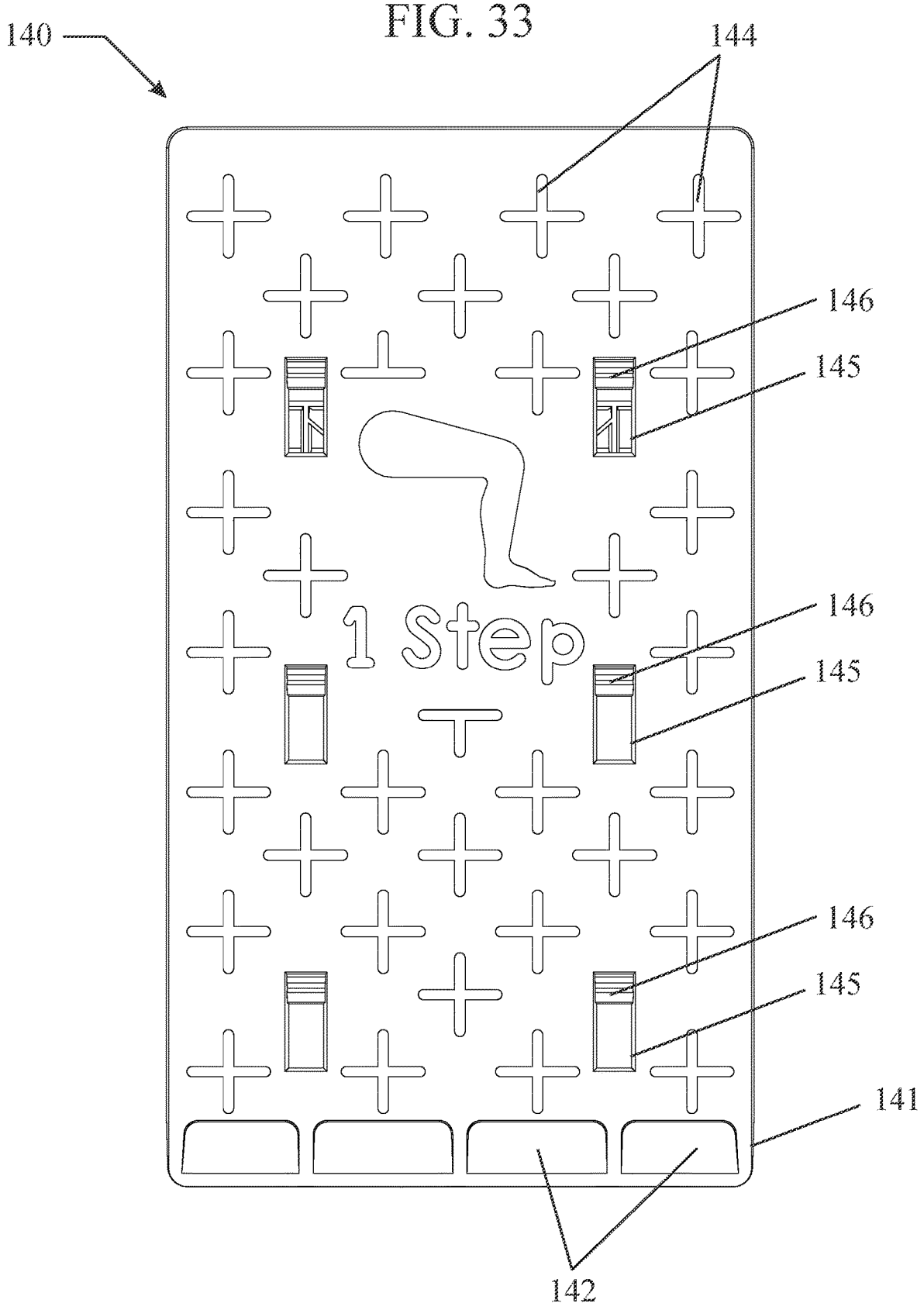

FIG. 33 is a front perspective view of the top piece of the incline/exercise board of FIGS. 23-32.

Figure 34:
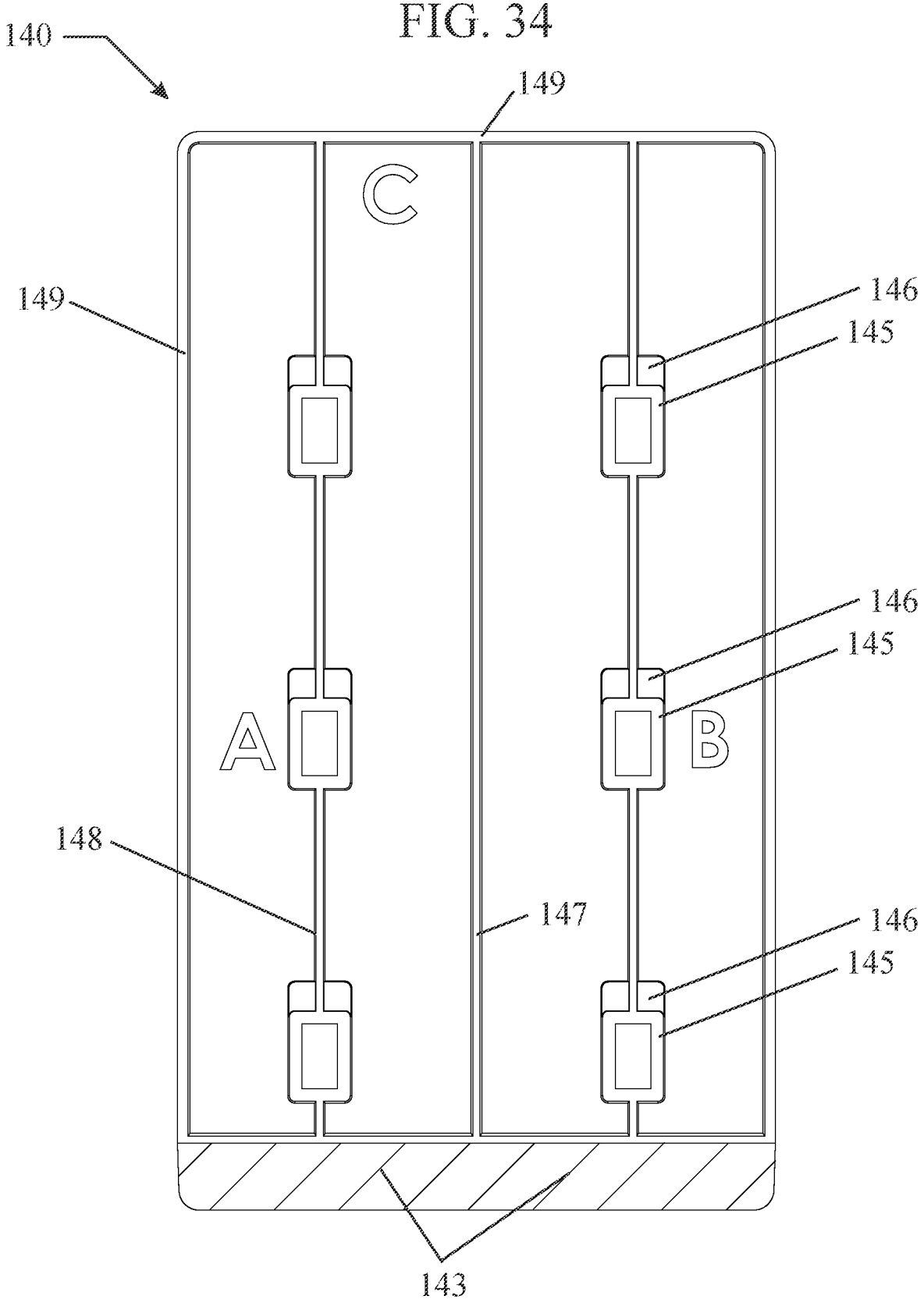

FIG. 34 is a rear perspective view of the top piece of the incline/exercise board of FIG. 33.

Figure 35:
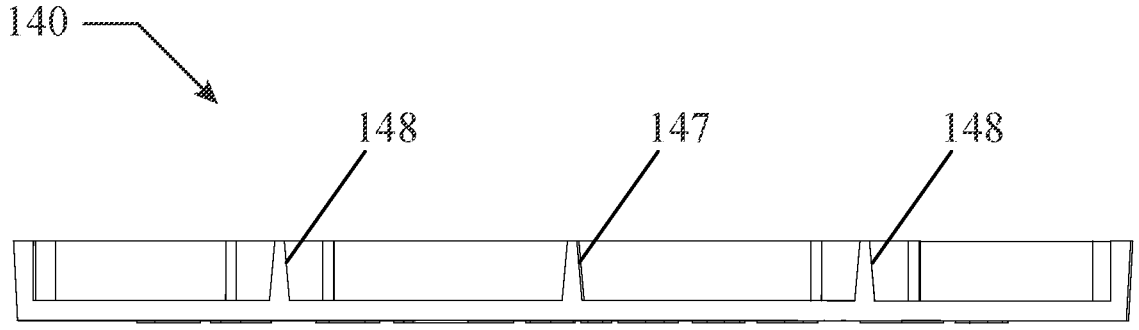

FIG. 35 is a bottom end perspective view of the top piece of the incline/exercise board of FIG. 33.

Figure 36:
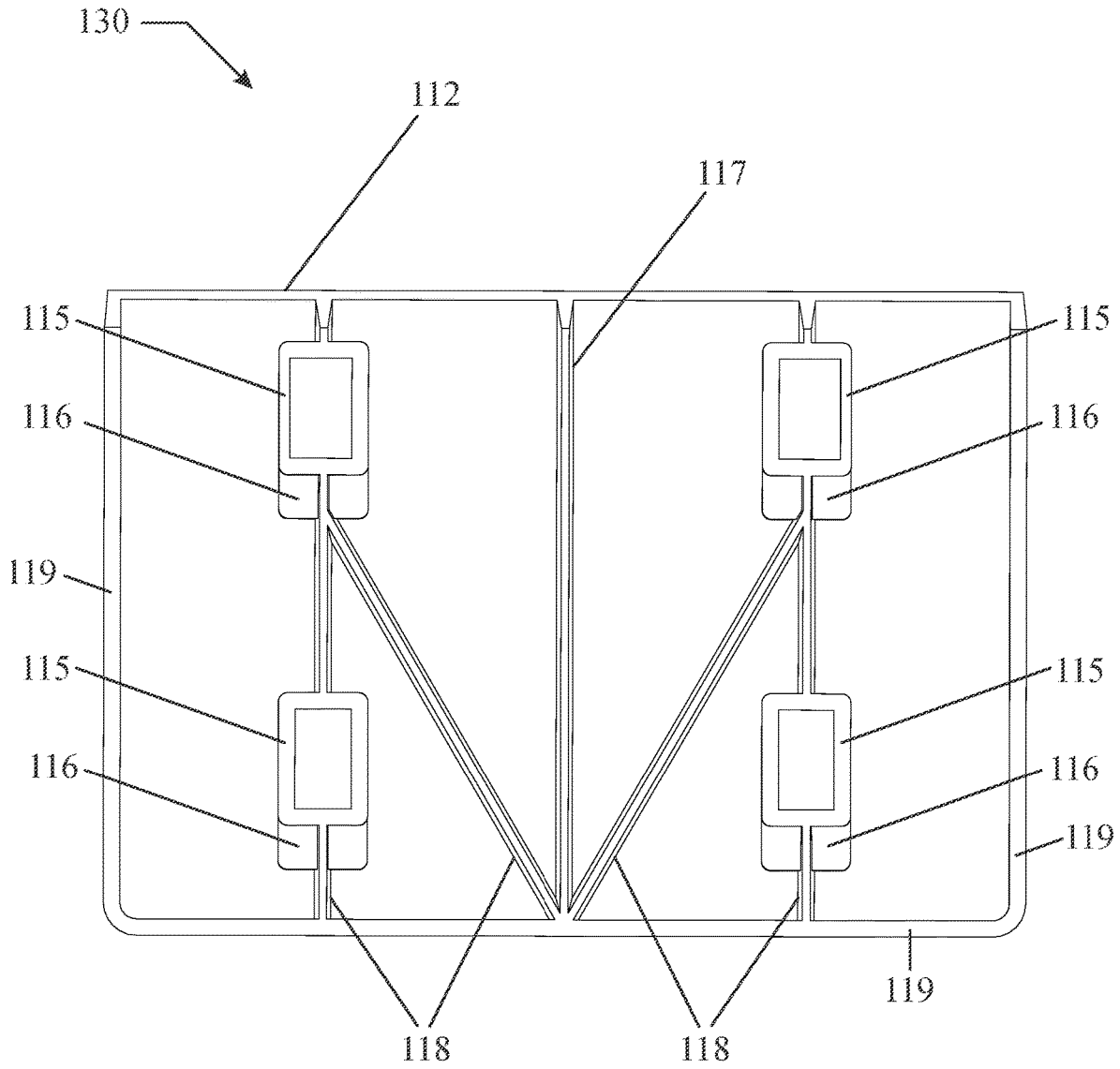

FIG. 36 is a rear perspective view of the rear vertical support piece of the incline/exercise board of FIGS. 23-32.

Figure 37:
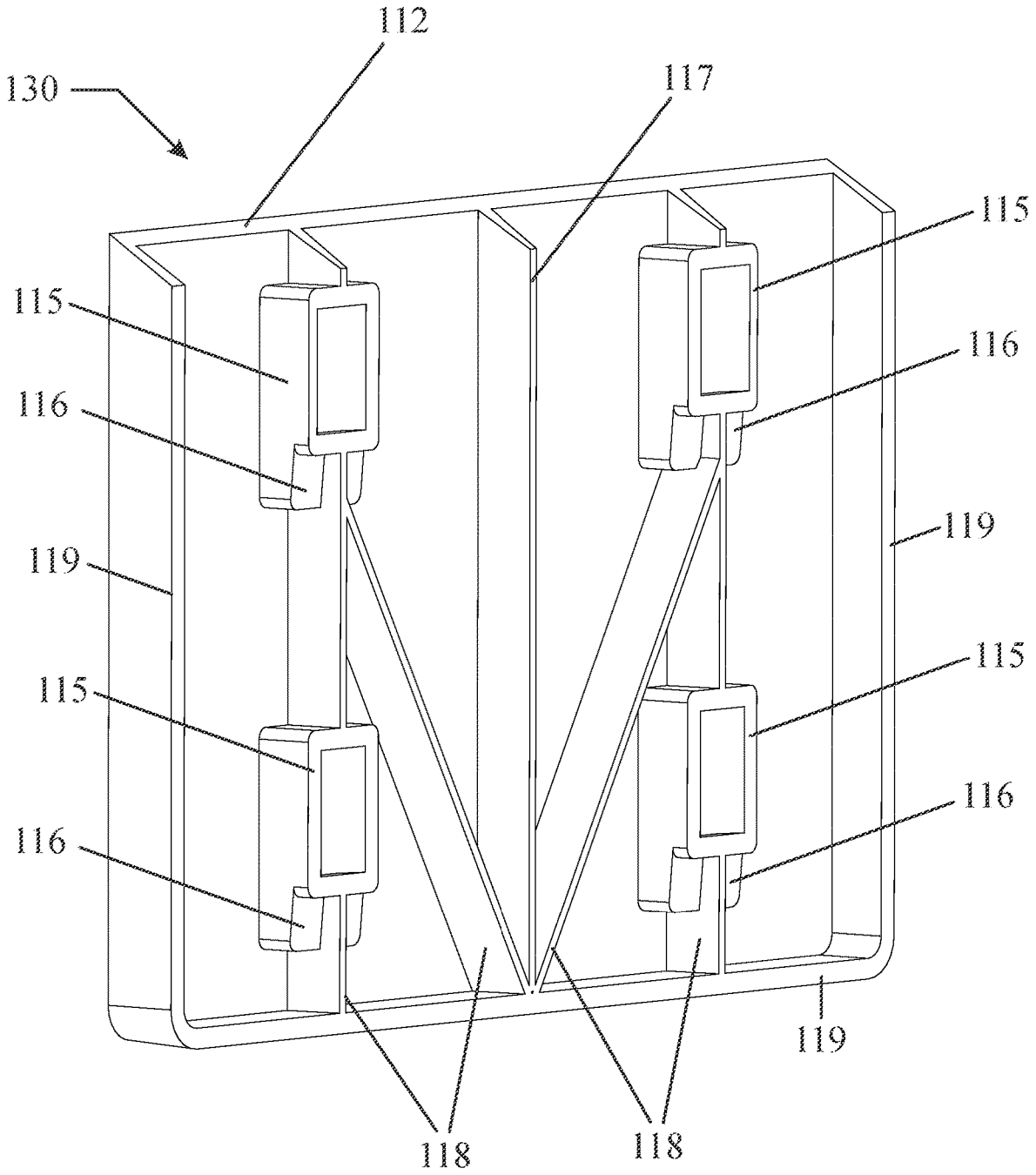

FIG. 37 is an upper rear left perspective view of the rear vertical support piece of the incline/exercise board of FIG. 36.

Figure 38:
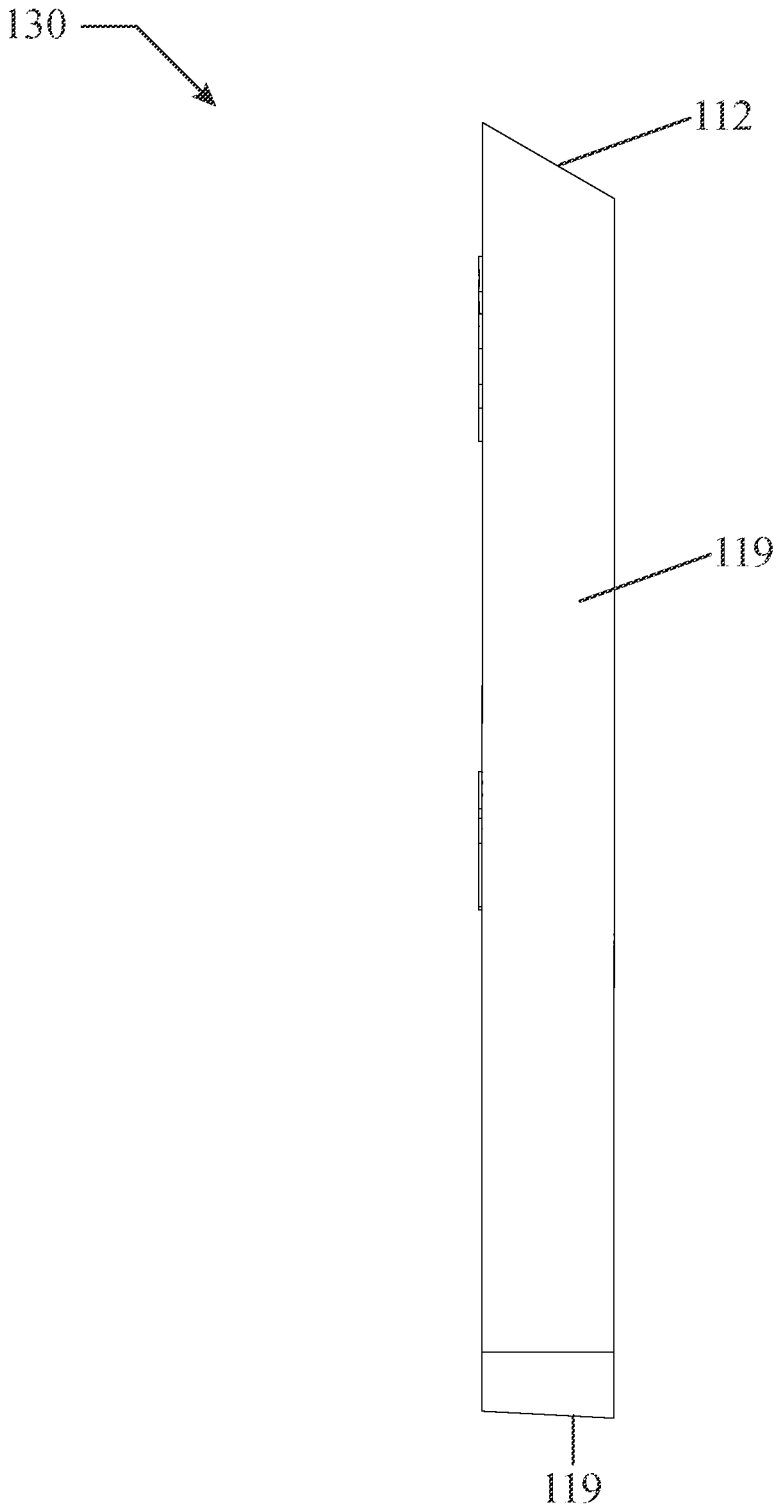

FIG. 38 is a left side view of the rear vertical support piece of the incline/exercise board of FIG. 36.

Figure 39:
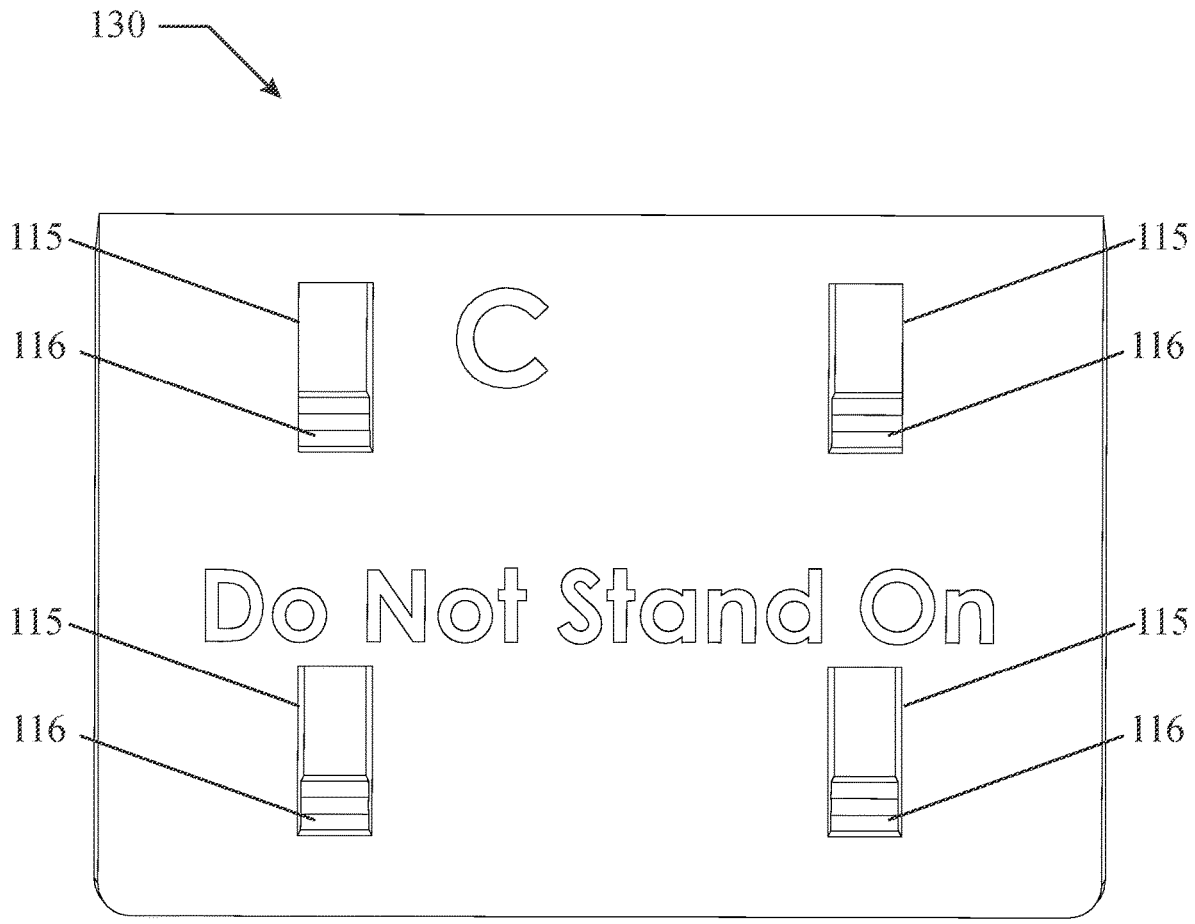

FIG. 39 is a front perspective view of the rear vertical support piece of the incline/exercise board of FIG. 36.

Figure 40:
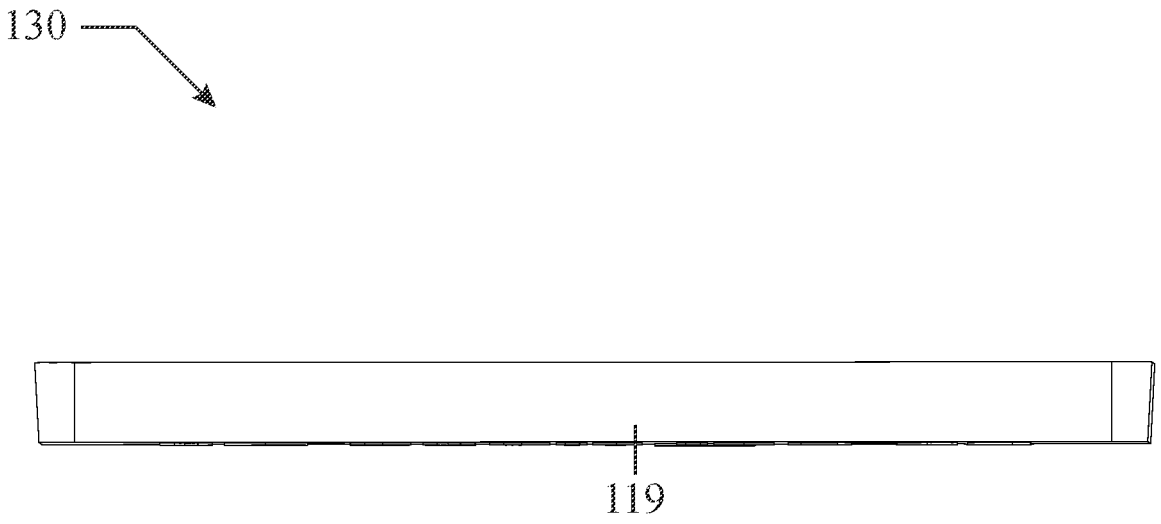

FIG. 40 is a bottom end perspective view of the rear vertical support piece of the incline/exercise board of FIG. 36.

Figure 41:
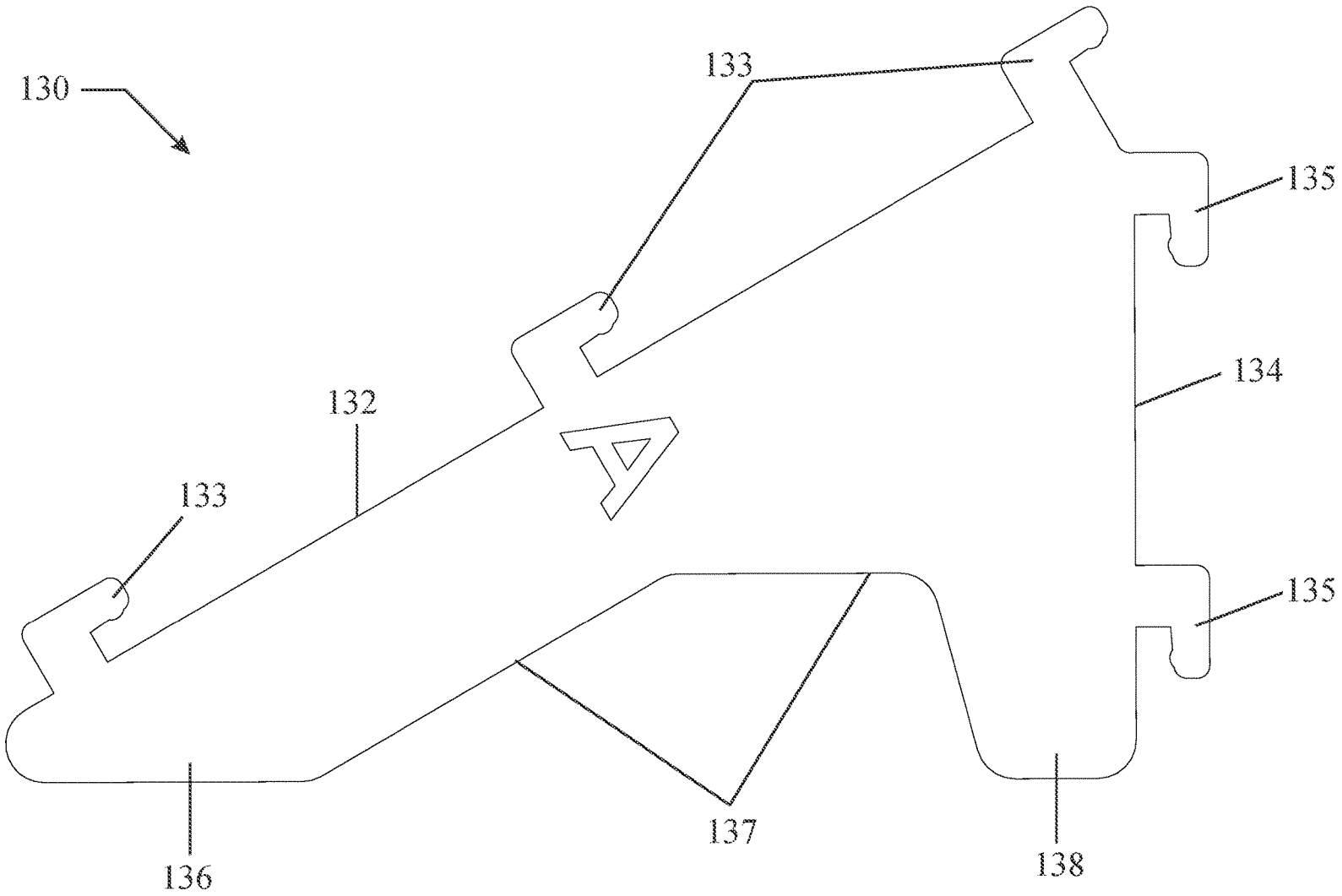

FIG. 41 is a right side perspective view of the right support piece of the incline/exercise board of FIGS. 23-32.

Figure 42:
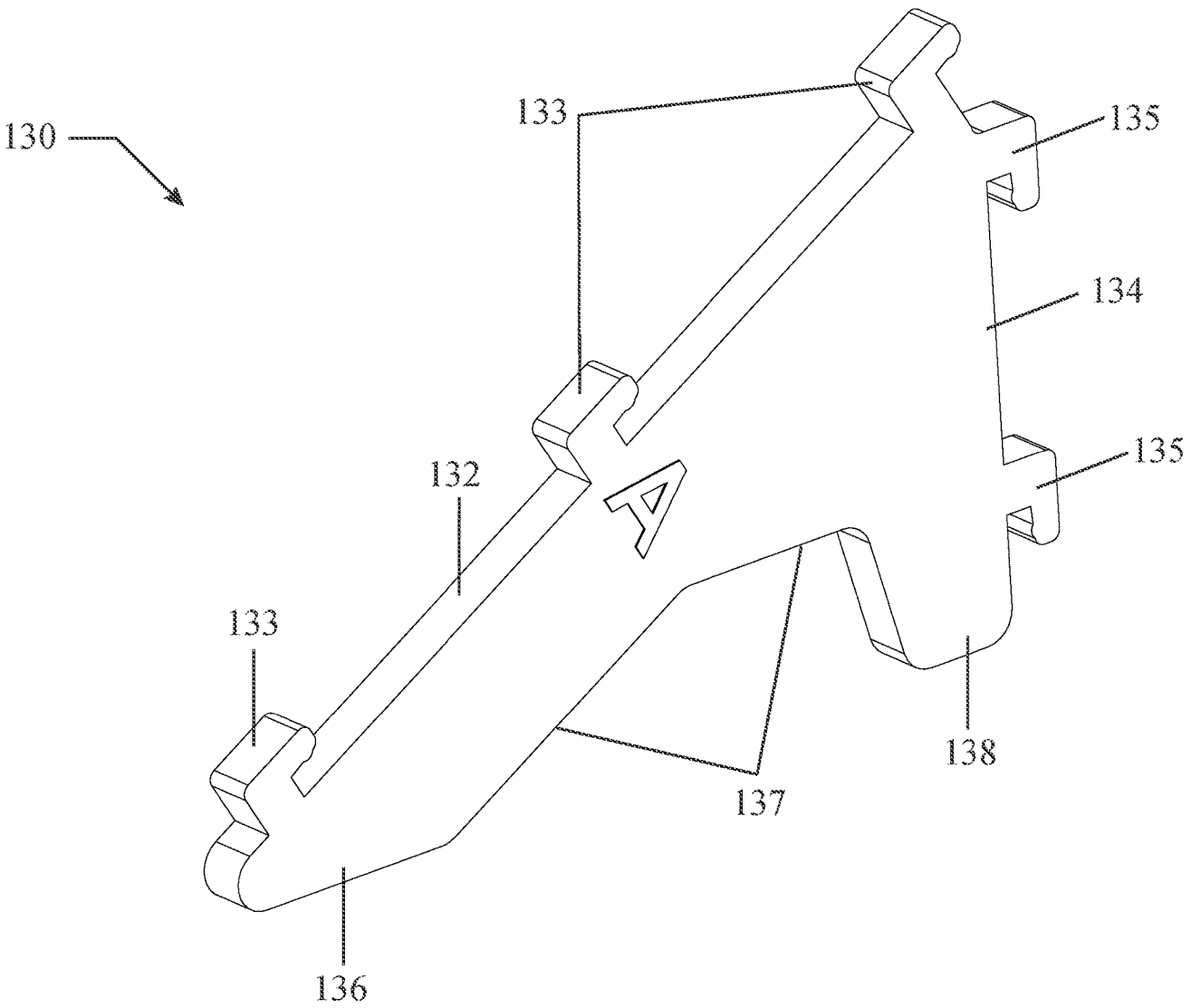

FIG. 42 is an upper right perspective view of the right support piece of the incline/exercise board of FIG. 41.

Figure 43:
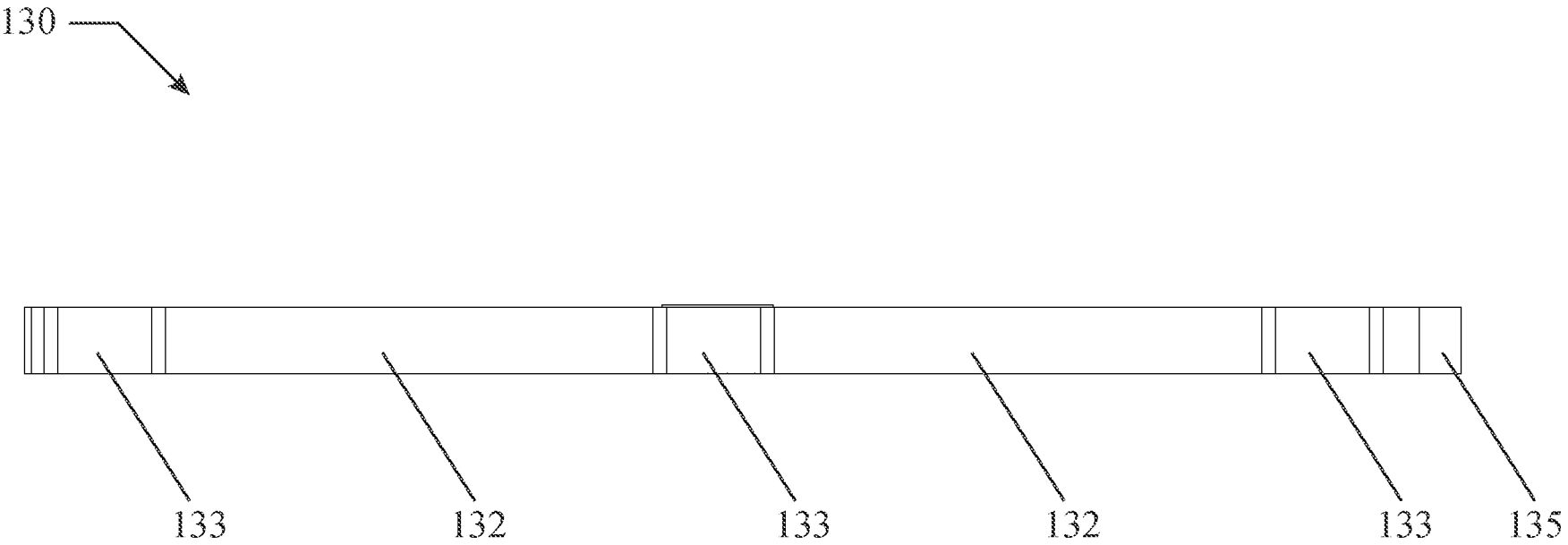

FIG. 43 is a top side perspective view of the right support piece of the incline/exercise board of FIG. 41.

Figure 44:
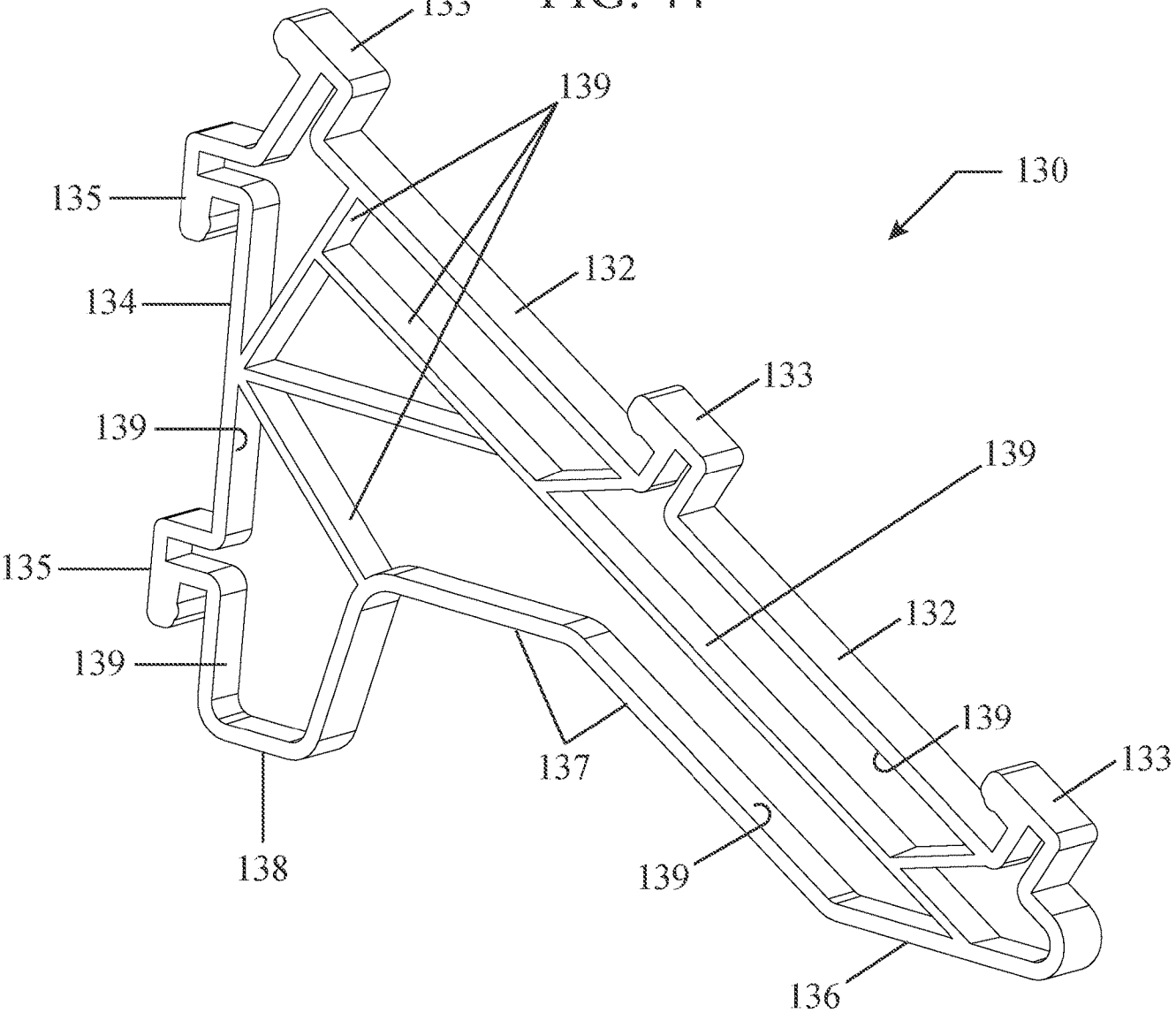

FIG. 44 is an upper front left side perspective view of the right support piece of the incline/exercise board of FIG. 41.

Figure 45:
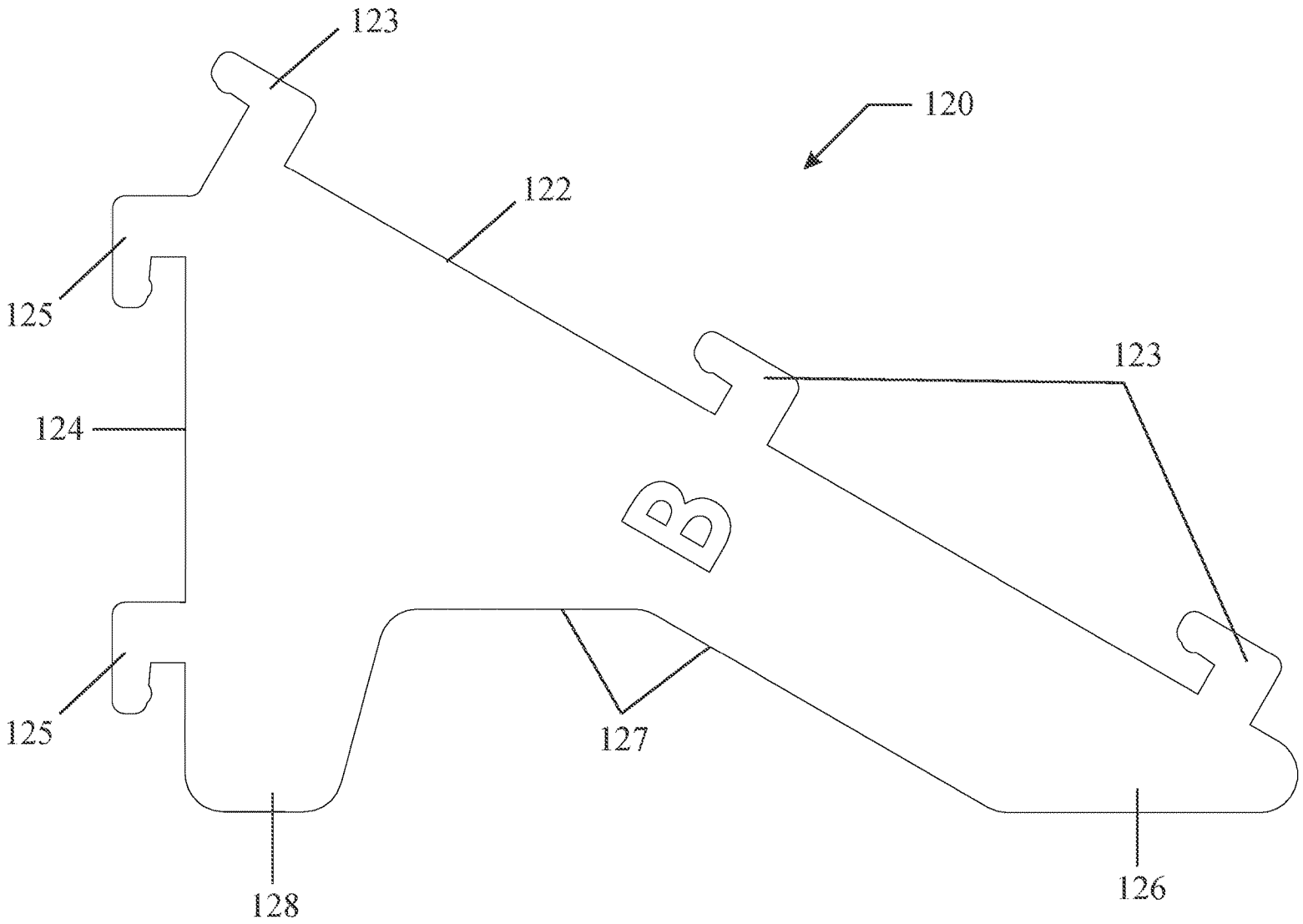

FIG. 45 is a left side perspective view of the left support piece of the incline/exercise board of FIGS. 23-32.

Figure 46:
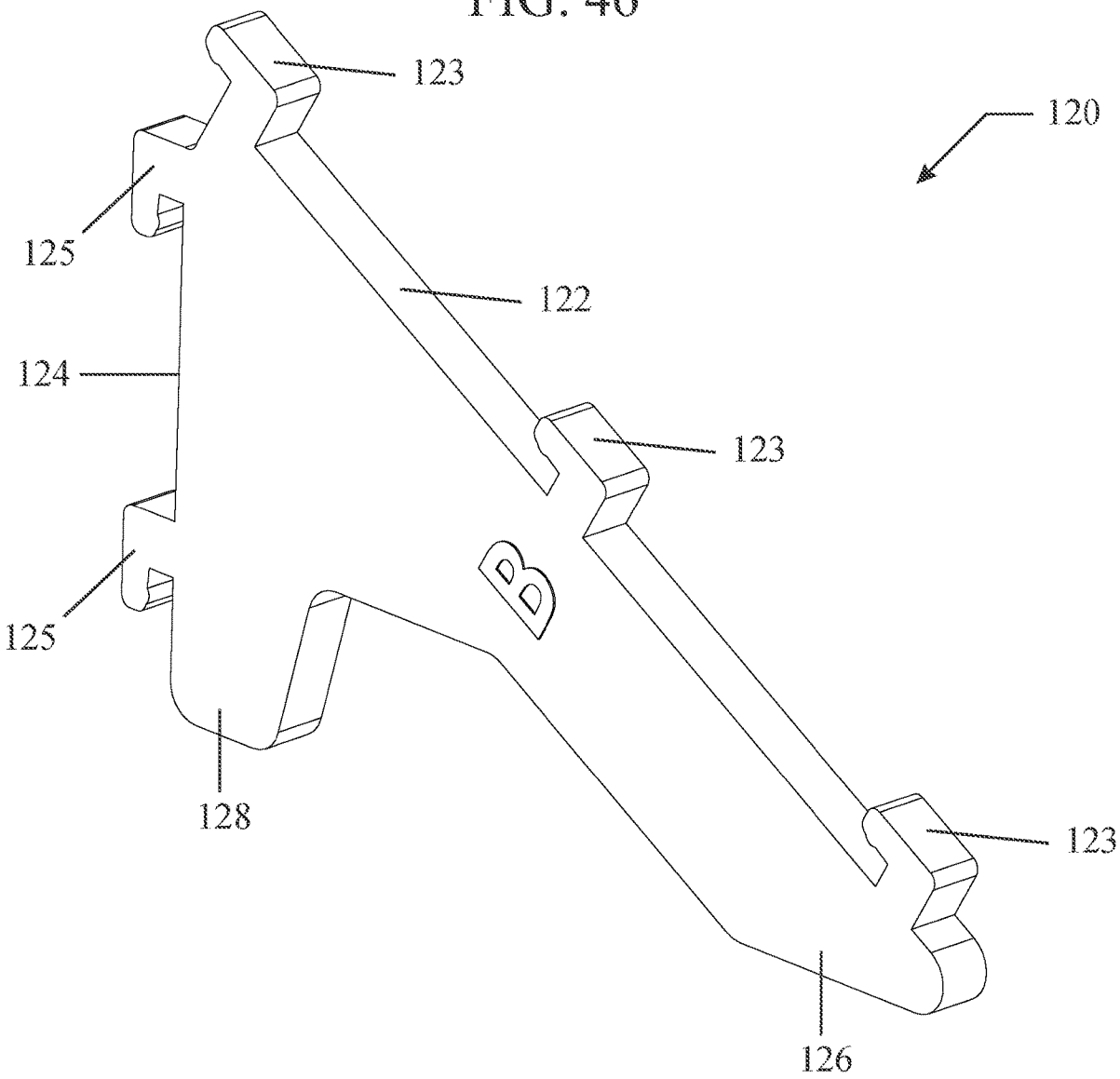

FIG. 46 is an upper front left side perspective view of the left support piece of FIG. 45.

Figure 47:
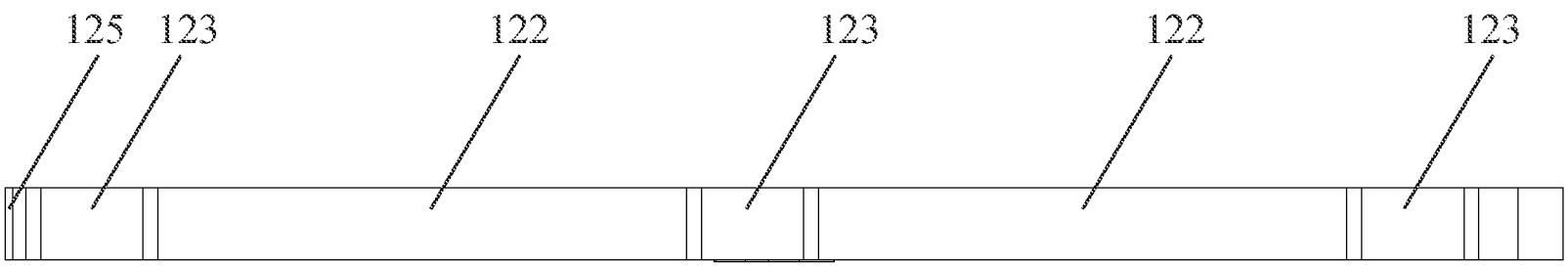

FIG. 47 is a top side perspective view of the left support piece of FIG. 45.

Figure 48:
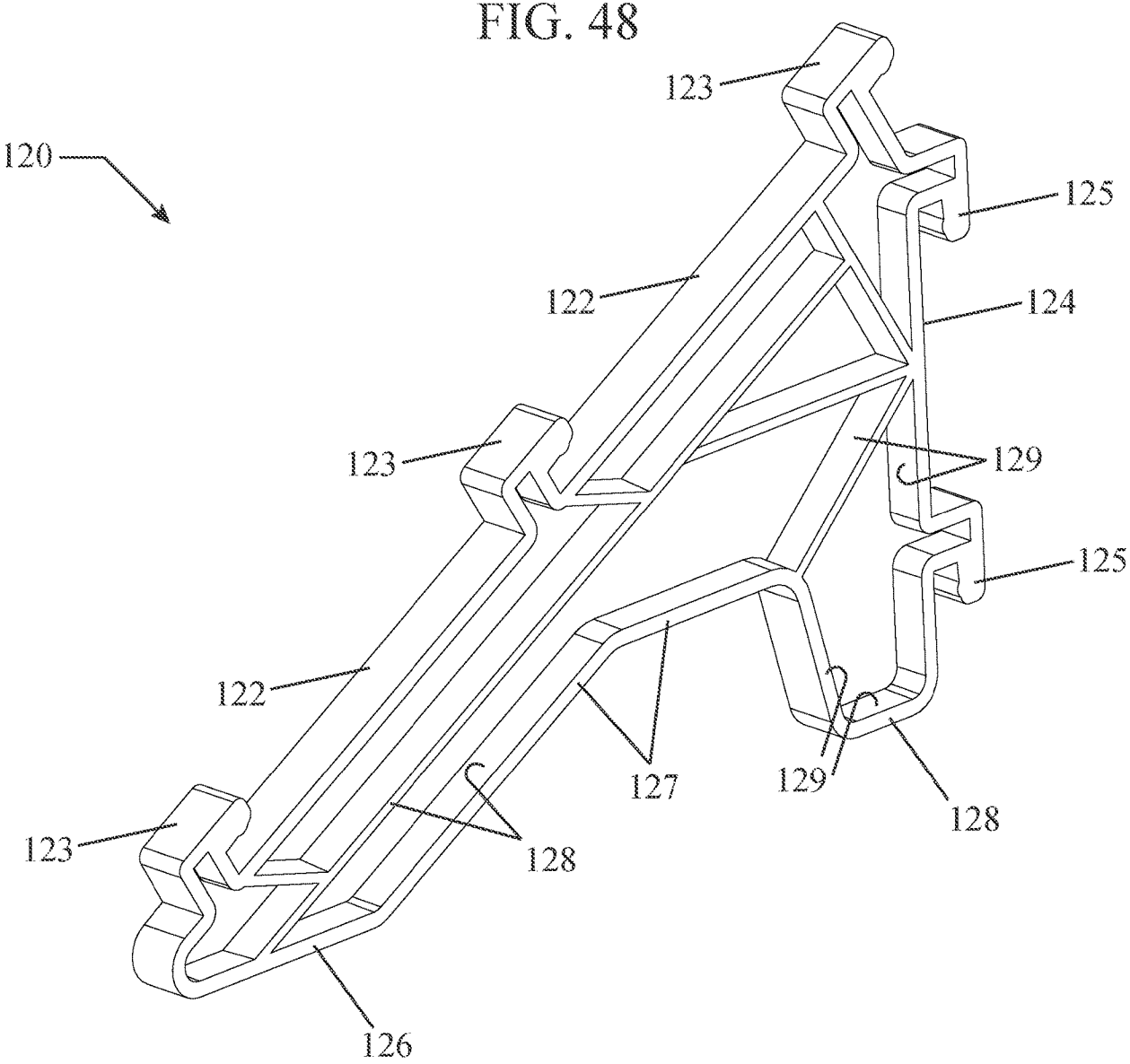

FIG. 48 is an upper right side perspective view of the left support piece of FIG. 45.

Figure 49:
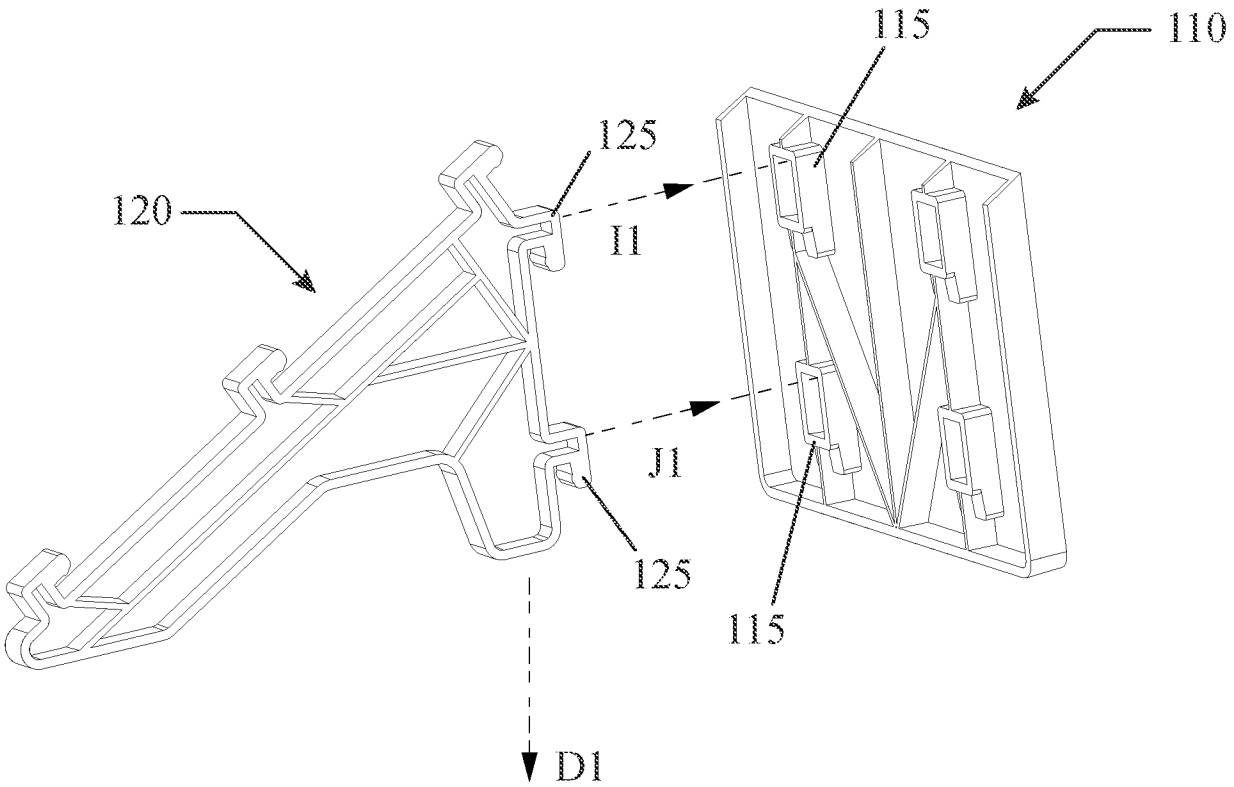

FIG. 49 is a side perspective view of the left support piece of FIGS. 45-47 about to mount to the rear vertical support piece of FIGS. 36-40.

Figure 50:
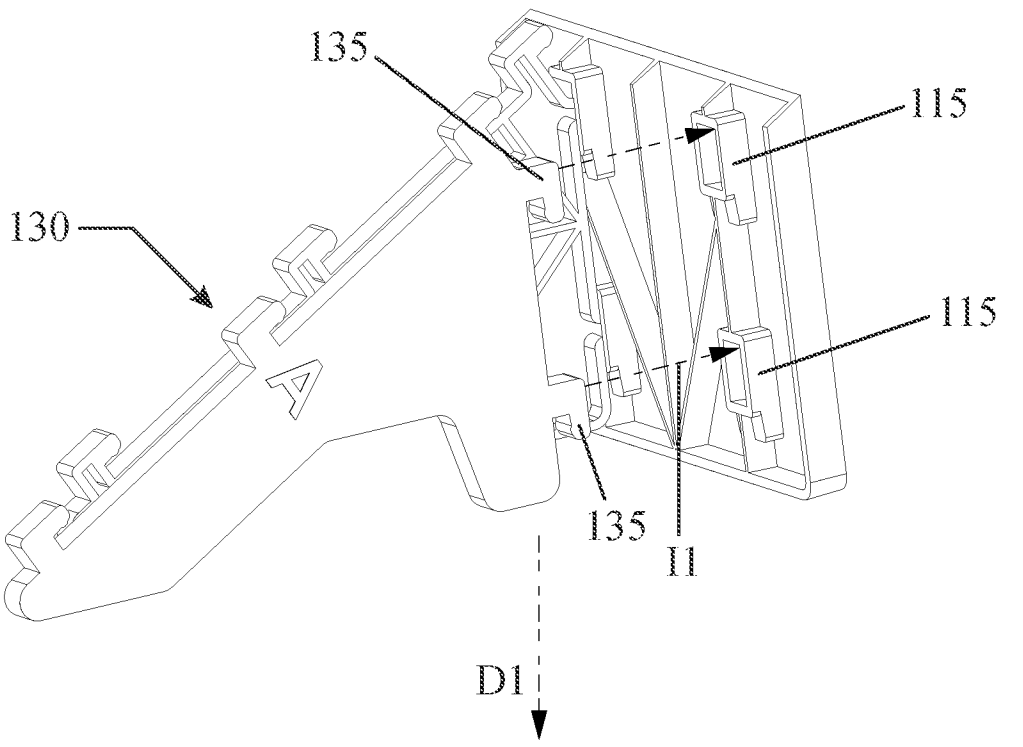

FIG. 50 is a side perspective view of the right support piece of FIGS. 41-44 about to mount to the rear vertical support piece of FIGS. 36-40.

Figure 51:
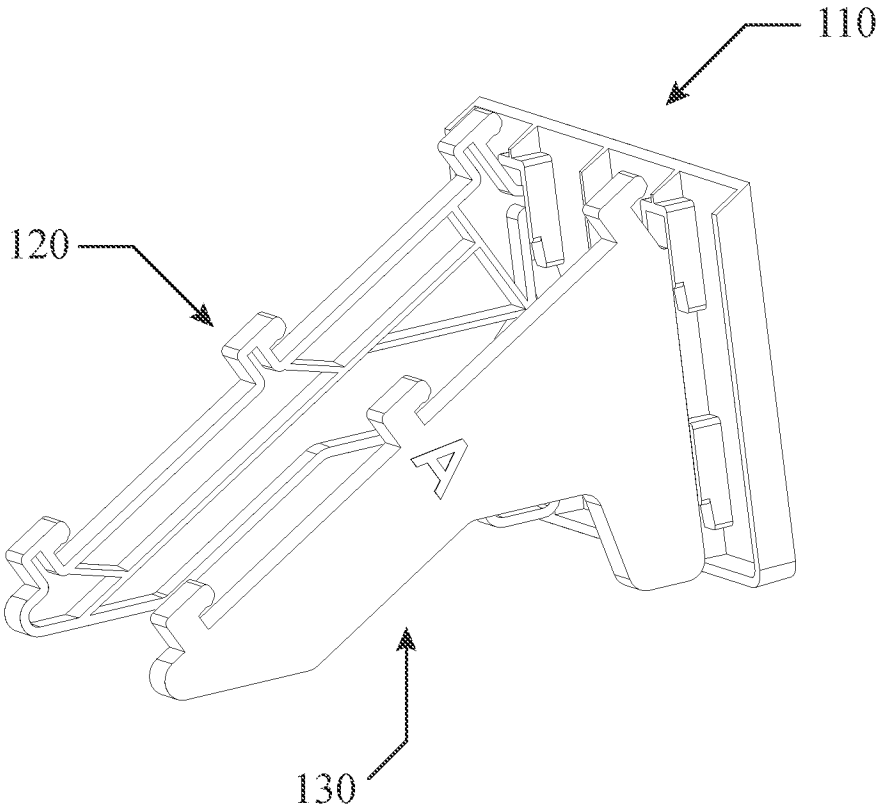

FIG. 51 is an upper side perspective assembled view of both the left and right support pieces of FIGS. 41-47 now mounted to the rear vertical support piece of FIGS. 36-40.

Figure 52:
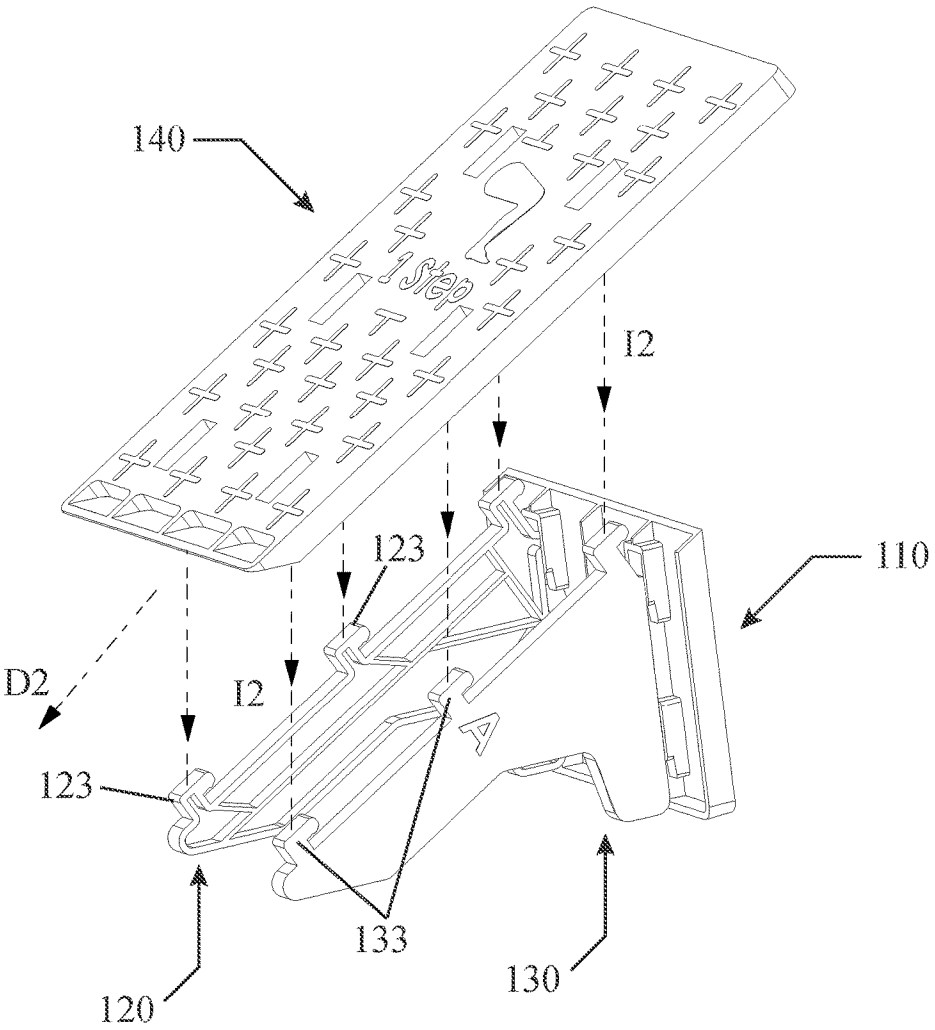

FIG. 52 is an upper side perspective view of the top piece (incline board) of FIGS. 33-35 about to be mounted to the assembled left and right support pieces mounted to the rear vertical support piece shown in FIG. 51.

Figure 53:
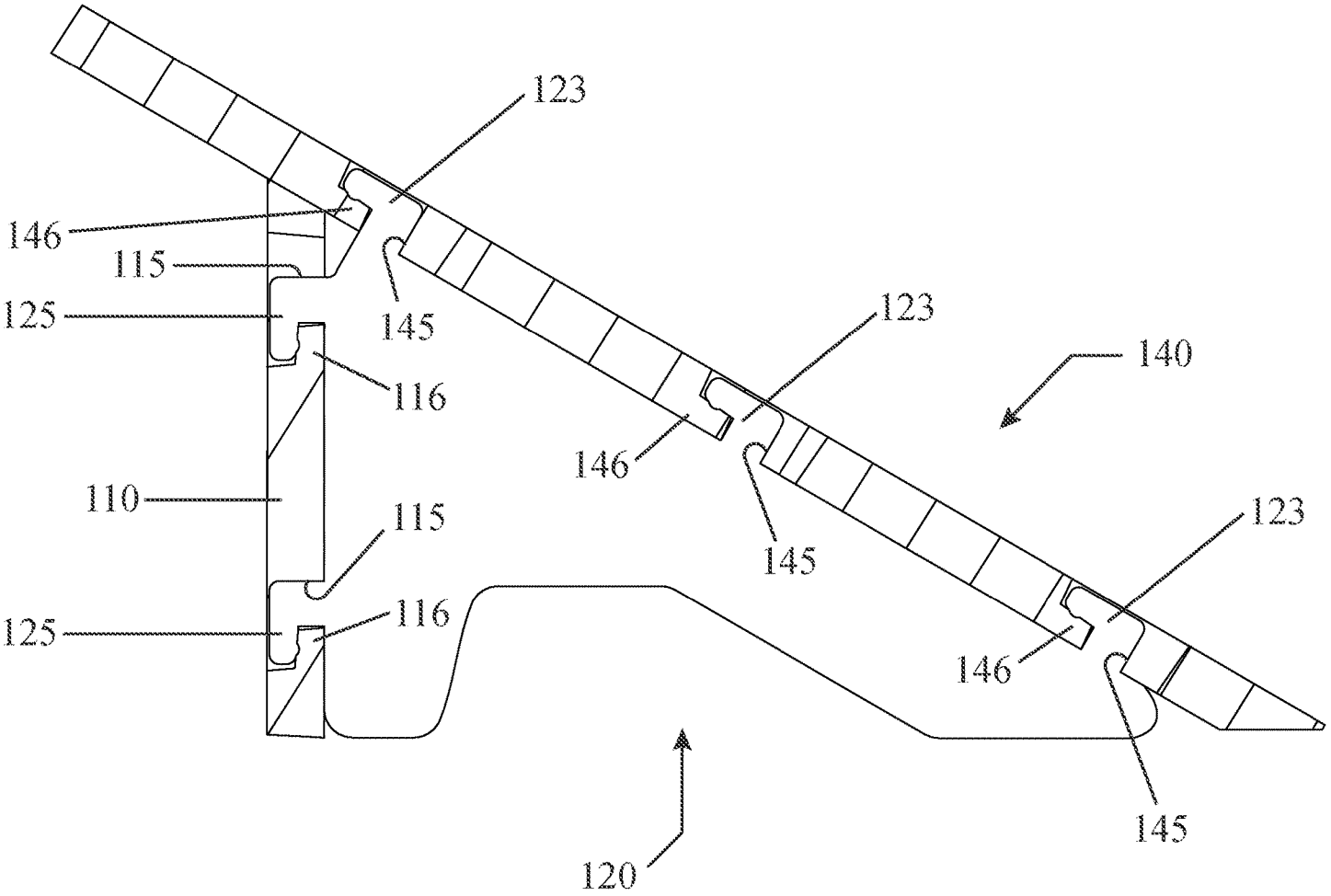

FIG. 53 is a side cross-sectional view of the assembled incline/exercise board of FIGS. 23-29

Figure 54:
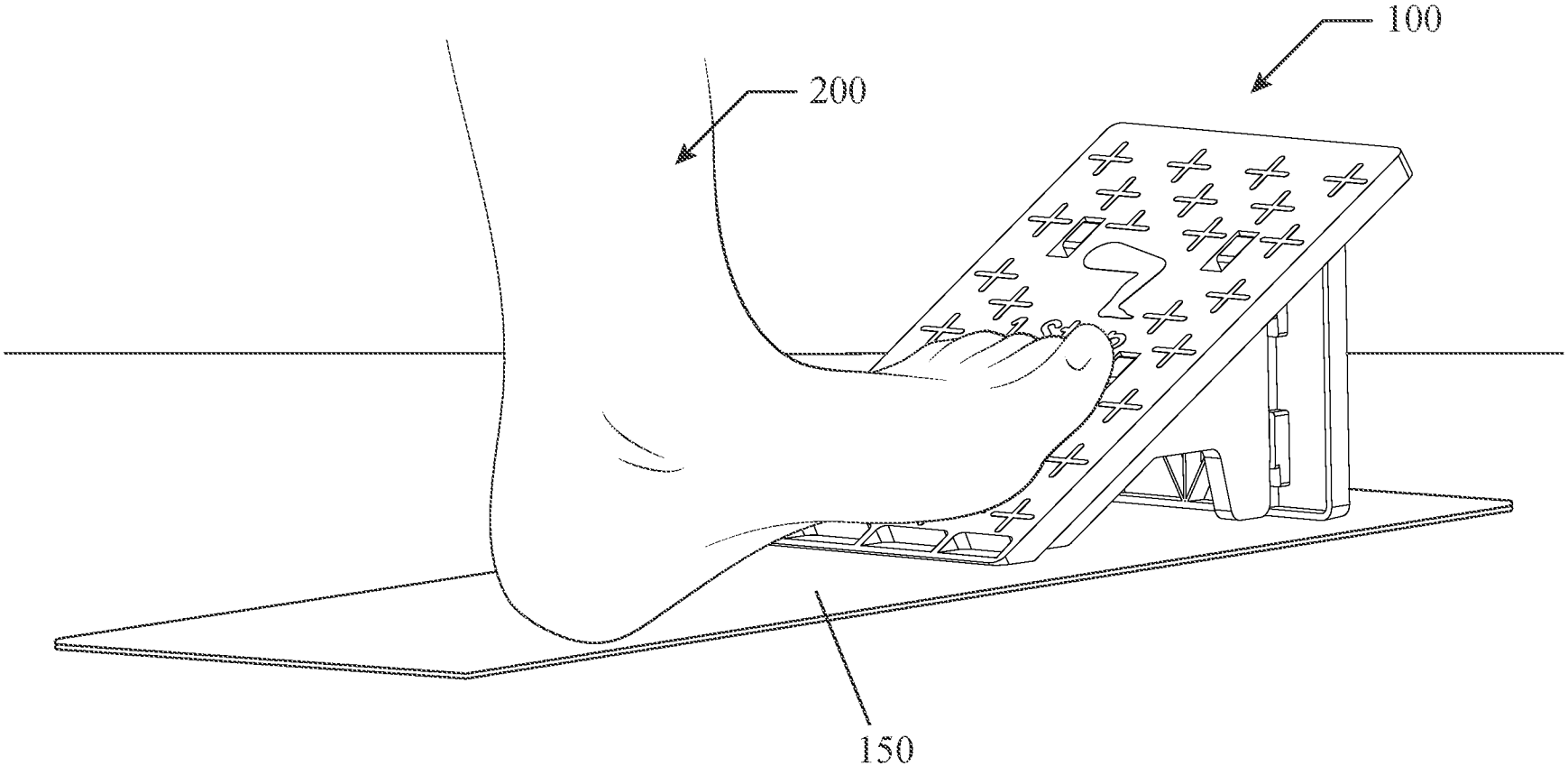

FIG. 54 is a perspective view of the assembled incline/exercise board of FIGS. 23-29 and 53 resting on a mat, with a foot being positioned for exercise.

Figure 55A:
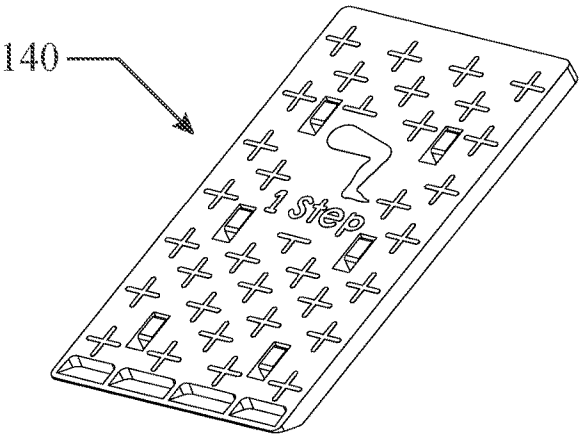

FIG. 55A is an upper right front perspective view of the top piece (incline board) of FIGS. 33-35.

Figure 55B:
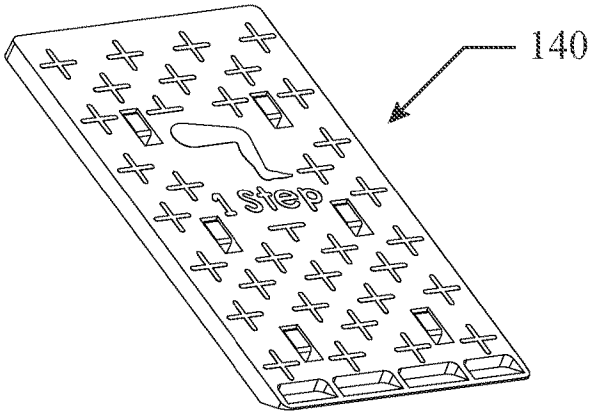

FIG. 55B is an upper left front perspective view of the top piece (incline board) of FIGS. 33-35.

Figure 55C:
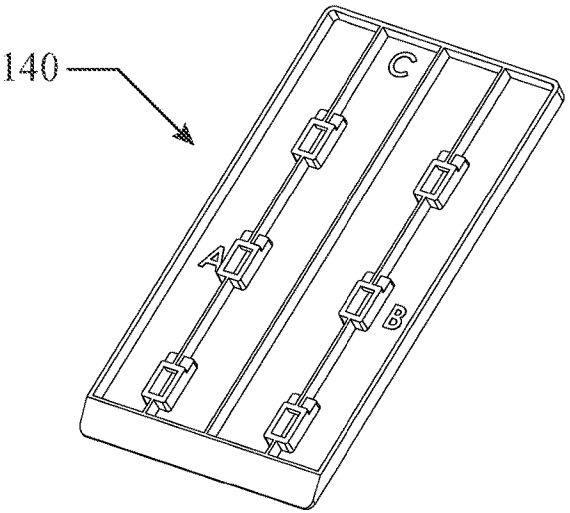

FIG. 55C is an upper left rear perspective view of the top piece (incline board) of FIGS. 33-35.

Figure 55D:
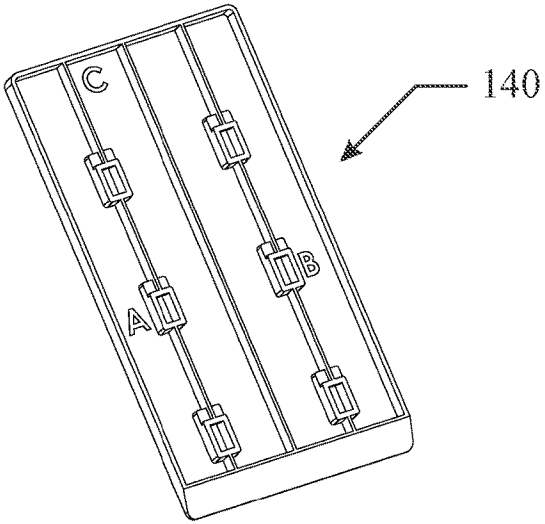

FIG. 55D is an upper right rear perspective view of the top piece (incline board) of FIGS. 33-35.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

A list of components will now be described.

1 assembled incline/exercise board First Embodiment
5 exploded view incline/assembled board
10 top piece
11 front raised surface
12 approximately 45 degree angled tip end
13 rounded rear end
14 flat left side
15 flat right side
16 inner parallel hexagon shape grooves
17 bottom slots for inner grooves
18 outer parallel hexagon shape grooves
Inverted V shaped protrusion runs between each set of outer grooves 18 and inner grooves 16
19 bottom slots for outer grooves
20 rear vertical support piece
22 top approximately 45 degree angled end
24 top pair of spaced apart parallel raised hexagon protruding members
25 bottom enlarged triangle shape footer end
26 left parallel channels
26V elongated inverted V shaped protrusion between the left parallel channels
26IP elongated inwardly facing side protrusions in the left parallel channels
27 open bottom for left channels
28 right parallel channels
28V elongated inverted V shaped protrusion between the right parallel channels
281P elongated inwardly facing side protrusions in the right parallel channels
29 open bottom for right channels
30 right triangular support piece
31 top angled side member
32C center V shape groove along top angled side member
32S opposite facing side grooves along exterior sides of top angled side member
32C and 32S forms pair of upwardly extending hexagon shape protrusions
33 flat footer left footer end
34 rear vertical leg member
35C center V shape groove along back of rear vertical leg member
35S opposite facing side grooves along exterior sides of rear vertical leg member
35C and 35S forms pair of outwardly extending hexagon shape protrusions
36 flat end of vertical leg member
38 indented exterior side face
39 flat interior side face
40 left triangular support piece
100 assembled incline/exercise board SECOND Embodiment
110 Rear vertical support piece (C)
112 open top edge
115 rectangular slot(s)
116 step(s) ledge(s) in rectangular slots
117 central raised ridge
118 side and angled raised ridges that connect the three rows of rectangular slots 115,
119 raised side edges bottom raised edge
120 left triangular support piece (B)
122 incline angled top side
123 raised L-shaped clips
124 rear side
125 raised L-shaped clips
126 front footer
127 lower side indentation
128 rear footer
129 raised perimeter and cross edges
130 right triangular support piece (A)
132 incline angled top side
133 raised L-shaped clips
134 rear side
135 raised L-shaped clips
136 front footer
137 lower side indentation
138 rear footer
139 raised perimeter and cross edges
140 top incline board piece (D)
141 generally triangular edge 141
142 plurality of indentations on a front side
143 optional elongated gripping pad 143 on the rear side.
144 raised cross protrusions
145 rectangular slot(s)
146 step(s)/ledge(s) in rectangular slots
147 central raised ridge
148 side raised ridges that connect the three rows of rectangular slots 145,
149 raised side edges upper raised edge 149
150 Support pad
200 foot of the user

First Embodiment

Figure 1:
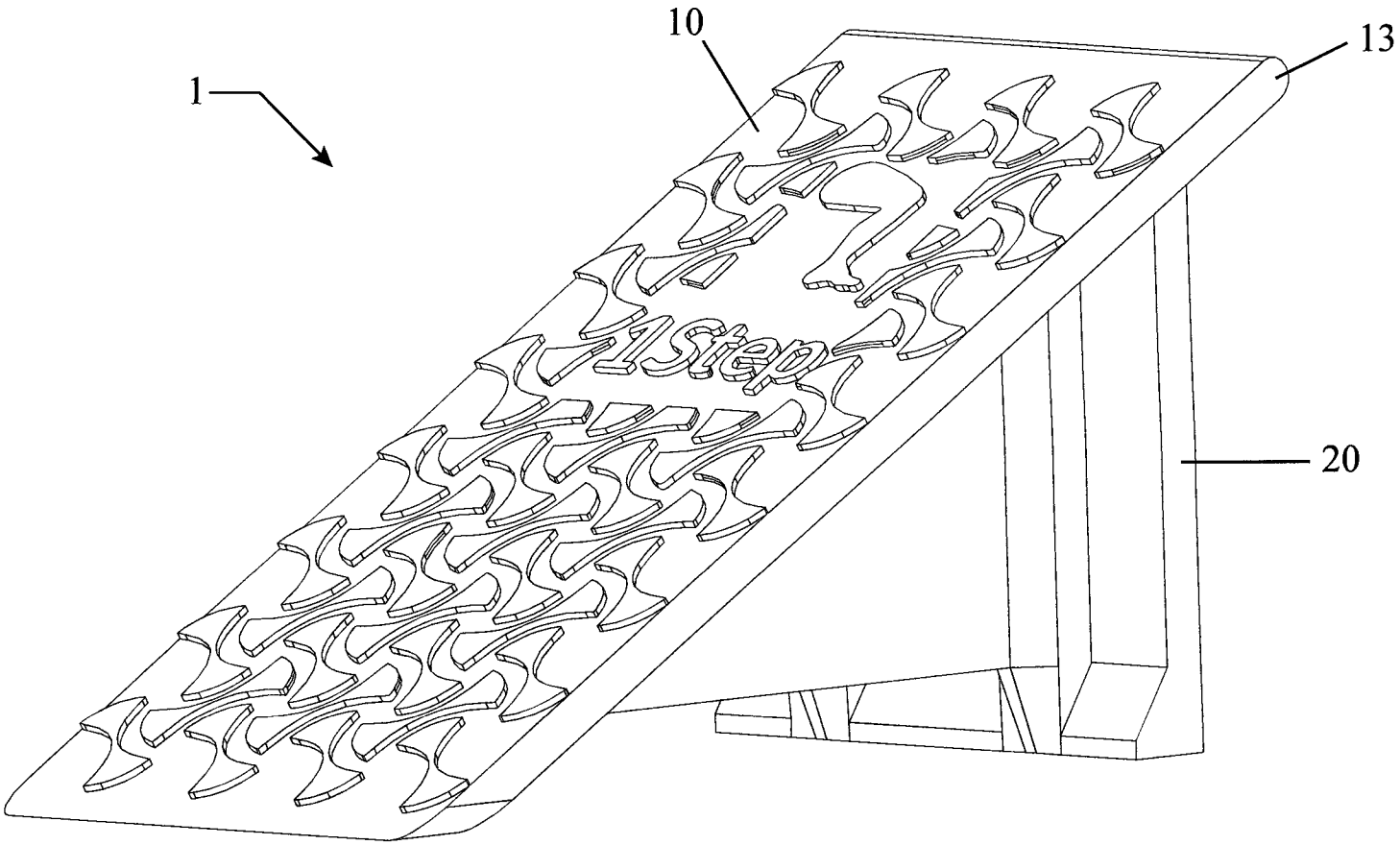
FIG. 1 is an upper front right perspective view of the assembled incline board.
Figure 2:
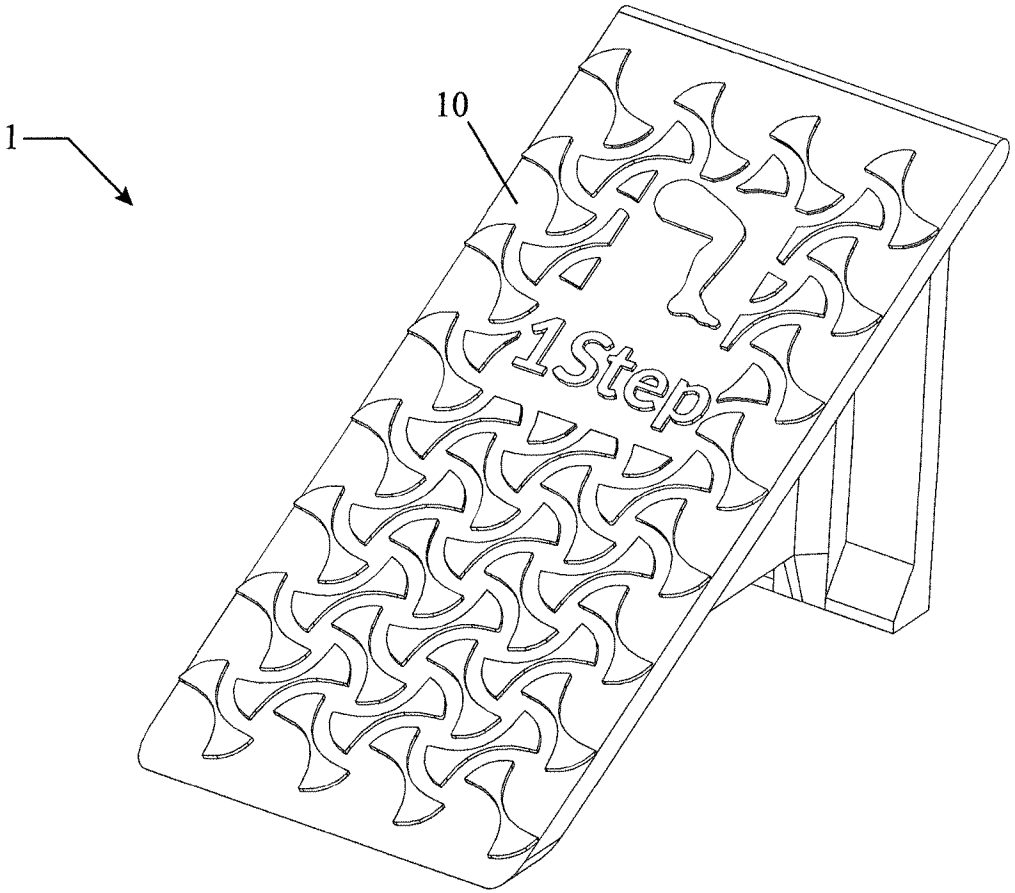
FIG. 2 is another upper front right perspective view of the incline board of FIG. 1
Figure 3:
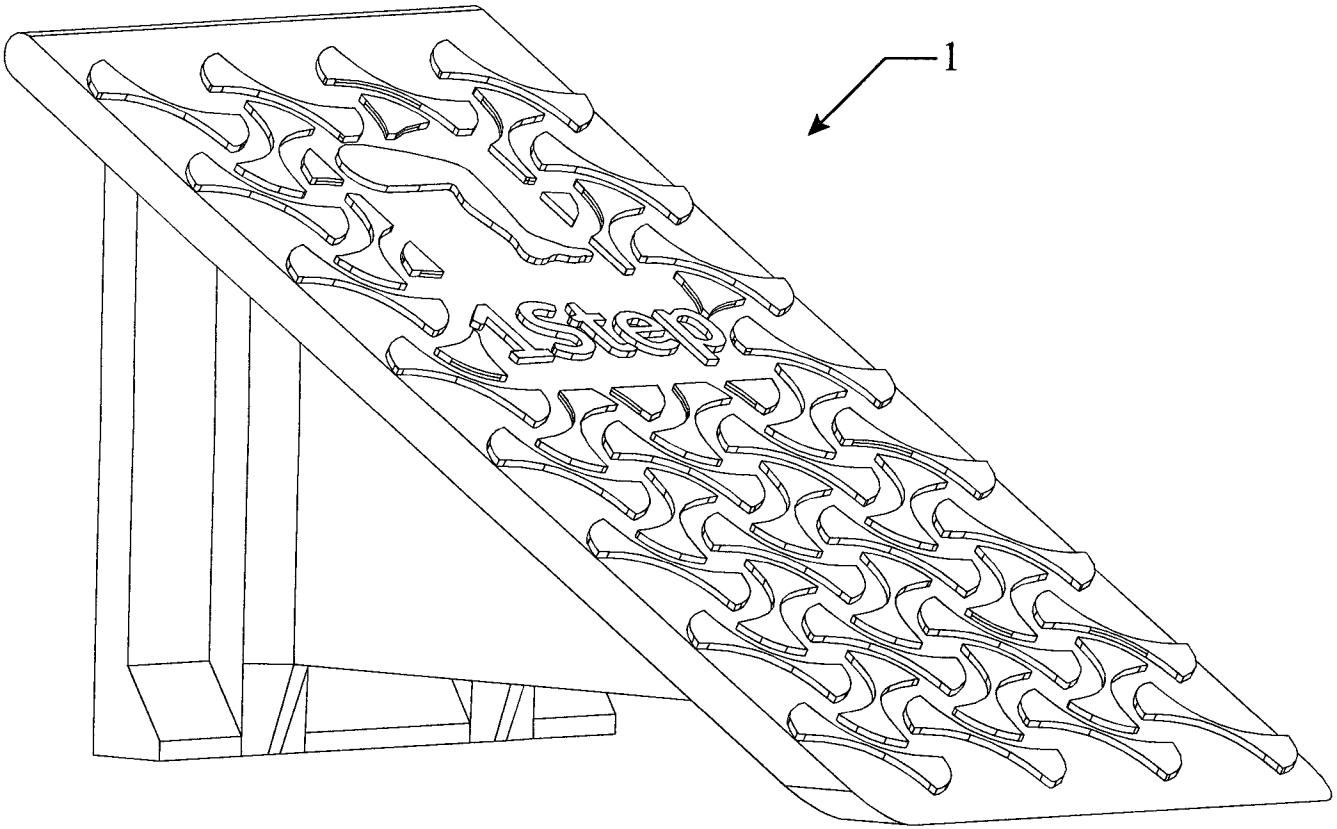
FIG. 3 is an upper front left perspective view of the incline board of FIG. 1.

FIG. 1 is an upper front right perspective view of the assembled incline board 1. FIG. 2 is another upper front right perspective view of the incline board 1 of FIG. 1. FIG. 3 is an upper front left perspective view of the incline board 1 of FIG. 1.

Figure 4:
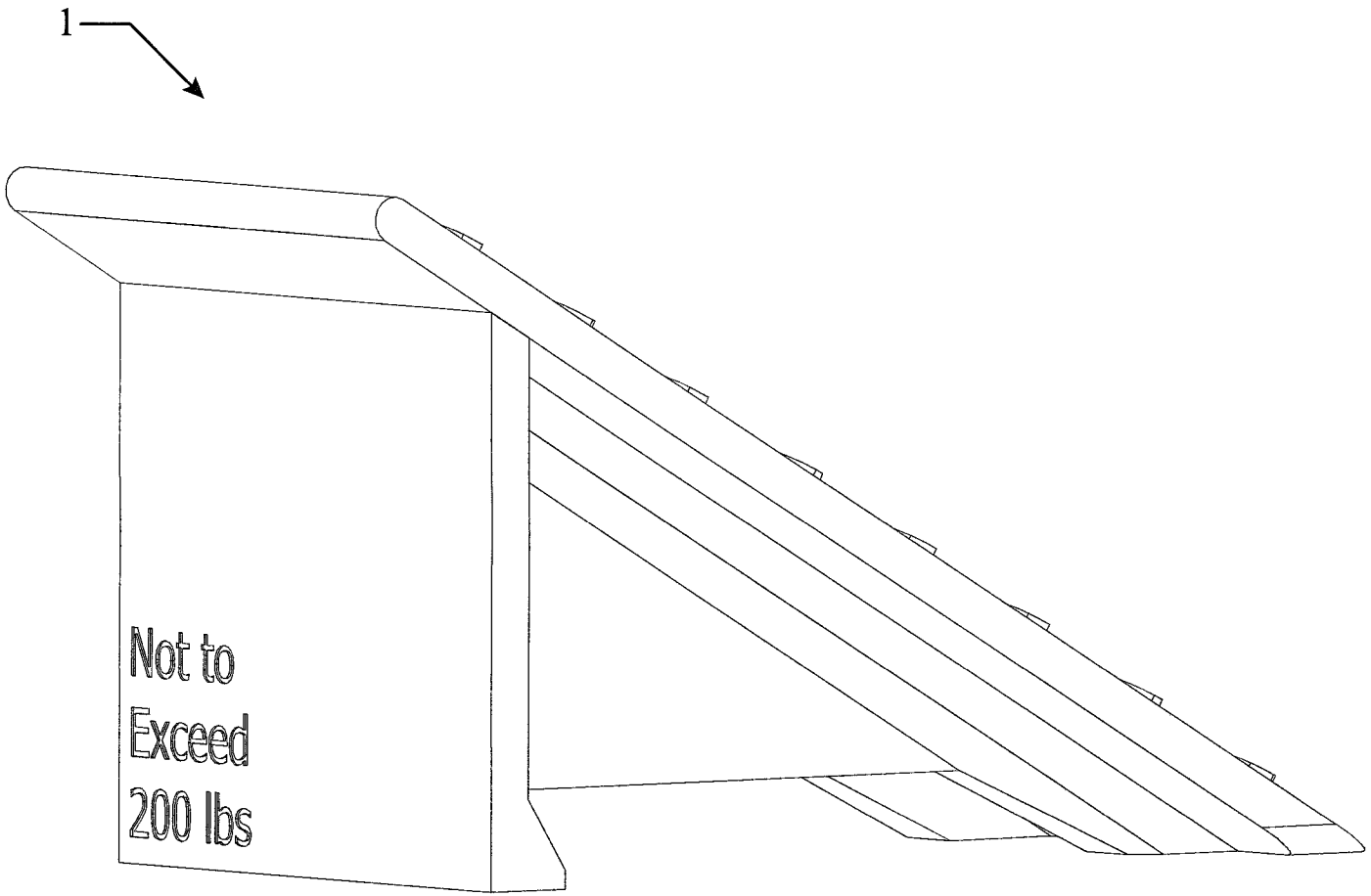
FIG. 4 is a rear right perspective view of the incline board of FIG. 1.

FIG. 4 is a rear right perspective view of the incline board 1 of FIG. 1.

Figure 5:
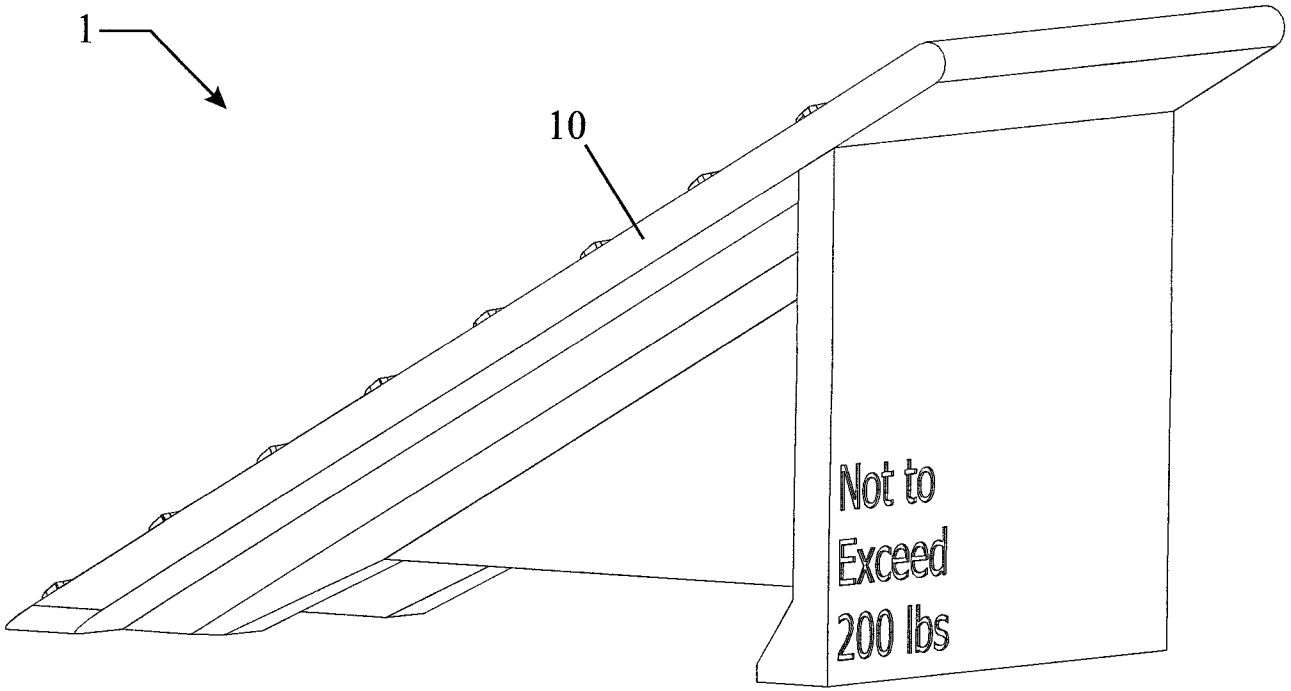
FIG. 5 is a rear left perspective view of the incline board of FIG. 1.
Figure 6:
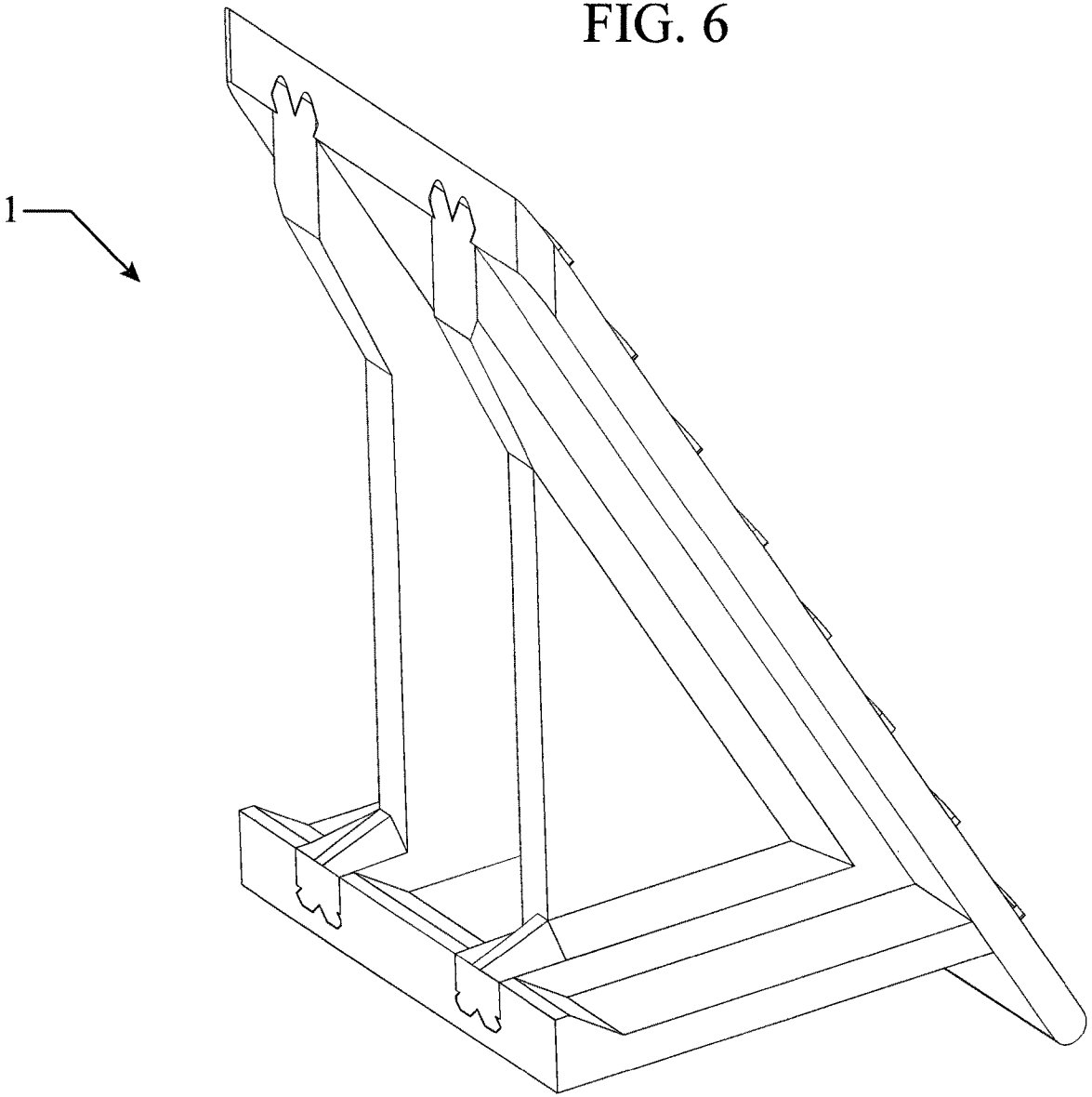
FIG. 6 is a lower front left perspective view of the incline board of FIG. 5 with top piece tilted backward.

FIG. 5 is a rear left perspective view of the incline board 1 of FIG. 1. FIG. 6 is a lower front left perspective view of the incline board 1 of FIG. 5 with top piece 10 tilted backward.

Figure 7:
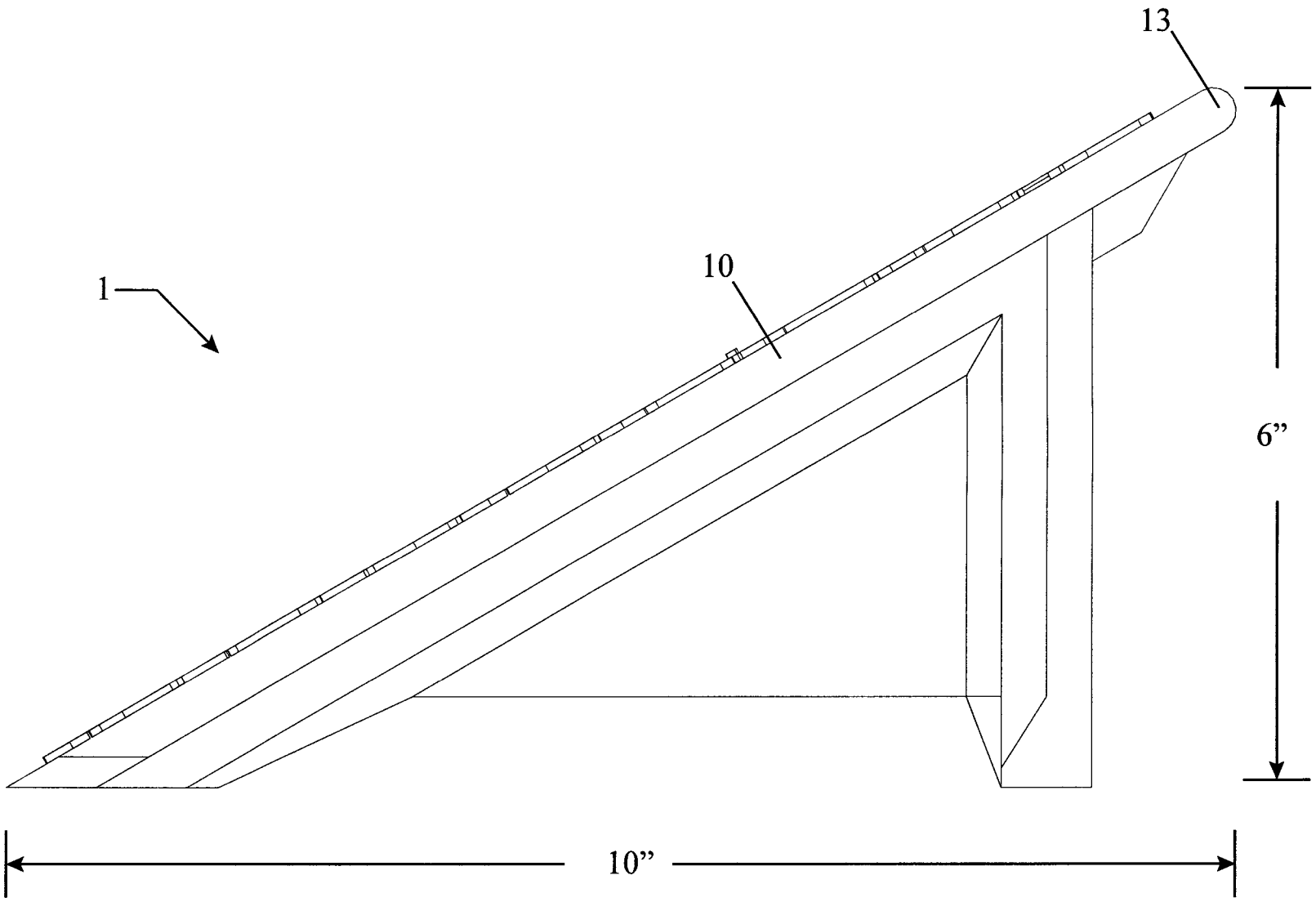
FIG. 7 is a right side view of the incline board of FIG. 1.

FIG. 7 is a right side view of the incline board 1 of FIG. 1.

Figure 8:
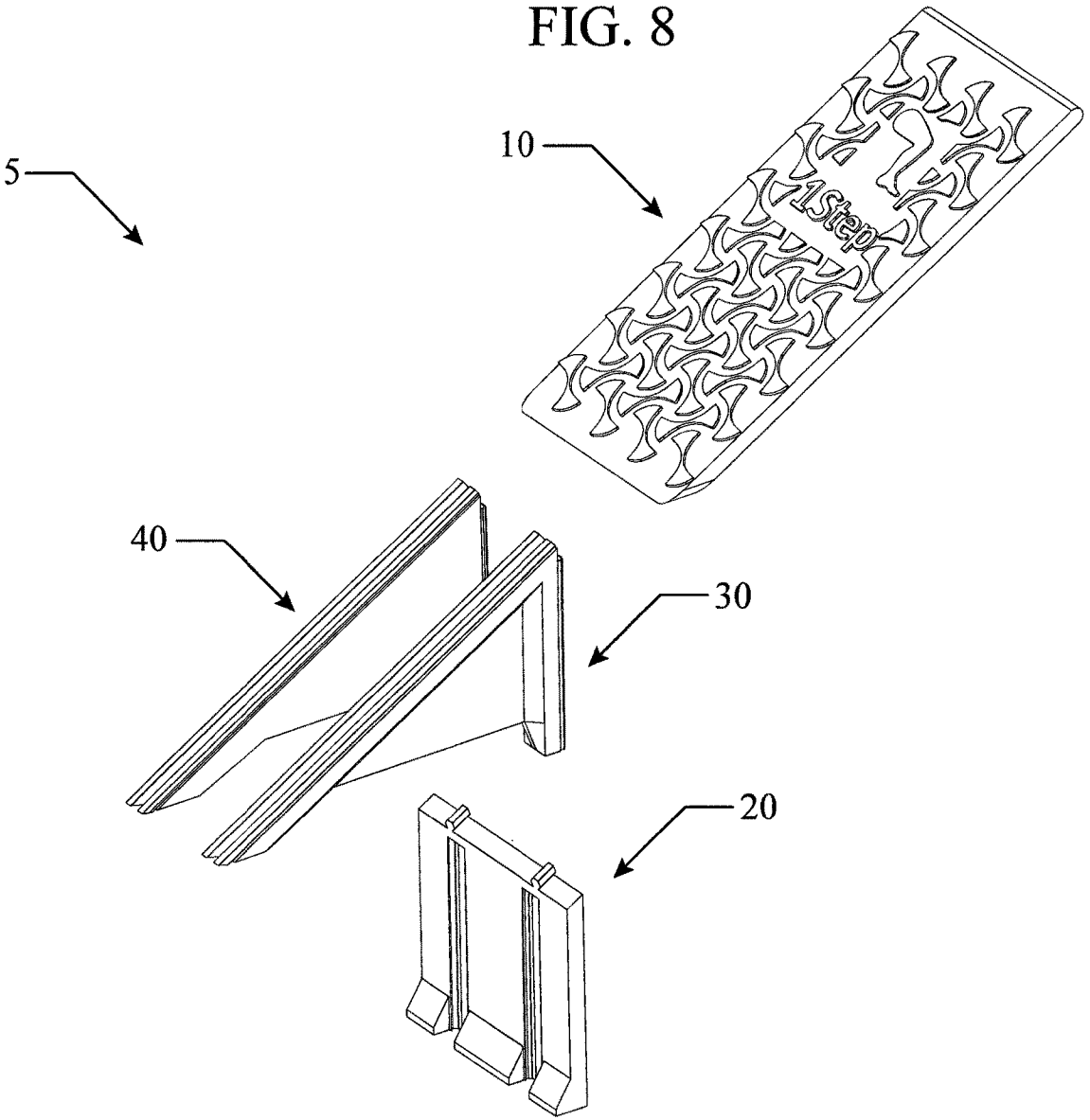
FIG. 8 is an exploded perspective view of the pieces of the incline board of FIG. 1.
Figure 9:
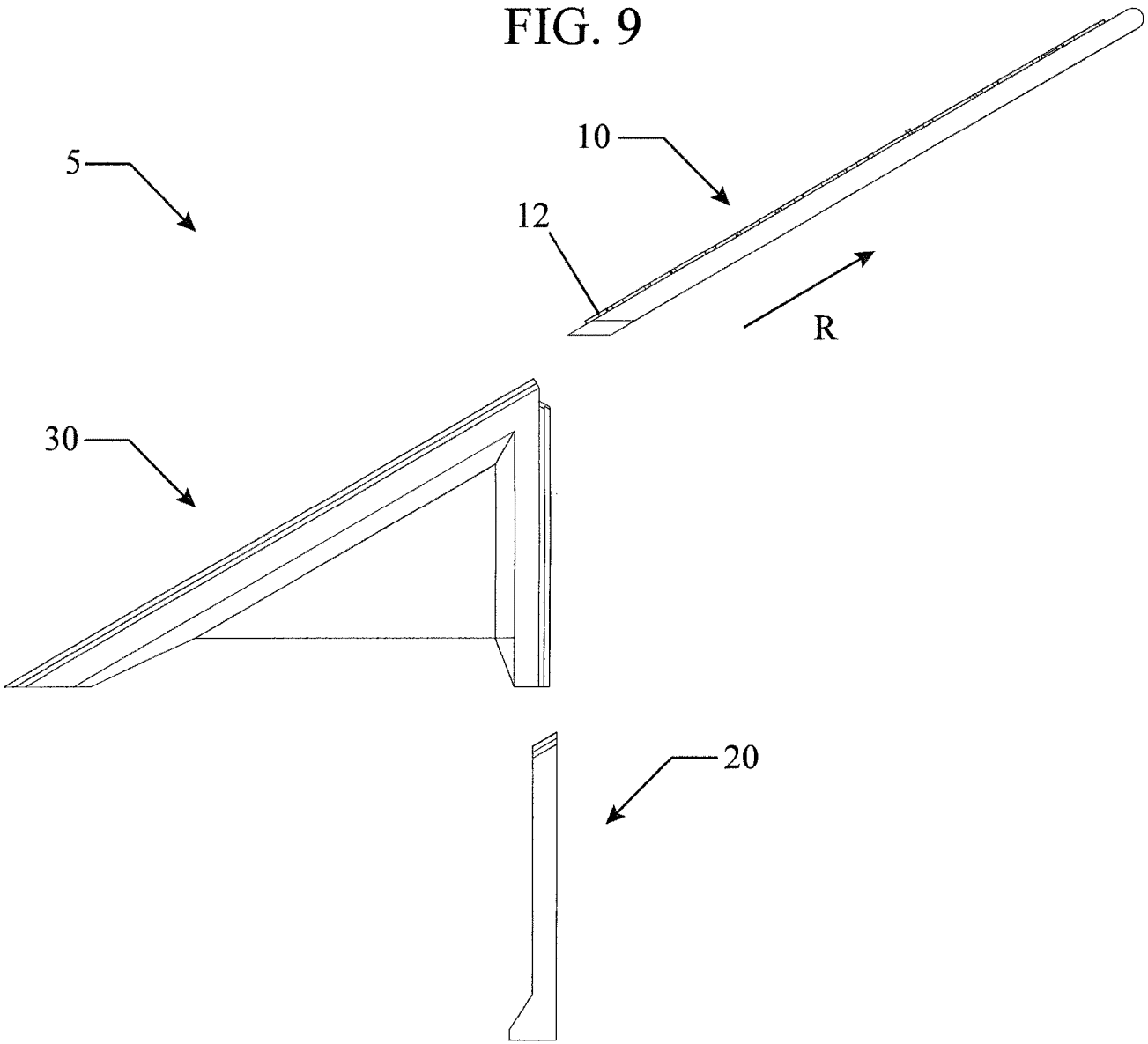
FIG. 9 is a side view of the pieces of the incline board of FIG. 8.

FIG. 8 is an exploded perspective view 5 of the pieces 10-40 of the incline board 1 of FIG. 1. FIG. 9 is a side view of the pieces 10-40 of the incline board 1 of FIG. 8.

Figure 10:
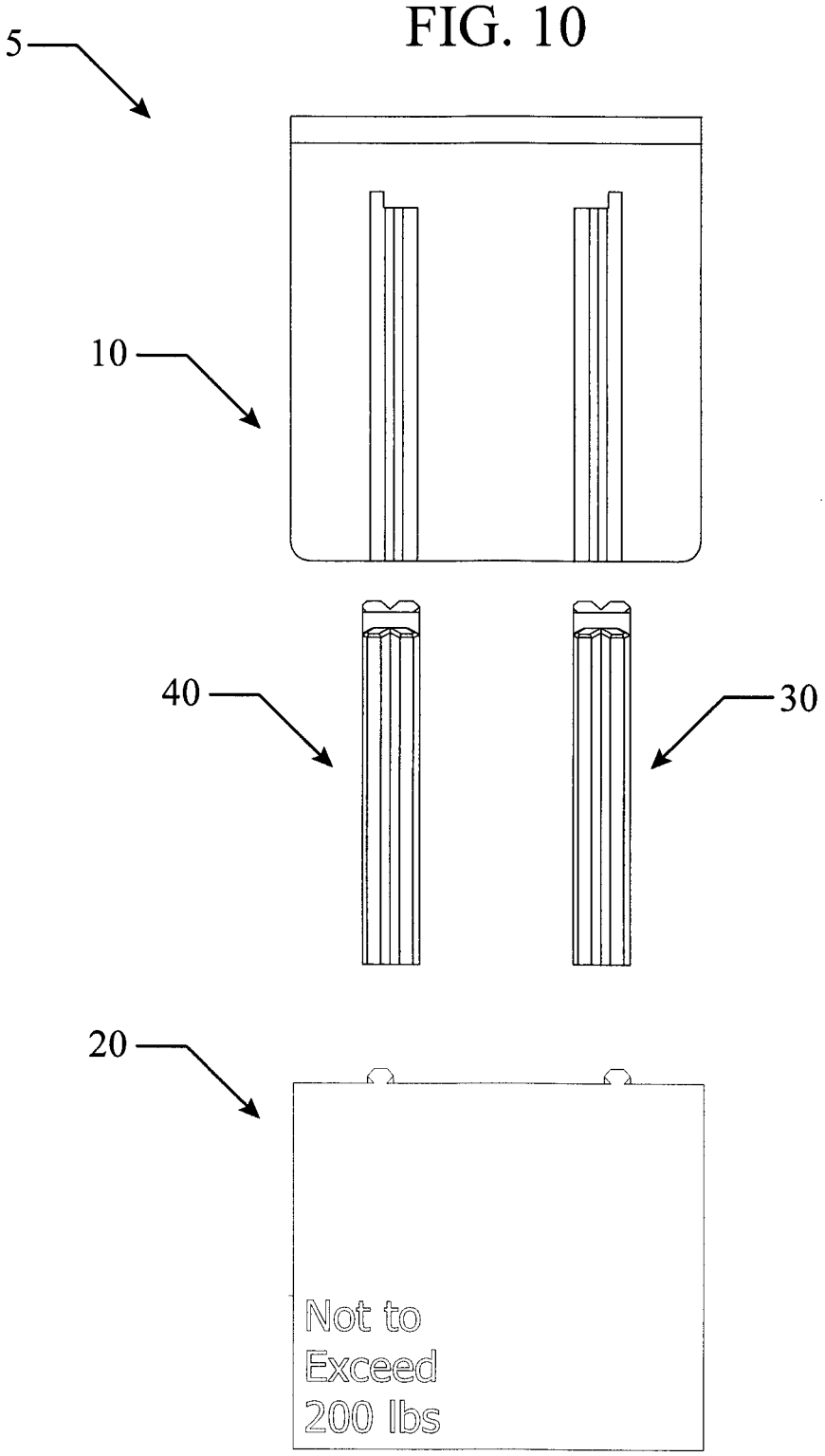
FIG. 10 is a rear side view of the pieces of the incline board of FIG. 9.

FIG. 10 is a rear side view of the pieces 10-40 of the incline board 1 of FIG. 9.

Top Piece 10

Figure 11:
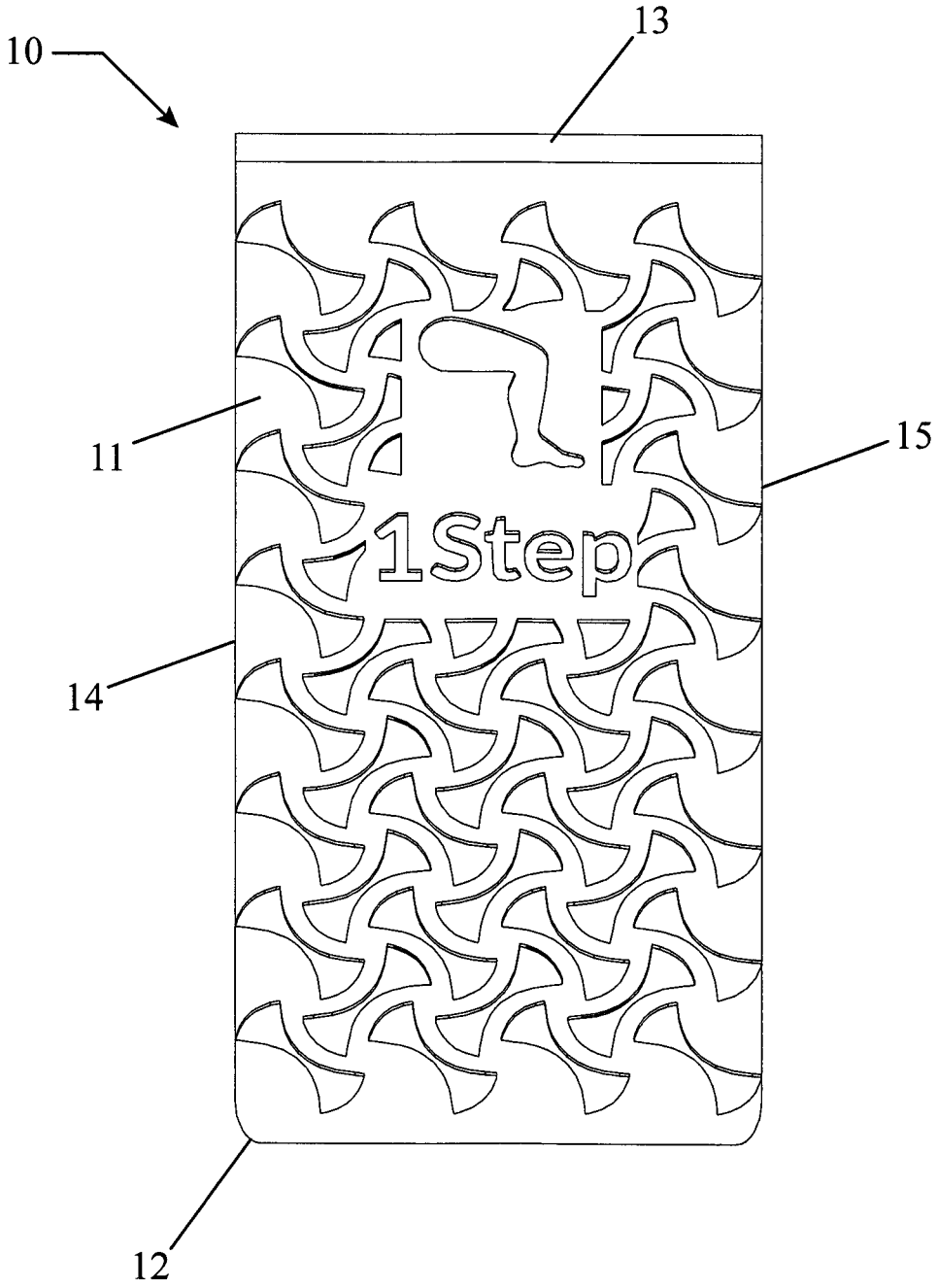
FIG. 11 is a front view of the top piece of the incline board of FIGS. 1-10.
Figure 12:
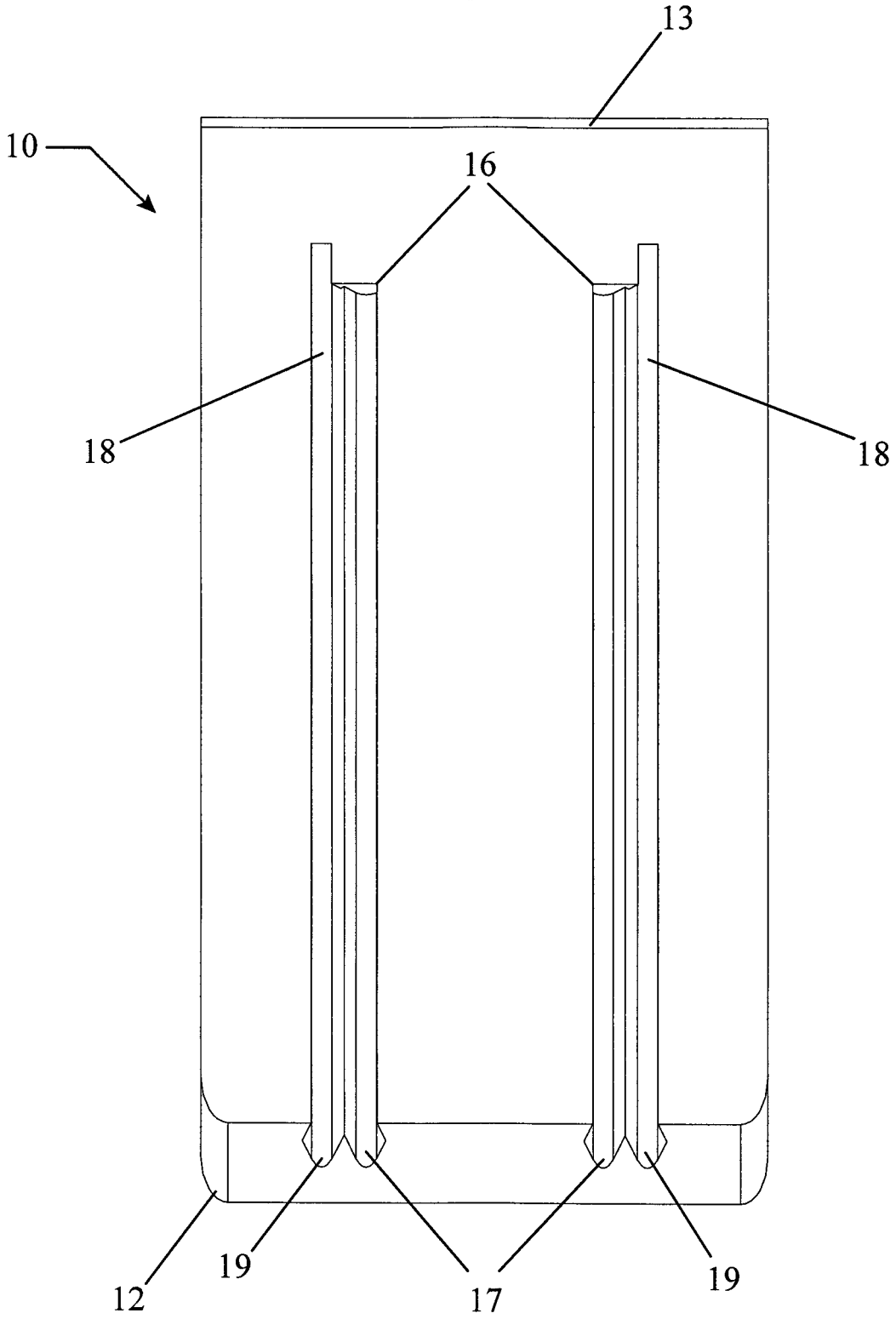
FIG. 12 is a rear side view of the top piece of the incline board of FIG. 11.
Figure 13:
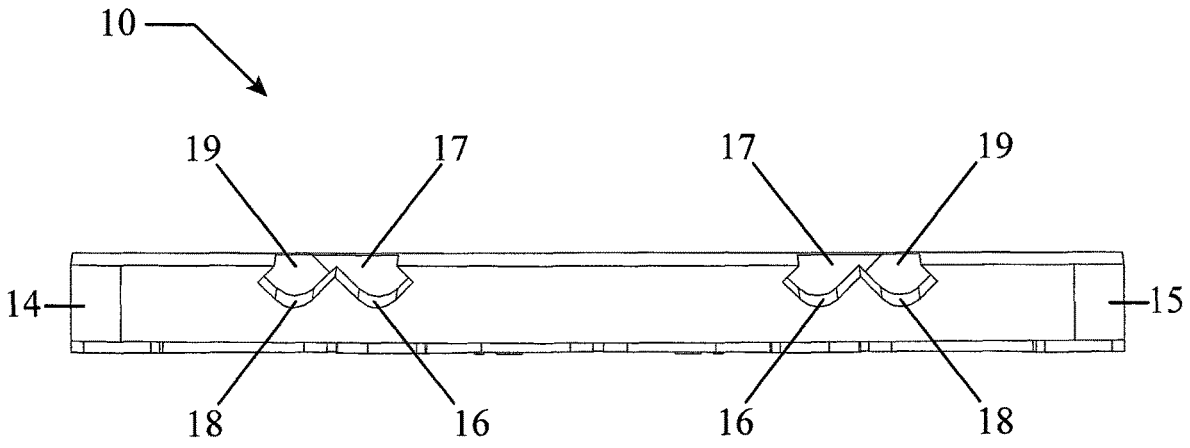
FIG. 13 is a bottom side view of the top piece of the incline board of FIG. 11.

FIG. 11 is a front view of the top piece 10 of the incline board of FIGS. 1-10. FIG. 12 is a rear side view of the top piece 10 of the incline board 1 of FIG. 11. FIG. 13 is a bottom side view of the top piece 10 of the incline board of FIG. 11.

Referring to FIGS. 11-13, top piece 10 can be formed from injection molded plastic, and have a generally rectangular configuration with a length of approximately 12" by approximately 5.5", with a thickness of less than approximately 0.5 inches. Top piece 10 can have a front raised surface 11 which is roughened to allow for grip by rubber bottoms of shoe ware, such as sneakers and the like. The bottom of top piece 10 can have an approximately 45 degree angled tip end 12, and an opposite rounded rear end 13. Top piece 10 can have a flat left side 14 and a flat right side 15.

On the rear side of the top piece 10 can be a pair of spaced apart inner parallel hexagon shape grooves 16 with bottom slots 17 extending through the angled tip end 12. The inner parallel hexagon shape grooves 16 can start from a stop edge approximately 2" from the rounded rear end 13.

The rear side of top piece can also include a pair of outer parallel hexagon shape grooves 18 with bottom slots 19 extending through the angled tip end 12. The outer parallel hexagon shape grooves 18 can start from a stop edge approximately 1.5" from the rounded rear end 13.

An inverted V shaped protrusion runs between each set of outer grooves 18 and inner grooves 16

Rear Vertical Support Piece 20

Figure 14:
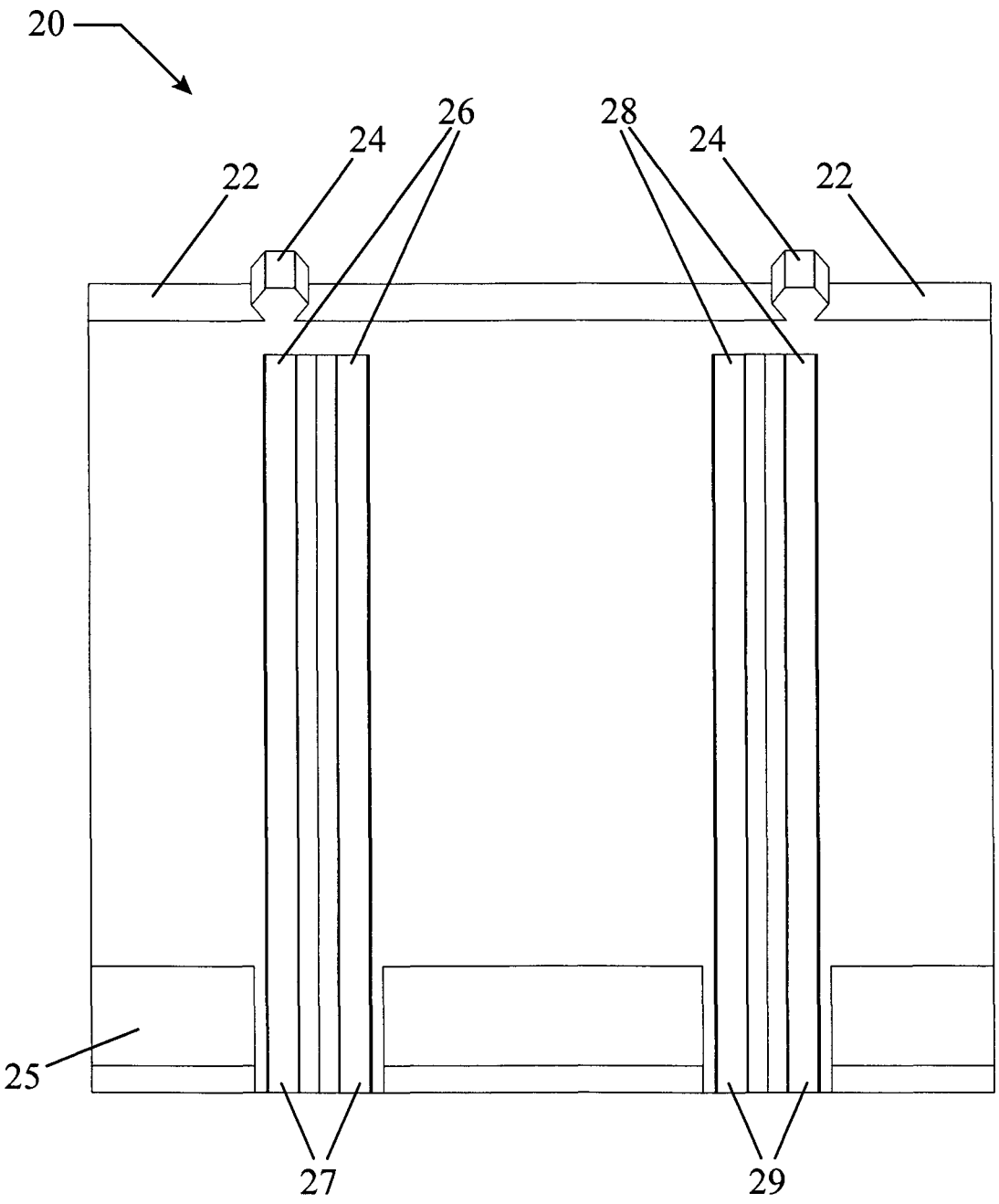
FIG. 14 is an upper front perspective view of the rear vertical support piece of the incline board of FIGS. 1-10.

FIG. 14 is an upper front perspective view of the rear vertical support piece 20 of the incline board 1 of FIGS. 1-10.

Figure 15:
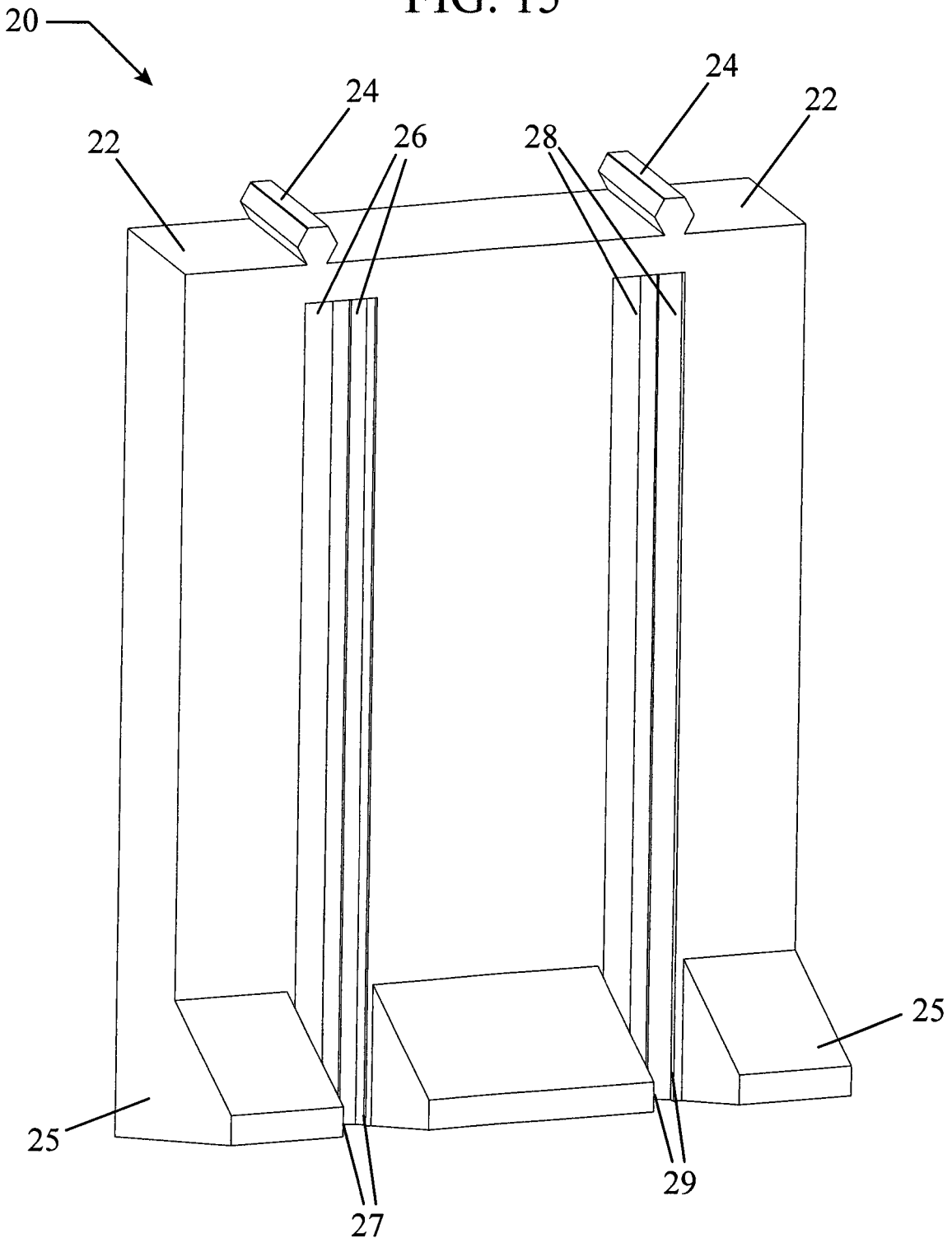
FIG. 15 is an upper front left perspective view of the rear vertical support piece of the incline board of FIG. 14.

FIG. 15 is an upper front left perspective view of the rear vertical support piece 20 of the incline board 1 of FIG. 14.

Figure 16:
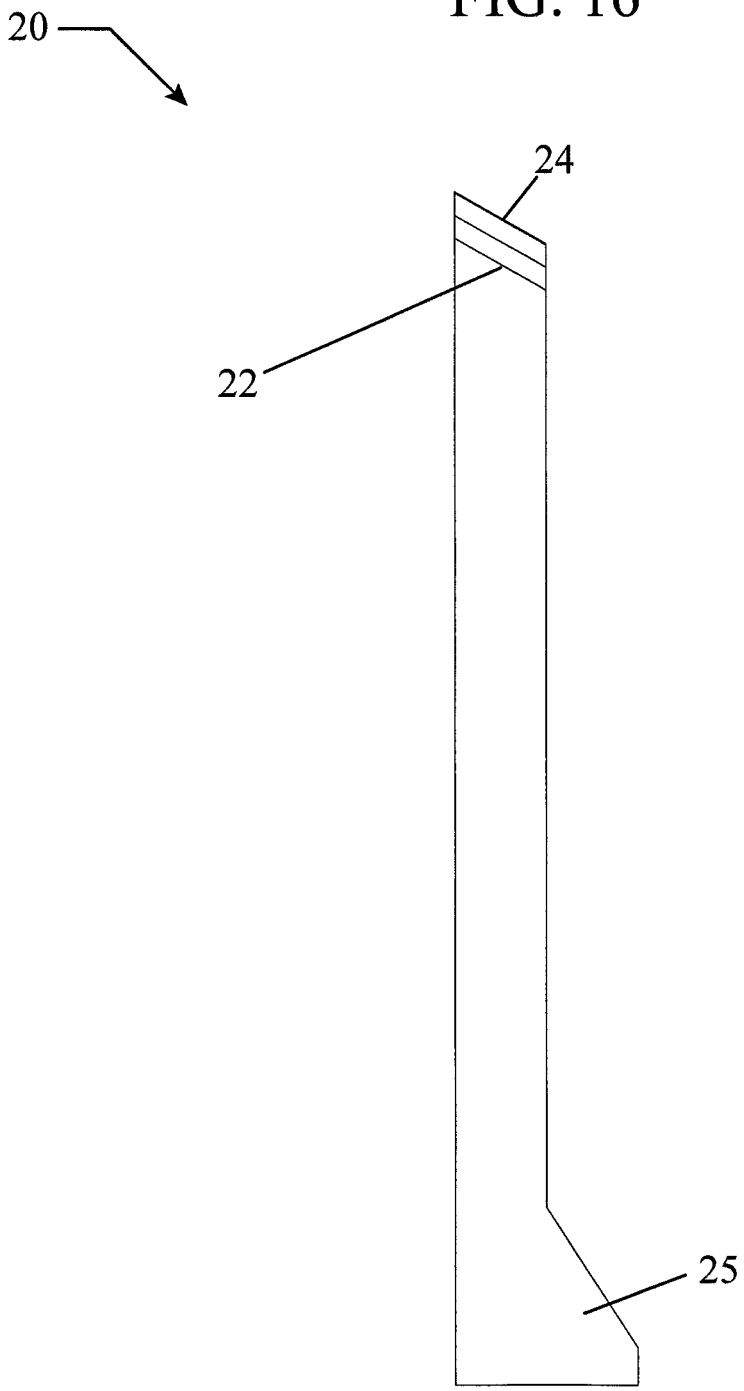
FIG. 16 is a left side view of the rear vertical support piece of the incline board of FIG. 14.

FIG. 16 is a left side view of the rear vertical support piece 20 of the incline board 1 of FIG. 14.

Figure 17:
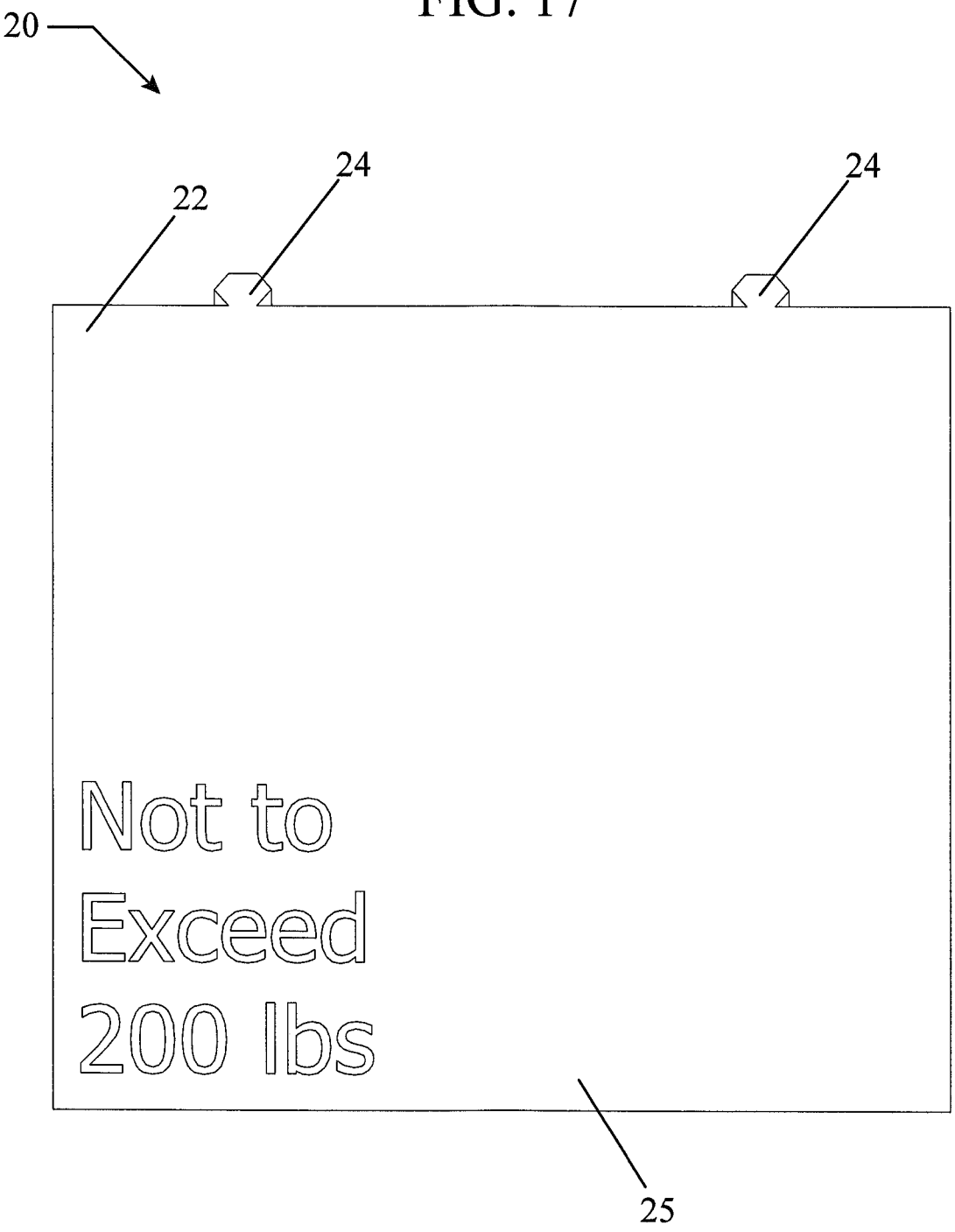
FIG. 17 is a rear perspective view of the rear vertical support piece of the incline board of FIG. 14.

FIG. 17 is a rear perspective view of the rear vertical support piece 20 of the incline board 1 of FIG. 14.

Figure 18:
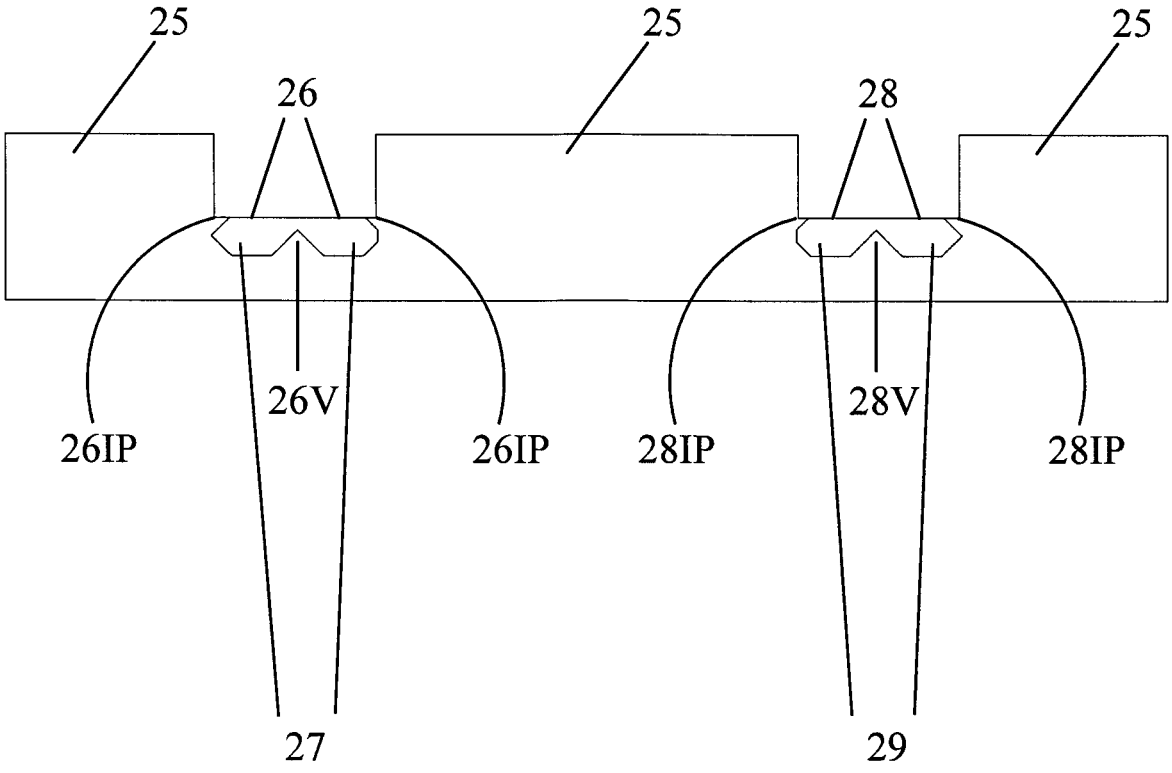
FIG. 18 is a bottom side view of the rear vertical support piece of the incline board of FIG. 14.

FIG. 18 is a bottom side view of the rear vertical support piece 20 of the incline board 1 of FIG. 14.

Referring to FIGS. 14-18, the rear vertical support piece 20 can be formed from injection molded plastic, and have a height length of approximately 5" and a width of approximately 5.5", and a thickness of less than approximately 0.5".

The rear support piece 20 can include a top edge with an approximately degree angled surface 22 with a pair of spaced apart parallel raised hexagon protruding members 24, each can have a generally hexagon shape. The bottom of the rear support piece 20 can include an enlarged triangle shape footer end 25 running from a flat left side to a flat right side.

On the outer face of rear support piece 20 can include a flat surface with engraved and/or raised indicia such as "Not to Exceed 200 lbs"

The inner face of the rear support piece 20 can include a pair of left parallel channels 26 which start below the top end 22 and have open bottoms 27 that pass through the enlarged triangle shape footer end 25. A generally raised triangular protrusion runs between the pair of left parallel channels 26.

An elongated inverted V shape protrusion 26V runs between the left parallel channels 26. A pair of elongated inwardly facing side protrusions 26IP are in the side walls of the parallel channels 26.

One of the pair of spaced apart parallel raised hexagon protruding members 24 can be located on the top end 22 above the most leftward of the left parallel channels 26.

The rear support piece 20 can include a pair of right parallel channels 28 which start below the top end 22 and have open bottoms 29 that pass through the enlarged triangle shape footer end 25.

An elongated inverted V shape protrusion 28V runs between the right parallel channels 28. A pair of elongated inwardly facing side protrusions 28IP are in the side walls of the parallel channels 28.

The other one of the pair of spaced apart parallel raised hexagon protruding members 24 can be located on the top end 22 above the most rightward of the right parallel channels 28.

Right Support Piece 30

Figure 19:
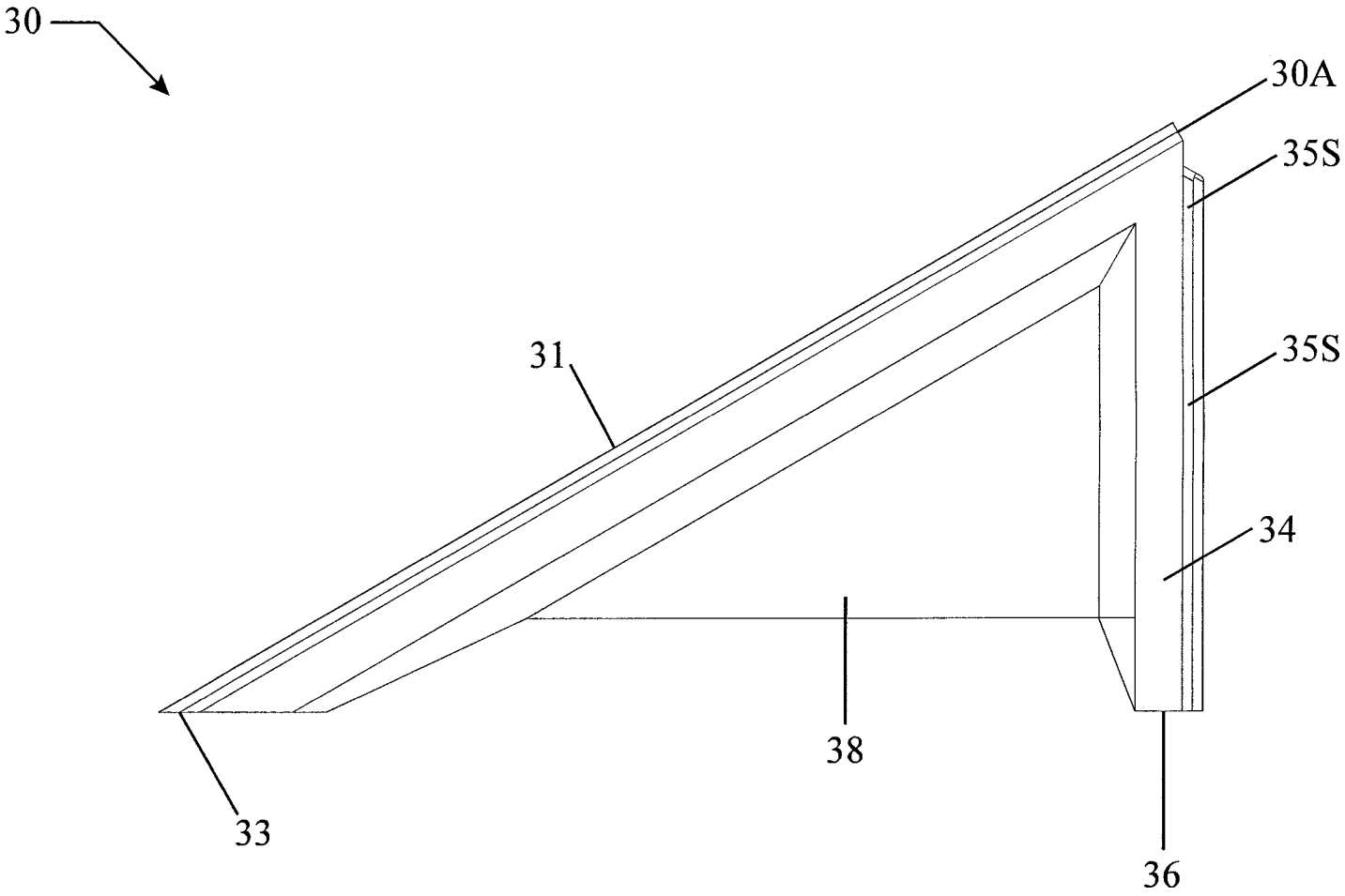
FIG. 19 is a right side perspective view of the right support piece of the incline board of FIGS. 1-10.

FIG. 19 is a right side perspective view of the right support piece 30 of the incline board 1 of FIGS. 1-10.

Figure 20:
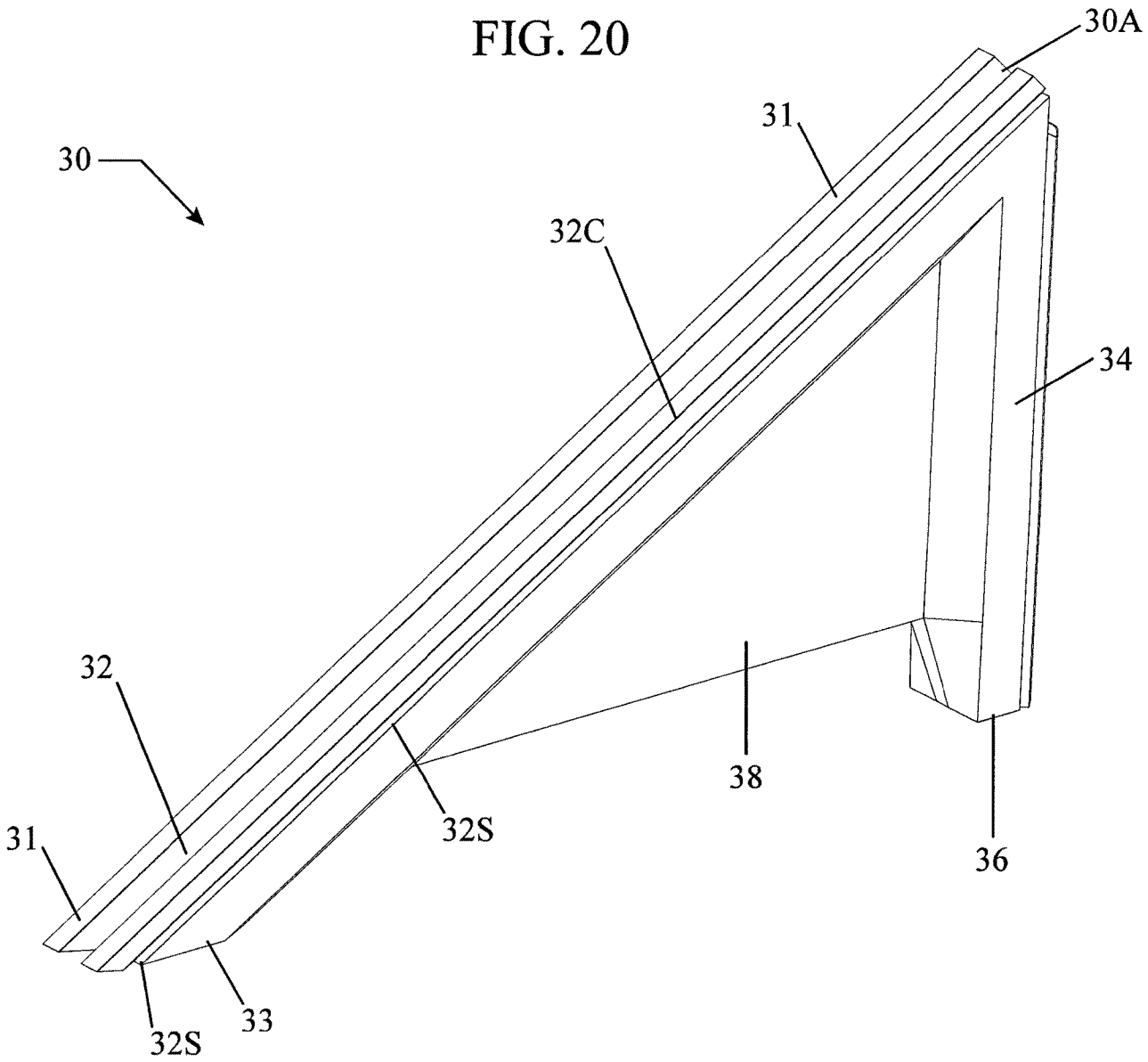
FIG. 20 is an upper right perspective view of the right support piece of the incline board of FIG. 19.

FIG. 20 is an upper right perspective view of the right support piece 30 of the incline board 1 of FIG. 19.

Figure 21:
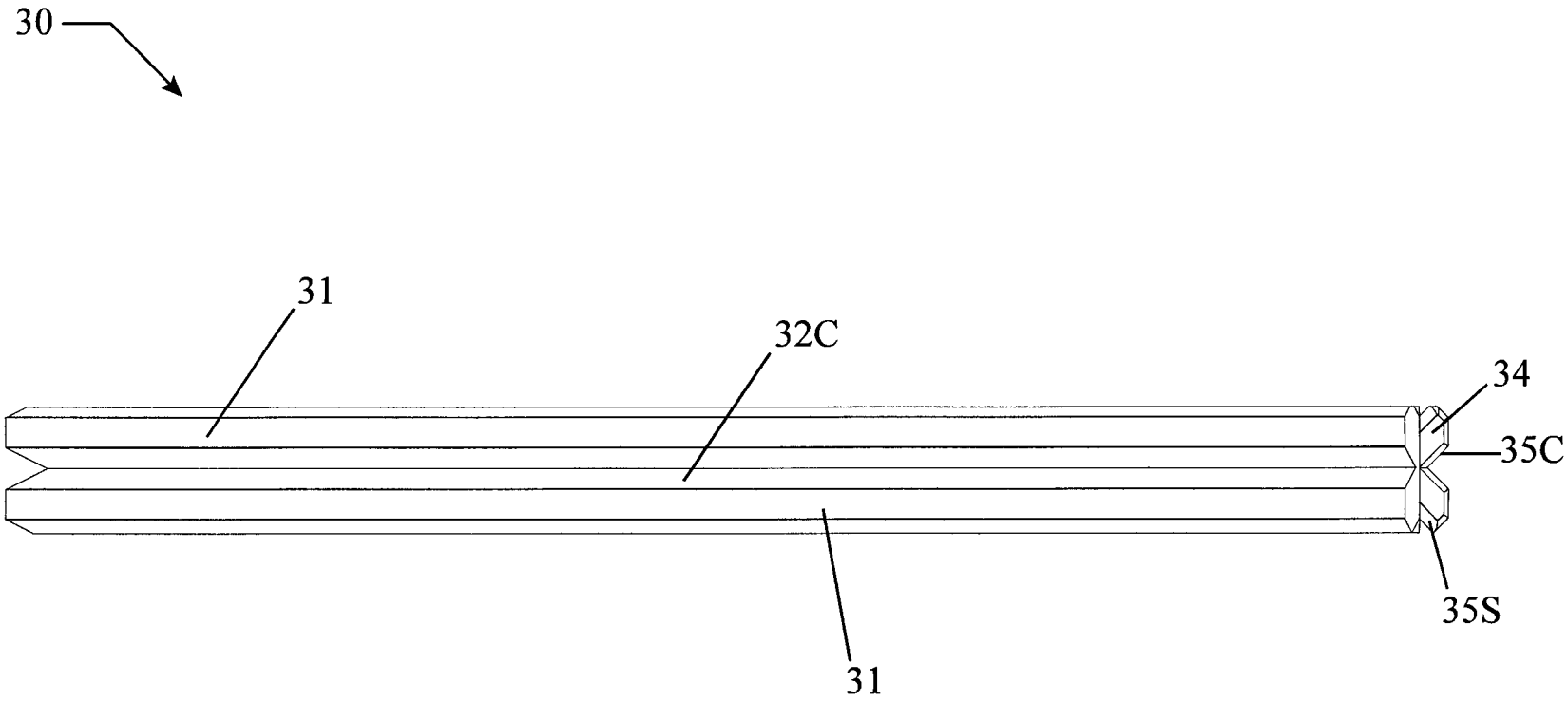
FIG. 21 is a top side view of the right support piece of the incline board of FIG. 19.

FIG. 21 is a top side view of the right support piece 30 of the incline board 1 of FIG. 19.

Referring to FIGS. 19-21, the right support piece 30 can be formed from injection molded plastic, and have a generally right triangle configuration with an approximately 45 degree top angled side member with a groove that runs from a flat left footer end to the apex of the right triangle and through the top edge of the rear vertical leg member 34.

Another groove 35 runs along the rear vertical leg member 34 from the apex of the right triangle and through the flat end of the vertical leg member 38.

The right support piece 30 can have an indented exterior side face, 38 and a flat interior side face 39.

The right support piece 30 can have dimensions of approximately 9.25" for the top angled member 31 and have a height of approximately 4.75" for the length of the rear vertical member 34. The bottom of the triangular configuration of the right support piece 30 can be approximately 8.33" from the lower end of the top angled member 31 to the exterior of the flat end 36 of the rear vertical leg member 34.

The top angled side member 31 can include center V shape groove 32C along the top angled side member 31. The top angled side member 31 can include opposite facing side grooves 32S along exterior sides of top angled side member 31. The grooves 32C and 32S forms a pair of upwardly extending hexagon shape protrusions.

Left Support Piece 40

Figure 22:
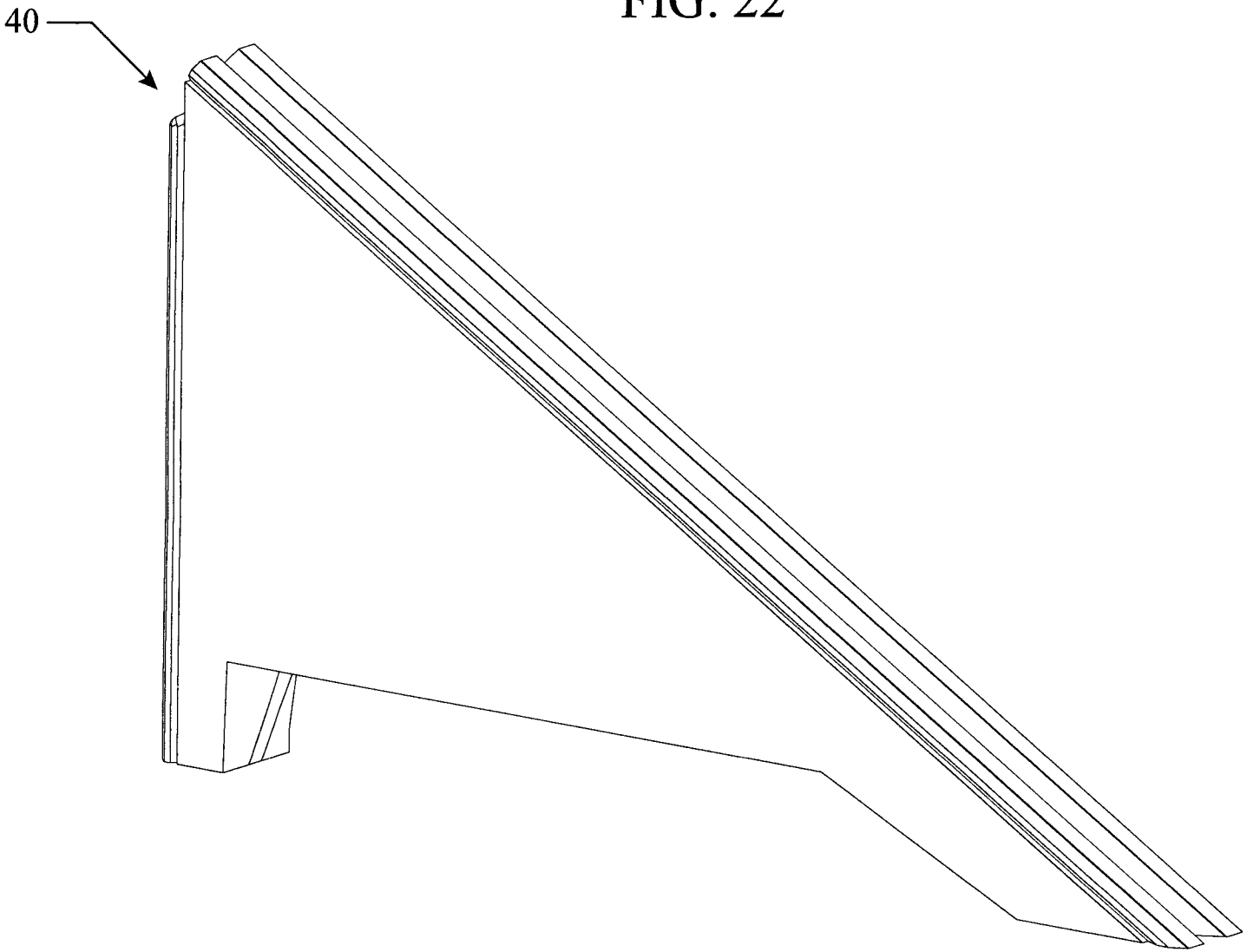
FIG. 22 is an upper front left side perspective view of the left support piece of right-side the incline board of FIGS. 1-10.

FIG. 22 is an upper front left side perspective view of the left support piece of the incline board 1 of FIGS. 1-10. The left support piece 40 can be a mirror image version to the right support piece 30 with identical top angled side member with groove, flat footer end, rear vertical leg member with groove and flat end. The left support piece 40 can also include an indented exterior side face, and a flat interior side face and identical dimensions, protrusions and grooves as in the right support piece 30.

Assembling the incline board 1 will now be described referring to FIGS. 1-21.

To assemble the incline board 1, the apex portion 30A of the right triangular support piece 30 can be positioned so that rear vertical leg member 34 so that center V shape groove 35C and opposite facing side grooves 35S are positioned to slide within open bottom 29 of rear vertical support piece 20.

The assembler aligns the pair of upwardly extending hexagon shape protrusions formed from 35C and 35S to fit into the pair of hexagon shaped grooves 28IP until the top edge of the hexagon shape protrusions abuts against the stop formed in the top of the grooves 28IP.

The assembler can assemble the left triangular support piece 40 in a similar manner into the open bottom 27 of the left parallel channels 26.

Once the right left triangular support piece 30 and left triangular support piece 40 are installed into the rear vertical support piece 20, the respective indented exterior side face 38 of the right triangular support piece 30 and indented exterior side face 48 of the left triangular support piece 40 are facing outward. The combined assembly of the rear vertical support piece 20 with right and left triangular support pieces 30, 40 are slid in the direct of arrow R starting at the approximately 45 degree angled tip end 12 of the top piece 10. as shown in FIG. 9.

The top pair spaced apart parallel raised hexagon protrusions 24 of the rear vertical support piece 20 (shown in FIG. 14) are positioned to pass into the bottom slots 19 of the outer parallel hexagon shape grooves 18 shown in FIGS. 12-13. At the same time, the center V shape groove along top angled side member 31 and opposite facing side grooves 32S of the top angled side member 31 of the right triangular support piece fit about respective Inverted V shaped protrusion runs between each set of outer grooves 18 and inner grooves 16 of top piece 10. The left triangular support piece 40 attaches in a similar manner. The incline board 1 has an assembled position as shown in FIGS. 1-7. and can be disassembled by reversing the steps above.

The assembled incline board 1 can have a height of approximately 6" from the bottom to the rounded rear end 13, and a length of approximately 10" as shown in FIG. 7, with an overall weight of less than a few pounds.

The exercise board can be used to keep muscles and tendons flexible to help avoid injuries. The exercise board can provide good physical therapy for ailments, such as but not limited to plantar fasciitis, achilles tendonitis, and the like.

An example of using the exercise board will now be described.

1. Place board in a standup position on the floor
2. Place right foot on the floor with your toes on the board, while your left foot is still flat on the floor for a balanced position.
3. For extra stability, hold onto a chair or table.
4. Lean forward bending your knee slightly to strengthen your toes, arch, and ankle.
5. Move your foot further up the board with heel still firmly on the floor, and lean forward to stretch muscles and tendons in your calf 5 to 10 times.
6. Move your foot further up the board, then lean forward to feel the stretch in your knee and thigh area, 5 to 10 times.
7. Move your foot further up the board and lean forward again to feel stretch in your hip area.
8. By moving your foot up, the board, you are changing and strengthening different muscles and tendons throughout your exercising routine.
9. After taking a 1-minute cool down period, start the same routine for the left leg.

Second Embodiment

FIG. 23 is an upper front right perspective view of an assembled second embodiment of an incline/exercise board 100. FIG. 24 is another upper front right perspective view of the assembled incline/exercise board 100 of FIG. 23. FIG. 25 is an upper front left perspective view of the incline/exercise board 100 of FIG. 23.

FIG. 26 is a rear right perspective view of the incline/exercise board 100 of FIG. 23. FIG. 27 is a rear left perspective view of the incline/exercise board 100 of FIG. 23. FIG. 28 is a rear right perspective view of the incline/exercise board 100 of FIG. 23. FIG. 29 is a left side perspective view of the incline/exercise board 100 of FIG. 23.

FIG. 30 is an exploded perspective view of the incline/exercise board 100 of FIG. 23. FIG. 31 is a right side view of the exploded incline/exercise board 100 of FIG. 30. FIG. 32 is a rear side view of the exploded incline/exercise board 100 of FIG. 30.

Referring to FIGS. 21-32, the second embodiment incline/exercise board 100 includes a rear vertical support piece 110 (C), a left support piece 120 (B), a right support piece 130 (A), and top (incline board) piece 140 (D).

Each of the support pieces 110, 120, 130 and 140 can be formed from injection molded plastic, and the like.

Top Piece 140 (D)

FIG. 33 is a front perspective view of the top piece 140 of the incline/exercise board 100 of FIGS. 23-32. FIG. 34 is a rear perspective view of the top piece 140 of the incline/exercise board 100 of FIG. 33. FIG. 35 is a bottom end perspective view of the top piece 140 of the incline/exercise board 100 of FIG. 33.

Referring to FIGS. 33-35, the top piece 140 can have a generally rectangular configuration having a length of approximately 9.5 inches and a width of approximately 5.25 inches and a thickness of approximately ⅓ to approximately ½ of an inch. The top piece can have generally triangular edge 141, with a plurality of indentations 142 on a front side and an optional elongated gripping pad 143 on the rear side.

On the front side of the top piece 140 can be a plurality of raised cross shaped protrusions 144 to that form gripping surfaces for the shoe(s) of the user using the incline/exercise board 100. The gripping surfaces 144 can include other shapes, raised protrusions and the like for use as a gripping surface.

On the front side of the top piece 140 can be three vertical rows, each having a pair of rectangular slots 145, with each slot 145 having an indented step 146 formed in the slots. The steps 146 can be used as a step ledge for the L-shaped clips to be described later. On the rear side of the top piece 140 be a central raised ridge 147 side raised ridges 148 that connect the three rows of rectangular slots 145, raised side edges 149 about the side perimeter and upper raised edge 149.

Raised ridges 147, 149 and upper raised edge 149 add strength to the top piece 140.

Rear Vertical Support Piece 110 (C)

FIG. 36 is a rear perspective view of the rear vertical support piece 110 of the incline/exercise board 100 of FIGS. 23-32. FIG. 37 is an upper rear left perspective view of the rear vertical support piece 110 of the incline/exercise 100 board of FIG. 36. FIG. 38 is a left side view of the rear vertical support piece 110 of the incline/exercise board 100 of FIG. 36. FIG. 39 is a front perspective view of the rear vertical support piece 110 of the incline/exercise board 100 of FIG. 36. FIG. 40 is a bottom end perspective view of the rear vertical support piece 110 of the incline/exercise board 100 of FIG. 36.

Referring to FIGS. 36-40, rear vertical support piece 110 can have a generally rectangular configuration with a width of approximately 5.25 inches and a height of approximately 3.5 inches, and a thickness of approximately ⅓ to approximately ½ inch.

Referring to FIGS. 36-40, rear vertical support piece 110 can have an open top edge 112, closed side walls and bottom edges 119. Across the front of rear vertical support piece can be two rows, each having a pair of rectangular slots 115, with interior steps 116 in each of the slots 115. The steps 116 can form a step ledge for the L-shaped clips to be later described. On the rear side, can be a central raised ridge 117 and side and angled raised ridges 118 that connect the three rows of rectangular slots 115. The side and bottom wall edges 119 and raised ridges 117, 118 had support strength to the rear vertical support piece 110.

Right Support Piece 130 (A)

FIG. 41 is a right side perspective view of the right support piece 130 of the incline/exercise board 100 of FIGS. 23-32. FIG. 42 is an upper right perspective view of the right support piece 130 of the incline/exercise board 100 of FIG. 41. FIG. 43 is a top side perspective view of the right support piece 130 of the incline/exercise board 100 of FIG. 41. FIG. 44 is an upper front left side perspective view of the right support piece 130 of the incline/exercise board 100 of FIG. 41.

Referring to FIGS. 41-44, the right support piece 130 can have a generally angled triangular configuration with a bottom length of approximately 5.5 inches, height across the rear side of approximately 3.5 inches, and thickness between approximately ⅓ to approximately ½ inch. The right support piece can have an incline angled top side 132 having three raised L-shaped clips 133 formed thereon, a rear side 134 with two raised L-shaped clips 135 thereon. The bottom of the right support piece 130 can have a front footer 136, and rear footer 138 with a lower side indentation 137 therebetween. About the perimeter of the right support piece 130 can be a raised wall edge. The front side of the support piece 130 can have a generally flat wall. The opposite side can have raised perimeter and cross edges 139 for adding strength to the right support piece 130.

Left Support Piece 120 (B)

FIG. 45 is a left side perspective view of the left support piece 120 of the incline/exercise board 100 of FIGS. 23-32. FIG. 46 is an upper front left side perspective view of the left support piece 120 of FIG. 45. FIG. 47 is a top side perspective view of the left support piece 120 of FIG. 45. FIG. 48 is an upper right side perspective view of the left support piece 120 of FIG. 45.

The left support piece 120 can be a mirror image of the right support piece 130. Referring to FIGS. 45-48, the left support piece 120 can have a generally angled triangular configuration with a bottom length of approximately 5.5 inches, height across the rear side of approximately 3.5 inches, and thickness between approximately ⅓ to approximately ½ inch. The left support piece 120 can have an incline angled top side 122 having three raised L-shaped clips 123 formed thereon, a rear side 124 with two raised L-shaped clips 125 thereon. The bottom of the left support piece 120 can have a front footer 126, and rear footer 128 with a lower side indentation 127 therebetween. About the perimeter of the left support piece 120 can be a raised wall edge. The front side of the support piece 120 can have a generally flat wall. The opposite side can have raised perimeter and cross edges 129 for adding strength to the left support piece 120.

FIG. 49 is a side perspective view of the left support piece 120 of FIGS. 45-47 about to mount to the rear vertical support piece 110 of FIGS. 36-40. The L-shaped clips 125 of the left support piece 120 are lined up to be inserted in the direction of arrows 11 to be inserted into the two vertical rectangular slots 115 on the rear vertical support piece 110. Once inserted, the left support piece is moved downward in the direction of arrow D1.

FIG. 50 is a side perspective view of the right support piece 130 of FIGS. 41-44 about to mount to the rear vertical support piece 110 of FIGS. 36-40. The L-shaped clips 135 of the right support piece 130 are lined up to be inserted in the direction of arrows 11 to be inserted into the two vertical rectangular slots 115 on the rear vertical support piece 110. Once inserted, the right support piece 130 is moved downward in the direction of arrow D1 to catch and lock onto the step ledges 115.

FIG. 51 is an upper side perspective assembled view of both the left support piece 120 and right support piece 130 of FIGS. 41-47 now mounted to the rear vertical support piece 110 of FIGS. 36-40.

The pieces 110, 120, 130 and 14 can be made from injection molded plastic and the like. The pieces can easily be packaged in an overnight cardboard type mailing envelope such as those delivered by UPS® and FED EX®, and wrapped up in the pad 150.

FIG. 52 is an upper side perspective view of the top piece (incline board) 140 of FIGS. 33-35 about to be mounted to the assembled left support piece 120 and right support piece 130 that is mounted to the rear vertical support piece 120 shown in FIG. 51.

Referring to FIGS. 30, 31, 33, 34 and 52 the three rows of rectangular slots 145 of the top piece 140 are lined up to be inserted over the six L-shaped clips 123, 133 on the assembled left support piece 120 and right support piece 130, in the direction of arrows 12. After being inserted, the top piece 140 is slid downward in the direction of arrows D2 to catch and lock onto the step ledges 146.

FIG. 53 is a side cross-sectional view of the assembled incline/exercise board 100 of FIGS. 23-29 showing the L-shaped clips 123 locked about the step ledges 146.

FIG. 54 is a perspective view of the assembled incline/exercise board 100 of FIGS. 23-29 and 53 resting on a mat 150, with a foot 200 being positioned for exercise.

The mat 150 can have dimensions of approximately 6.5 inches wide by approximately 8 inches long, with a thickness of approximately 3 to approximately 4 mm.

FIG. 55A is an upper right front perspective view of the top piece (incline board) 140 of FIGS. 33-35. FIG. 55B is an upper left front perspective view of the top piece (incline board) 140 of FIGS. 33-35. FIG. 55C is an upper left rear perspective view of the top piece (incline board) 140 of FIGS. 33-35. FIG. 55D is an upper right rear perspective view of the top piece (incline board) of FIGS. 33-35.

As previously described, the exercise board 100 can be used to keep muscles and tendons flexible to help avoid injuries. The exercise board 100 can provide good physical therapy for ailments, such as but not limited to plantar fasciitis, Achilles tendonitis, and the like.

Another example of using the exercise board will now be described.

1. Place board i100 n a standup position on a pad 150 on the floor
2. Place right foot 200 on the pad with your toes on the board 100, while your left foot is still flat on the floor for a balanced position.
3. For extra stability, hold onto a chair or table.
4. Lean forward bending your knee slightly to strengthen your toes, arch, and ankle.

5. Move your foot 200 further up the board 100 with heel still firmly on the floor, and lean forward to stretch muscles and tendons in your calf 5 to 10 times.
6. Move your foot 200 further up the board 100, then lean forward to feel the stretch in your knee and thigh area, 5 to 10 times.
7. Move your foot 200 further up the board and lean forward again to feel stretch in your hip area.
8. By moving your foot 200 up the board 100, you are changing and strengthening different muscles and tendons throughout your exercising routine.
9. After taking a 1-minute cool down period, start the same routine for the left foot and leg.

The term "approximately"/"approximate" can be +/−10% of the amount referenced. Additionally, preferred amounts and ranges can include the amounts and ranges referenced without the prefix of being approximately.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An exercise incline board, comprising:

a generally rectangular top piece with rounded top end and angled lower end, the top piece having a raised upper surface, and hexagon shape grooves along a lower surface;

a rear vertical support piece having hexagon shape protrusions along an upper end, and a plurality of elongated grooves along an inner face; and a pair of right angle support pieces, each having raised protrusions along each outer vertical leg, wherein the raised protrusions are fore aligning into the plurality of elongated grooves of the inner face of the rear vertical support, and the hexagon shape protrusions on the upper end of the rear vertical support piece are fore aligning into the hexagon shape grooves along the lower surface of the generally rectangular top piece.

2. A plastic incline exercise board comprising:

a top board having an upper side with raised surface edges, and a lower side with a plurality of slots;

a pair of generally triangular support pieces, each having an upper inclined top side with a plurality of upper raised clips, and a rear side with a plurality of raised rear clips, the upper raised clips adapted to be inserted and locked in the plurality of slots in the lower side of the top board; and a rear vertical support piece having one side with a plurality of slots, wherein the raised rear clips on each of the pair of triangular support pieces are adapted to be inserted into and locked in the plurality of slots on the rear vertical support piece.

3. The plastic incline exercise board of claim 2, wherein the top board has a generally rectangular shape, and the rear vertical support piece has a generally rectangular shape smaller than the rectangular shape of the top board.

4. The plastic incline exercise board of claim 3, wherein the top board includes a triangular shaped front end for allowing the front end of the top board to sit flush on a floor surface.

5. The plastic incline exercise board of claim 4, wherein the triangular shaped front end of the top board includes a grippable surface pad.

6. The plastic incline exercise board of claim 2, wherein each of the triangular support pieces includes:

a front footer; and a rear footer.

7. The plastic incline exercise board of claim 2, wherein the plurality of upper raised clips includes three clips arranged in a first direction, and the plurality of raised rear clips includes two clips arranged in a second direction, the first direction being different from the second direction.

8. The plastic incline exercise board of claim 7, wherein each of the upper raised clips and raised rear clips include: L-shaped clips.

9. The plastic incline exercise board of claim 7, wherein each of the plurality of slots on the lower side of the top board includes: a step ledge.

10. The plastic incline exercise board of claim 7, wherein each of the plurality of slots in the rear vertical support piece includes a step ledge.

11. The plastic incline exercise board of claim 7, wherein each of the plurality of slots on the lower side of the top board and each of the plurality of slots in the rear vertical support piece includes a step ledge.

12. The plastic incline exercise board of claim 2, further comprising:

a flexible mat adapted to fit underneath the exercise board.

13. The plastic incline exercise board of claim 2, wherein the plurality of slots in the top board includes six slots.

14. The plastic incline exercise board of claim 13, wherein the plurality of slots in the rear vertical support piece includes four slots.

15. The plastic incline exercise board of claim 14, wherein each of the slots includes a step ledge.

16. An exercise board assembly for feet, comprising:

a top board having an upper side, and a lower side with a plurality of slots;

a pair of support pieces, each having an upper inclined top side with a plurality of upper raised clips, and a rear side with a plurality of raised rear clips, the upper raised clips adapted to be inserted and locked in the plurality of slots in the lower side of the top board; and a single rear vertical piece having a plurality of slots, wherein the raised rear clips on the pair of support pieces are adapted to be inserted into and locked in the plurality of slots on the rear vertical support piece.

17. The exercise board assembly of claim 16, wherein each of the slots includes a step ledge.

* * * * *